US005427461A

United States Patent [19]

Hirai et al.

[11] Patent Number: 5,427,461

[45] Date of Patent: Jun. 27, 1995

[54] SERIAL PRINTER WITH CARRIAGE POSITION CONTROL

[75] Inventors: Yuichi Hirai; Masashi Kamada; Masashi Matsumoto, all of Kawasaki; Noriyuki Suzuki, Tokyo, all of Japan

[73] Assignee: Canon Kabushiki Kaisha, Tokyo, Japan

[21] Appl. No.: 113,326

[22] Filed: Aug. 30, 1993

[30] Foreign Application Priority Data

| | | | |
|---|---|---|---|
| Aug. 31, 1992 | [JP] | Japan | 4-255956 |
| Sep. 29, 1992 | [JP] | Japan | 4-283671 |
| Oct. 29, 1992 | [JP] | Japan | 4-314001 |
| Nov. 10, 1992 | [JP] | Japan | 4-324864 |
| Apr. 28, 1993 | [JP] | Japan | 5-125328 |

[51] Int. Cl.[6] ..... B41J 19/14

[52] U.S. Cl. ..... 400/279; 400/322

[58] Field of Search ..... 400/279, 320, 322; 250/237 G, 231.14–231.18

[56] References Cited

U.S. PATENT DOCUMENTS

| | | | |
|---|---|---|---|
| 4,652,159 | 3/1994 | Nagai | 400/322 |

FOREIGN PATENT DOCUMENTS

| | | | |
|---|---|---|---|
| 0157048 | 10/1985 | European Pat. Off. | 400/279 |
| 0226449 | 6/1987 | European Pat. Off. | 400/322 |
| 0300823 | 1/1989 | European Pat. Off. | 400/279 |
| 0357526 | 3/1990 | European Pat. Off. | 400/322 |
| 0372844 | 6/1990 | European Pat. Off. | 400/322 |
| 0401843 | 12/1990 | European Pat. Off. | 400/322 |
| 2157187 | 6/1973 | France | 400/322 |
| 54429 | 4/1980 | Japan | 400/279 |
| 3075180 | 3/1991 | Japan | 400/322 |
| 3099874 | 4/1991 | Japan | 400/322 |
| 3265481 | 11/1991 | Japan | 400/279 |
| 188931 | 7/1992 | Japan | 400/279 |
| 1378234 | 12/1974 | United Kingdom | 400/322 |

OTHER PUBLICATIONS

H. Inada, et al. "Digital Servo System for Impact Serial Printer", 298 N.E.C. Research and Development, No. 65, pp. 16–23 (1982).

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

A serial printer for recording with a recording head while synchronizing with a movement of a carriage reciprocated on an apparatus body and on which the recording head is mounted. A position of a linear encoder is detected by a detecting portion. A detecting signal from this detecting portion is compared with a reference voltage, and a pulse output as a synchronous signal is generated. A duty of this pulse output is adjusted to obtain a well-recorded result.

20 Claims, 44 Drawing Sheets

FIG. 15A
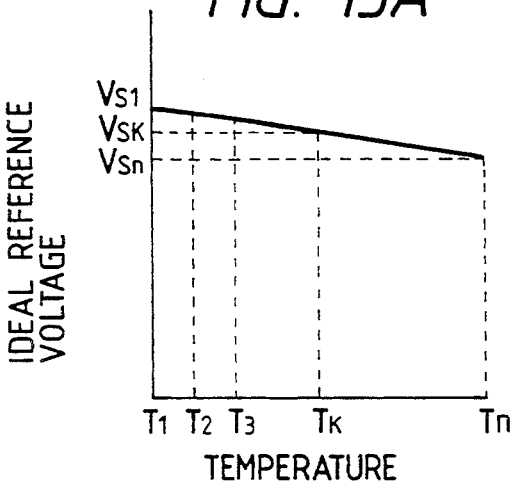
FIG. 15B
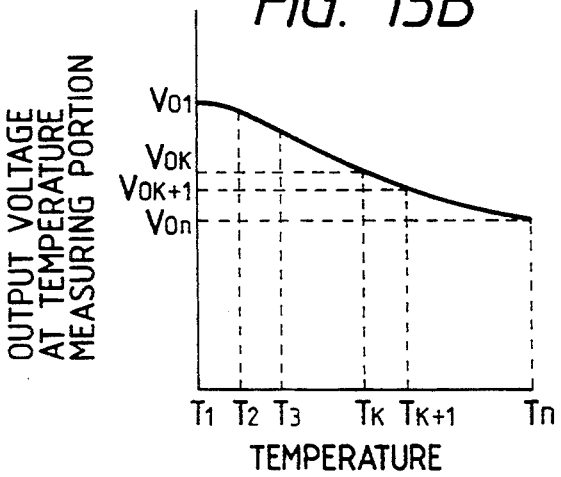
FIG. 15C
| T | VO | VS |
|---|---|---|
| T1 | VO1 | VS1 |
| T2 | VO2 | VS2 |
| T3 | VO3 | VS3 |
| ⋮ | ⋮ | ⋮ |
| TK | VOK | VSK |
| ⋮ | ⋮ | ⋮ |
| Tn | VOn | VSn |
DATA STORED IN MEMORY
FIG. 15D
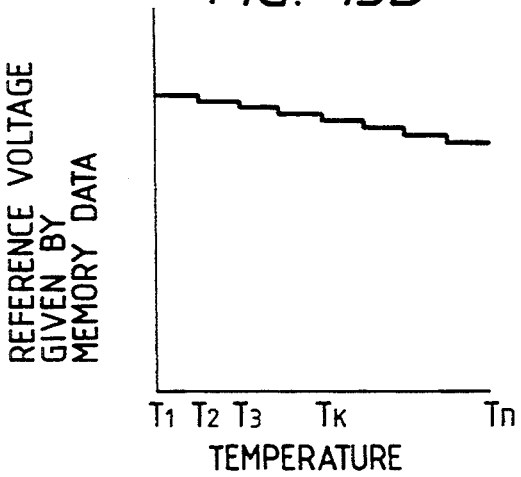

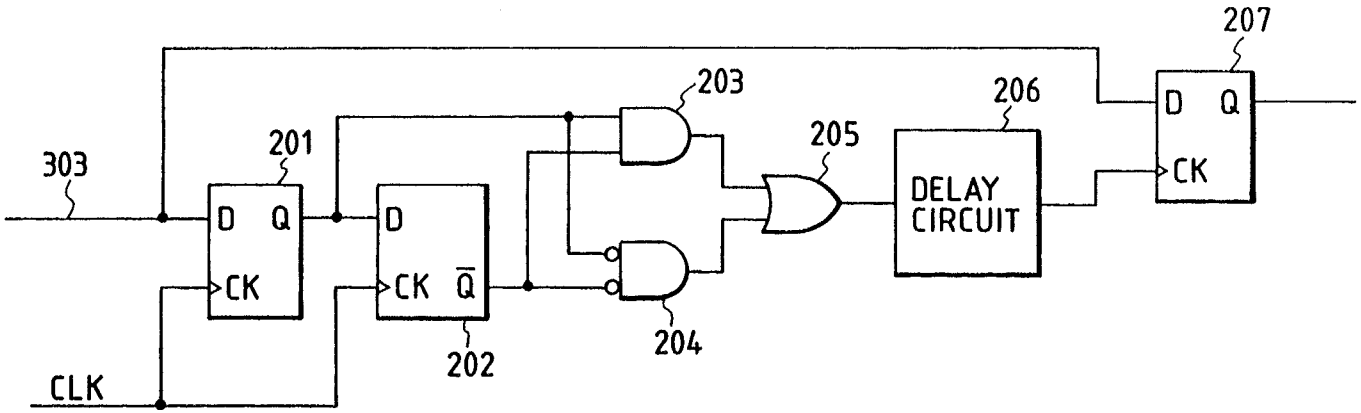
FIG. 24
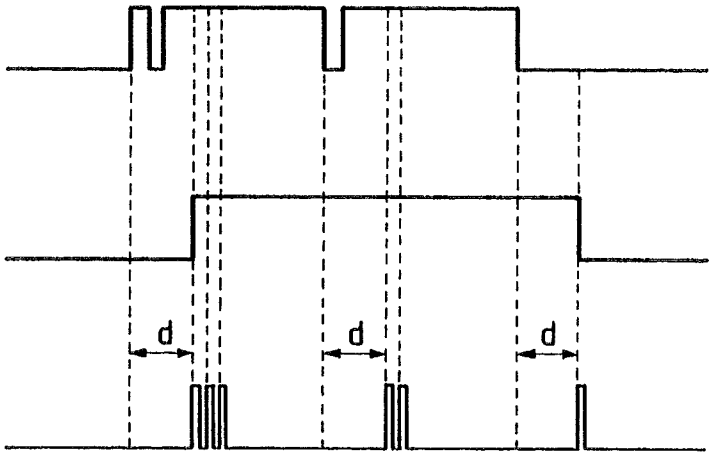
FIG. 25A
FIG. 25B
FIG. 25C

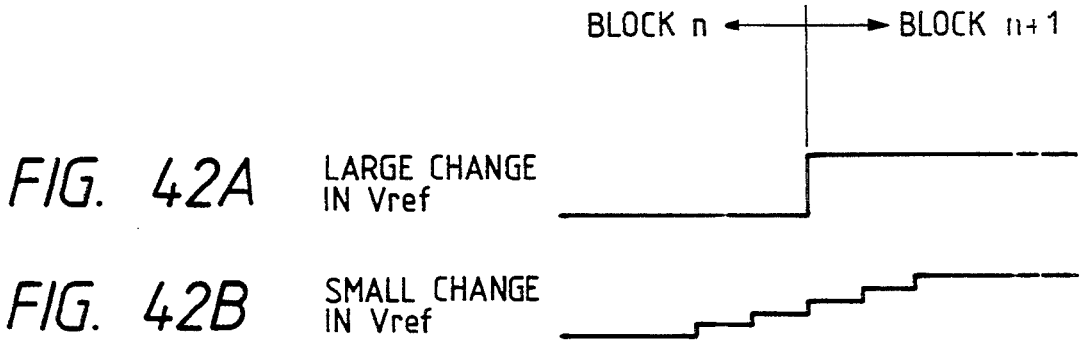
FIG. 48
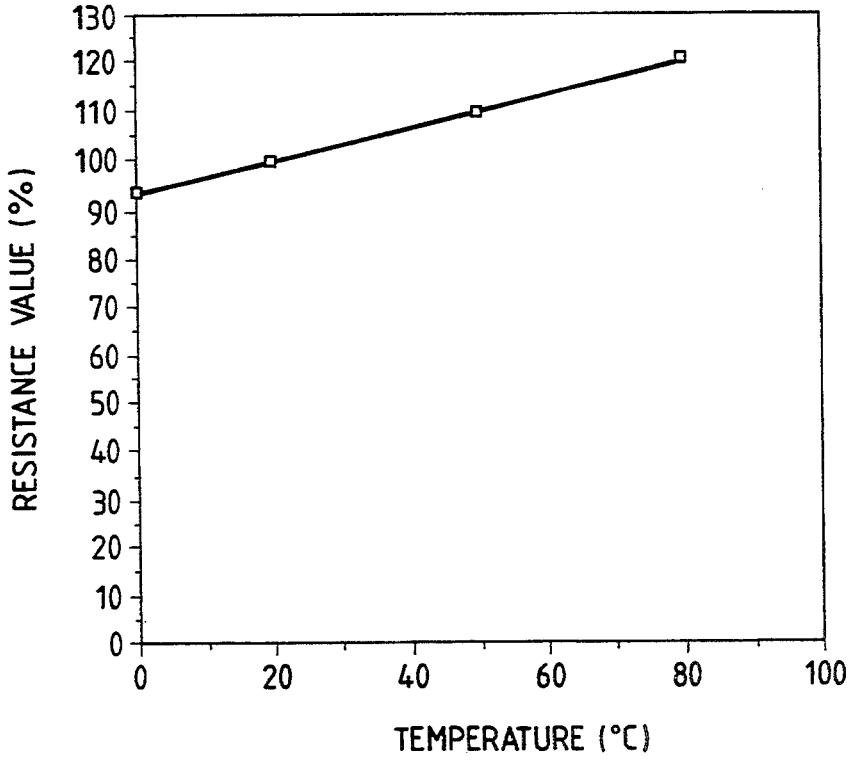

SERIAL PRINTER WITH CARRIAGE POSITION CONTROL

BACKGROUND OF THE INVENTION

1. Field of the Invention

The present invention relates generally to a serial printer and, more particularly, to a serial printer including a synchronous signal generating circuit for synchronizing a movement of a carriage mounted with a printing head with a recording action of the recording head.

2. Related Background Art

A serial printer performs a record (print) while causing a carriage mounted with a printing head of a recording means to scan across a recording medium. If a carriage speed fluctuates due to some influence, however, a scatter in density appears as a result of recording. Especially in a color printer, the problem is a deviation in terms of color registration.

One of known methods of obviating these problems has hitherto involved steps of detecting a moving quantity of the carriage mounted with the recording means with respect to an apparatus body and performing a recording action through the recording means while synchronizing with this detected result.

More specifically, a scale portion of a linear encoder is fixed to the apparatus body. The carriage which moves relatively to this scale portion is mounted on a detecting portion of the linear encoder. On the other hand, an output signal from this detecting portion is amplified and thereafter fetched outside the carriage. A recording signal is generated in synchronization with this amplified signal, thereby preventing occurrences of the scatter in the printing density and of the deviation in the color registration.

An example of the prior art will be explained with reference to the drawings. FIG. 44 is a circuit diagram showing a configuration of a synchronous signal generating circuit in the conventional example. The scale portion of the linear encoder is mounted in the carriage and fixed to the apparatus body. A detecting portion 101 of the linear encoder detects a relative moving position of the carriage with respect to the apparatus body by detecting the scale portion. The detecting portion 101 consisting of MR elements which act based on a magnetic resistance effect is provided integrally with a pair of magnetic detecting elements 102, 103. This detecting portion 101 is also connected to a substrate 5 mounted on the carriage and shown by a broken line in the Figure. Connected, as known well, to this substrate 5 are amplifiers 104, 105 constituting constant current circuits, an amplifier 106 for amplifying a detected signal and a comparator 107. An output signal 303 is thereby outputted. Then, a variable resistor 158 for determining a reference voltage is connected to the comparator 107 and packaged on the substrate 5. An adjustment thereof is thus made on the carriage.

The operation of the thus constructed circuit will be explained. The magnetic detecting elements 102, 103 are supplied with a constant current via the constant current circuits 104, 105, respectively. Magnetic patterns are previously recorded at a fixed interval on the scale portion of the linear encoder which is fixed to the apparatus body. The detecting portion 101 moves along the scale portion. With this movement, resistance values of the magnetic detecting elements 102, 103 vary. The variation in the resistance value is detected as a change in voltage and amplified by the amplifier 106. An amplified signal is inputted to one input terminal of the comparator 107. This comparator 107 compares the amplified signal with a reference voltage preset by an adjustment of the variable resistor 158 and inputted to the other input terminal of the comparator 107. An output signal 303 is thereby obtained as a synchronous signal.

Further, an adverse effect may be exerted on the printing/recording result because of a high dependency on temperatures according to a detecting device and a circuit system. A detailed explanation will be given based on the drawings. FIG. 45A is a diagram showing a relationship of the reference voltage versus the signal inputted to the comparator 107. FIG. 45B is a pulse waveform diagram showing a relationship of the output signal 303 of the comparator 107 in combination with FIG. 45A. An input signal 301 to the comparator 107 takes, as depicted in the Figure, a waveform approximate to a sine waveform which varies with a fixed period.

On the other hand, in the pulse-shaped output signal 303 of the comparator, in consequence of obtaining the reference voltage as a threshold value, a difference between the input signal 301 and the reference voltage 302 appears, as can be understood from the Figure, in the form of a duty change in the output signal. If the recording/printing action is executed in synchronization with this output signal 303, the scatter in the density and a ruled-line deviation in an output image are caused. This results in a remarkable decline in terms of recording quality.

FIGS. 46A and 46B are explanatory views of the recording action, showing how dots D are recorded on a recording medium by driving a recording means in synchronization with the output signal 303 described above. As illustrated in the Figure, a fluctuation in pitch P between the dots D can be seen, and consequently, the scatter in the density is produced as a result of recording. Particularly in the color printer, this may cause the deviation in the color registration.

As explained above, in the conventional apparatus, the recording/printing action is effected synchronizing with the output signal. Therefore, the duty change in the output signal pulse waveform leads directly to the decline in quality as a result of printing.

Further, in the conventional apparatus, a means for restraining the duty change in the output signal pulse waveform depends on a stability of the circuit elements themselves. Hence, expensive parts have to be employed. A problem arises in terms of increasing the costs.

Additionally, when examining the conventional example from a different point of view, the temperature dependency is high according to the detecting device and the circuit system as well in the example of the prior art. The adverse influence may be therefore exerted on the printing/recording result. FIG. 47 is a graphic chart showing a temperature dependency characteristic with respect to a magnetic resistance effect rate of the MR element. FIG. 48 is a graphic chart showing a temperature dependency characteristic with respect to a resistance value of the MR element. An output of this MR element is expressed by the following formula:

$$V_s = K \times (\Delta\rho/\rho) \times R \times i$$

where k is the constant, $\Delta\rho/\rho$ is the magnetic resistance effect rate, R is the electric resistance, and i is the rated current.

The MR element expressed by the preceding formula and shown in FIGS. 47, 48 has the large temperature dependency characteristic, and hence, its output becomes as illustrated in FIG. 17.

The following is an explanation of actions in a case where such an MR element is employed in the detecting portion of the linear encoder. FIG. 49A is a waveform diagram showing relationship of the reference voltage 302 versus the signal 301 inputted to the comparator 107. FIG. 49B is a waveform diagram of the synchronization output signal 303 obtained when establishing the relationship shown in FIG. 49A. The input signal 301 to the comparator 107 assumes a waveform approximate to the sine waveform which varies, as shown in the Figure, with a fixed period.

On the other hand, in the output signal 303 of the comparator, in consequence of obtaining the reference voltage 302 as a threshold value, a difference between the input signal 301 and the reference voltage 302 appears, as can be understood from FIGS. 45A and 45B, in the form of a duty change in the output signal. If the recording/printing action is executed in synchronization with this output signal 303, the scatter in the density and a ruled-line deviation in an output image are caused. This results in a remarkable decline in terms of recording quality. For this reason, as already explained in relation to FIGS. 46A and 46B, the fluctuation in pitch P between the dots D can be seen, and consequently, the scatter in the density is produced as a result of recording. Particularly in the color printer, this may cause the deviation in the color registration.

SUMMARY OF THE INVENTION

It is a first object of the present invention to provide a serial printer capable of restraining a duty change.

It is a second object of the present invention to provide a serial printer capable of preventing a mistake in counting due to noises entering a synchronous signal generating circuit.

It is a third object of the present invention to provide a serial printer capable of obtaining an excellent recording result over a wide temperature range.

It is a fourth object of the present invention to provide a serial printer capable of adjusting a reference voltage to obtain an ideal reference voltage.

It is a fifth embodiment of the present invention to provide a serial printer capable of obtaining the ideal reference voltage in an entire moving range of a carriage even when a gap between a scale portion of a magnetic linear encoder and MR elements of a detecting portion is not fixed.

BRIEF DESCRIPTION OF THE DRAWINGS

Other objects and advantages of the present invention will become apparent during the following discussion in conjunction with the accompanying drawings, in which:

FIG. 15A is a chart showing a relationship of a temperature versus an ideal reference voltage of a comparator;

FIG. 15B is a chart showing a relationship of a temperature versus an output voltage of a temperature measuring portion illustrated in FIG. 14;

FIG. 15C is a diagram showing a relationship between a set value of the reference voltage and the reference voltage of the temperature measuring portion which are stored in a memory shown in FIG. 14;

FIG. 15D is a chart showing a relationship of a temperature versus a reference voltage given by data of the memory shown in FIG. 14;

FIG. 24 is a circuit diagram illustrating a noise filtering circuit provided in place of the counter shown in FIG. 21 in an eighth embodiment of this invention;

FIGS. 25A–25C are time charts of respective portions of the noise filtering circuit shown in FIG. 24;

FIGS. 42A and 42B are explanatory time charts each showing variations in the reference voltage of the comparator depicted in FIG. 34;

FIG. 48 is a chart showing a relationship of a temperature versus a resistance value of the MR element.

DETAILED DESCRIPTION OF THE PREFERRED EMBODIMENTS

Figure 1:
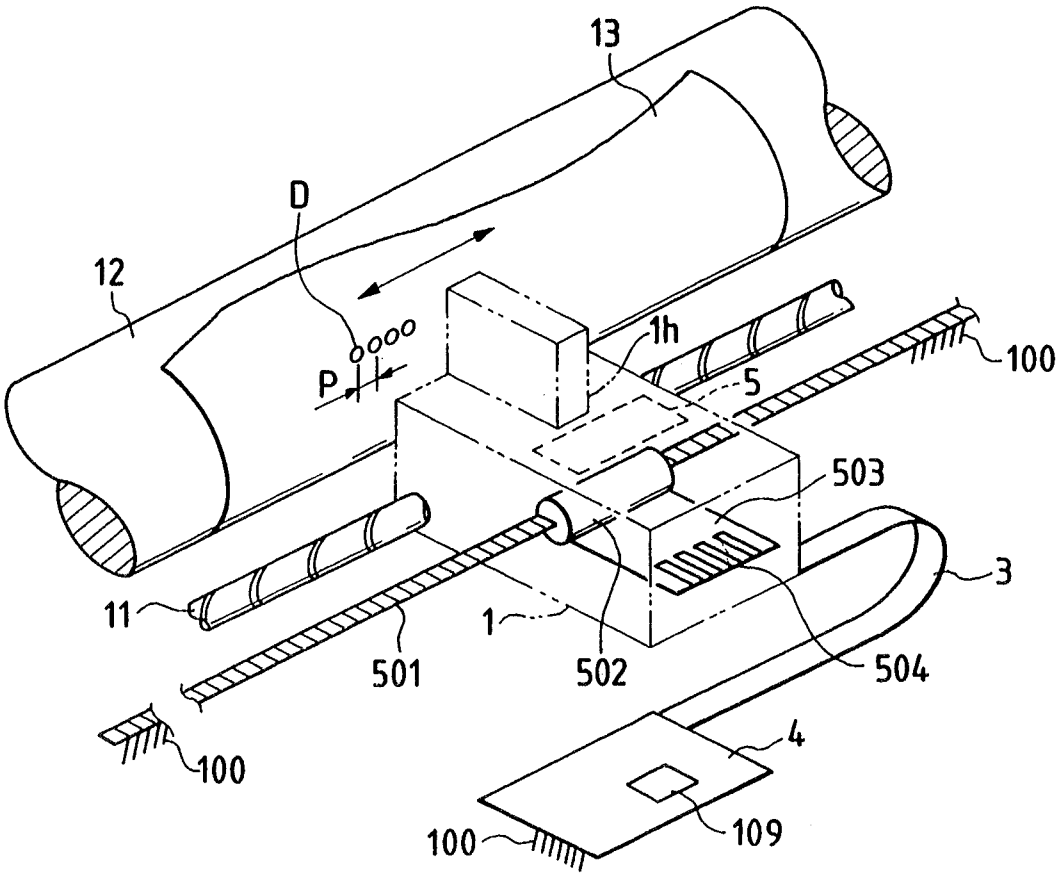
FIG. 1 is a perspective view illustrating the principal portion of a serial printer according to the present invention.

Preferred embodiments of the present invention will hereinafter be described with reference to the drawings. FIG. 1 is a perspective view illustrating the principal portion of a serial printer together with a recording medium. Referring to FIG. 1, a carriage 1 indicated by a dashed line is mounted with a recording portion 1*h* based on an ink jet recording method. On the other hand, the carriage 1 is guided by a guide shaft member 11 formed with a helical groove in the outer peripheral surface thereof. An engagement portion (unillustrated) is propelled along the helical groove with rotations of the guide shaft member 11. The carriage 1 is thus reciprocated in arrowed directions in the Figure with respect to a recording sheet 13 wound on the outer peripheral surface of a platen 12. Dots D are recorded at pitches P on the recording sheet (recording medium) 13, thus forming an image or a character. A so-called serial printer is constructed in this manner.

The thus constructed carriage 1 incorporates an encoder for obtaining a synchronous signal. This encoder is a magnetic linear encoder. The following is an arrangement thereof. A magnetic pattern is recorded with a printing pitch density corresponding to, e.g., 180 dot/inch (dpi) or 360 dpi on a magnetic substance formed on a wire surface. A scale portion 501 of the linear encoder is fixed to an apparatus body 100. On the other hand, a magnetic head 502 composed of MR elements, etc. is fixed inwardly of the carriage 1. A positional detection is thereby attainable with the movements of the carriage 1.

Further, a flexible printed circuit board 503 for fetching output signals to the outside from the MR elements in the magnetic head is connected to the magnetic head 502. A connecting portion 504 is connected to a connector (not shown), thus making a connection to a substrate 5 mounted on the carriage 1 and shown by a broken line in the Figure.

(First Embodiment)

Figure 2:
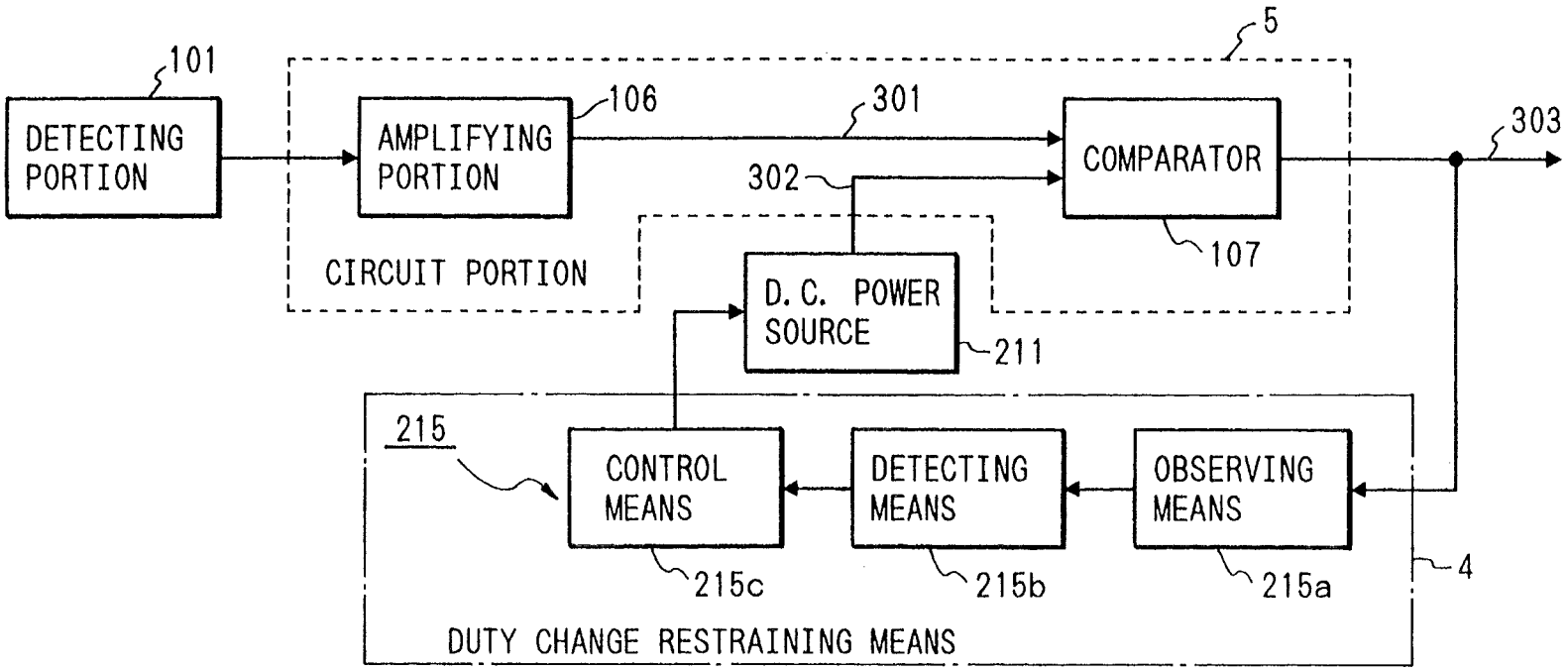
FIG. 2 is a diagram showing a block control circuit for generating a synchronous signal from an encoder of the printer shown in FIG. 1 in a first embodiment of this invention.

Next, FIG. 2 is a basic block diagram in a first embodiment of the present invention. A duty change restraining means according to this invention, designated at 215 in the Figure, is constructed of a duty observing means 215*a*, a detecting means 215*b* and a control means 215*c*. A control output from the duty change restraining means 215c is transferred to a control input of a reference voltage 302 of a DC voltage source 211. The reference voltage 302 serves as an output generation threshold with respect to an input signal 301 inputted to a comparator 107 via an amplifying portion 106 from a detecting portion 101. The reference voltage 302 is thereby stabilized with respect to a duty of the output signal.

Figure 3:
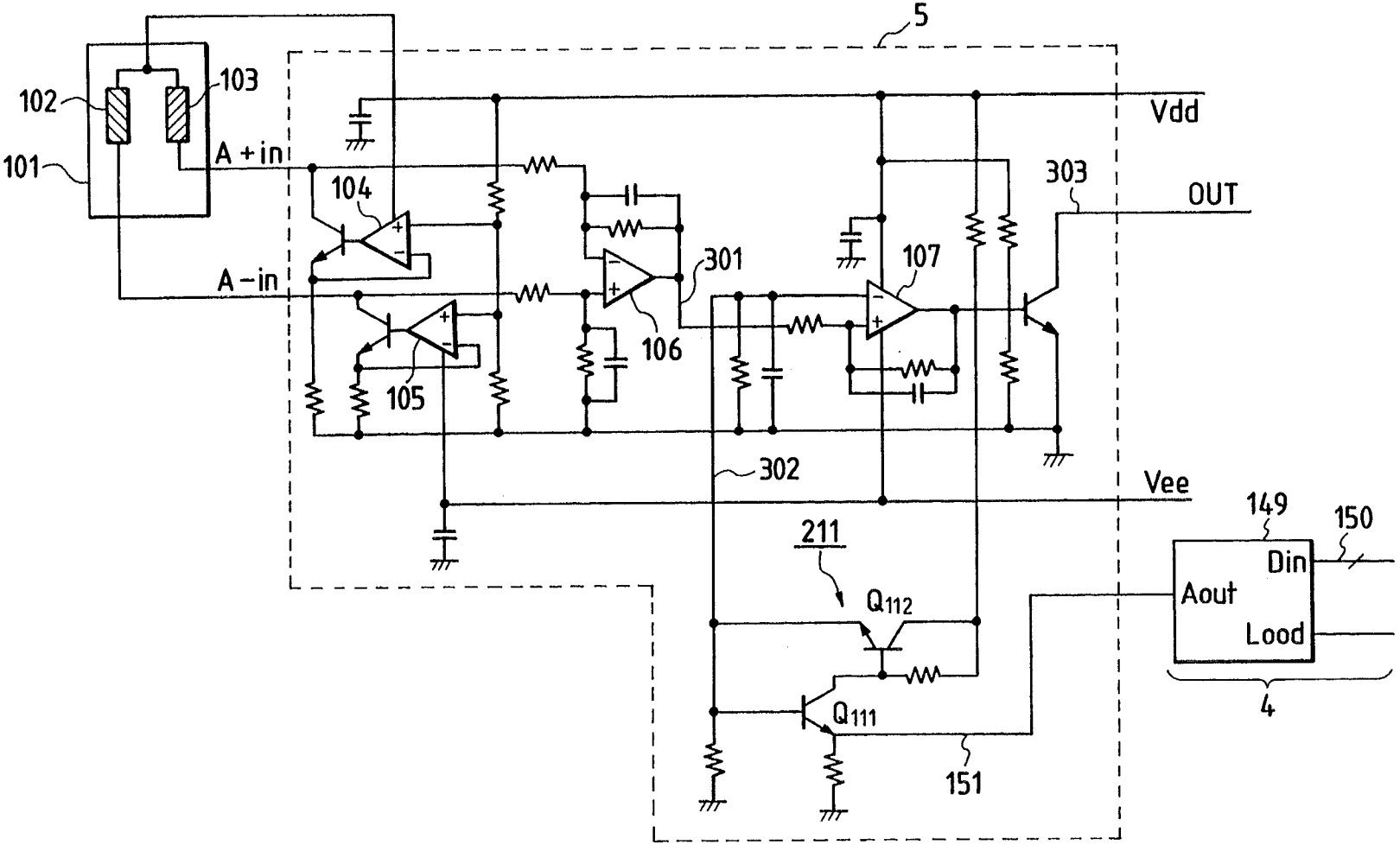
FIG. 3 is a circuit diagram fully illustrating a synchronous signal generating circuit shown in FIG. 2.
Figure 4:
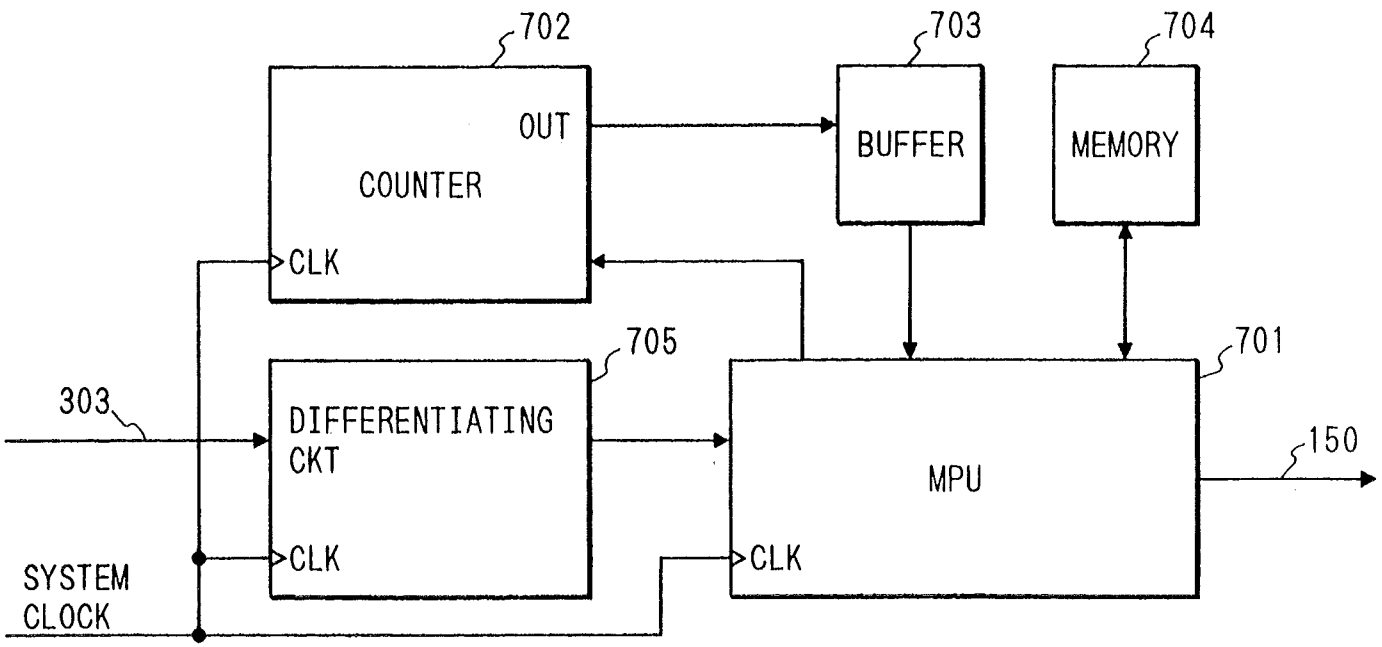
FIG. 4 is a diagram showing a block control circuit of a duty change restraining means shown in FIG. 2.

FIGS. 3 and 4 illustrate examples of circuitry based on the block diagram (FIG. 2). Turning to FIG. 3, the detecting portion 101 is provided with magnetic detecting elements (MR elements) 102, 103. A magnetic part of the scale portion of the linear encoder is scanned by the magnetic detecting elements 102, 103. Variations in magnetic resistance in the magnetic detecting elements are thereby detected based on the circuitry of the substrate 5. Constant current sources 104, 105 in the circuit of the substrate 5 give a proper bias to a lever as a whole in order to detect negative signals through the MR elements. A result of scanning magnetic characteristics of the scale portion of the linear encoder by the detecting portion 101 is approximate to a sine wave and then transmitted to the amplifying portion 106. This sine wave is converted into a pulse output with the reference voltage 302 serving as a threshold value. The comparator 107 is provided therefor and outputs an output signal 303. A pulse duty of this output signal 303 is compared and examined. A duty change restraining means (which will be mentioned later) constructed in a control circuit substrate 4 generates an input data signal 150 so that a duty ratio becomes 50%. The input data signal 150 is transferred to a D/A (digital-to-analog) converter 149. The D/A converter 149 converts the input data signal defined as a digital value into a control voltage signal 151 as an analog value. The control voltage signal 151 is inputted to a DC voltage source consisting of transistors $Q_{111}$, $Q_{112}$. The DC voltage source 211 generates the reference voltage 302 having a proper voltage value on the basis of the control voltage signal 151. The reference voltage 302 is inputted to one input terminal of the comparator 107.

FIG. 4 is a circuit block diagram of the above-mentioned duty change restraining means. Indicated at 705 in FIG. 4 is a differentiating circuit, to which the output signal 303 is inputted from the comparator, for detecting a switchover of the level of the output signal 303. An MPU 701 controls actions of the respective functional elements. A counter 702 measures an output pulse width (in other terms, a duty). A buffer 703 temporarily stores a count value of the counter 702. A memory 704 stores a control algorithm and a table of the threshold values.

Figure 5:
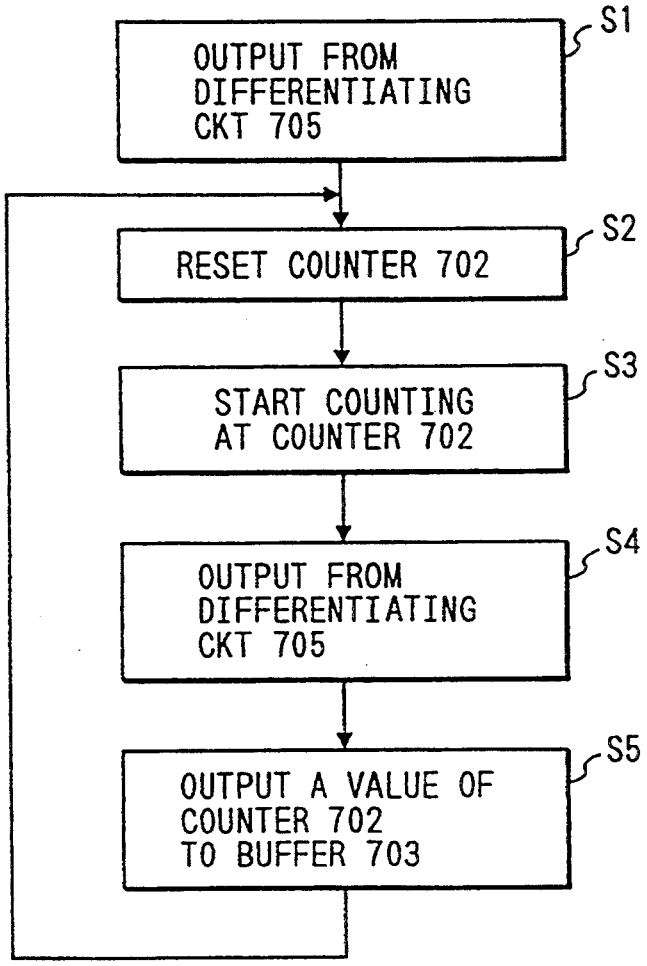
FIG. 5 is a flowchart of an observing means of the duty change restraining means shown in FIG. 4.

FIG. 5 is a flowchart showing actions of the observing means in the duty change restraining means. At the first onset, when the level of the output signal 303 is switched over, the differentiating circuit 705 gives forth a trigger output to the MPU 701 (step S1). The MPU 701 receiving the trigger output causes, after resetting the counter 702 (step S2), the counter 702 to start counting for measuring a pulse width of the output signal (step S3). After a certain period has elapsed, the level of the output signal 303 is inverted. The differentiating circuit 705, when the level is inverted, gives forth a trigger output (step S4). At this time, the MPU 701 outputs the count value of the counter 702 to the buffer 703 (step S5). Incidentally, at this time the MPU recognizes that the data of the count value has been inputted to the buffer 703. The action goes back to step S2. The same steps as those described above are hereinafter sequentially repeated, thus observing the duty of the output pulse.

Figure 6:
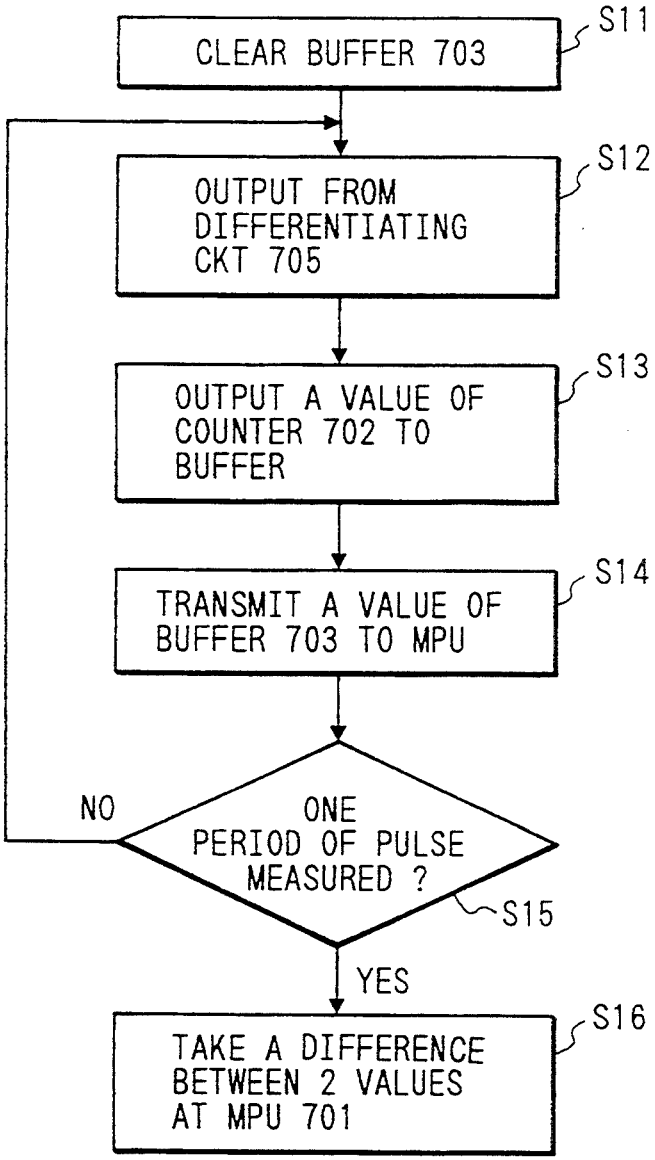
FIG. 6 is a flowchart of a detecting means of the duty change restraining means shown in FIG. 4.

FIG. 6 is a flowchart showing actions of the detecting means in the duty change restraining means. To start with, contents of the buffer 703 are cleared when setting the system (step S11). Next, a trigger is outputted from the differentiating circuit 705 at a rise (or a fall) of the output signal 303 with a printing action (step S12). The MPU 701 detects the trigger, and the count value of the counter 702 is transferred to the buffer 703 (step S13). The MPU 701 detects that a value of the buffer 703 is updated. The duty is detected in the MPU 701. For this purpose, the data thereof are taken in from the buffer 703 (step S14). Note that if the MPU 701 is always open for the data transfer control, the data may be transferred to an in-MPU register from the counter without using the buffer 703. Next, the MPU 701, after finishing a measurement of the pulses for one period, judges whether or not two values, i.e., a width at a High level (Th in FIGS. 8A and 8B) and a width at a Low level (Tl in FIGS. 8A and 8B), have been detected, these two values serving for calculating the duty (step S15). If not, the action returns to step S12. Whereas if detected, the action proceeds to next step S16. Then, just when obtaining the two values to be compared, a difference between two values is taken at MPU 701, and the widths are compared (step S16).

Figure 7:
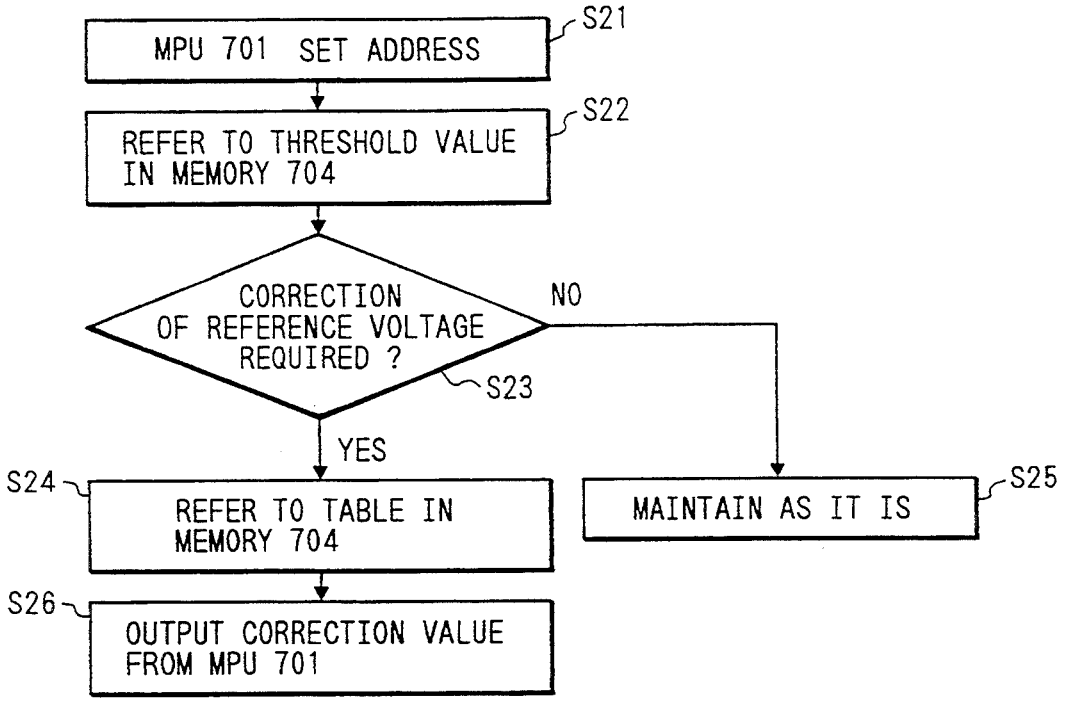
FIG. 7 is a flowchart of a control means of the duty change restraining means shown in FIG. 4.
Figure 8A:
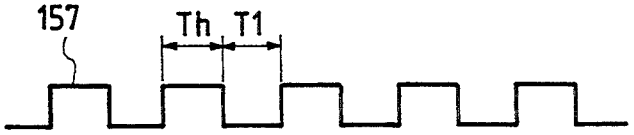
FIGS. 8A and 8B are diagrams illustrating printing dots and outputs of the control circuit shown in FIG. 2.
Figure 8B:
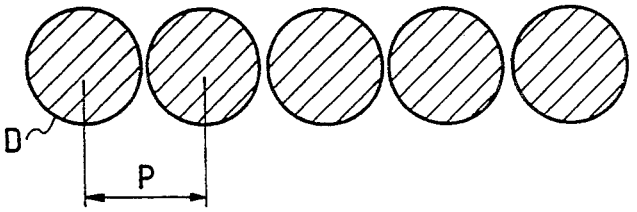

FIG. 7 is a flowchart showing actions of the control means in the duty change restraining means. The MPU 701 accesses the memory 704 with respect to a compared value obtained through the detecting means as well as through the observing means described above (step S21). The MPU 701 then refers to the threshold value (step S22). The widths Th, Tl of the signal 303 in FIGS. 8A and 8B are taken in as items of count value data by the MPU 701. The MPU 701 compares magnitudes of the widths. If there is a change in the duty ratio, and when $Th > Tl$, it is required that the reference voltage 302 be decreased. When $Th < Tl$, it is required that the reference voltage be increased. That is, the reference voltage is controlled so that the duty ratio converges at 50% (i.e., in approximation to $Th = Tl$). Judged is whether or not a Th-to-Tl relationship in magnitude needs a modification of the data 150 in comparison with the threshold value determined by the system (step S23). As a result, if a necessity for the modification is recognized, an optimum reference voltage control table is drawn out of the memory 704 (step S24). The correction value data is outputted to the D/A converter 149 (step S26). On the other hand, when falling within an allowable range of the threshold value, and if the modification is not required, a present value of the correction value data 150 is kept (step S25).

Under the control described above, the output signal 303 is controlled so that the pulse widths Th, Tl are substantially uniformly kept (i.e., the duty ratio is 50%) as seen in a pulse 157 exhibiting an output voltage waveform in FIG. 8A. As illustrated in FIG. 8B, the pitches P of the printing outputs (dots) D become uniform.

(Second Embodiment)

In accordance with the first embodiment, the observation of the pulse duty ratio of the output signal 303 involves the use of the counter and the system clocks, wherein the "H (High)" and "L (Low)" times of the output pulse are measured. In accordance with a second embodiment, a compared value between the High- and Low-level widths is grasped as an electric power ratio in terms of restraining a duty change while keeping the duty ratio at 50% by a method other than the above-mentioned. A duty observing portion is composed of discrete parts.

Figure 9:
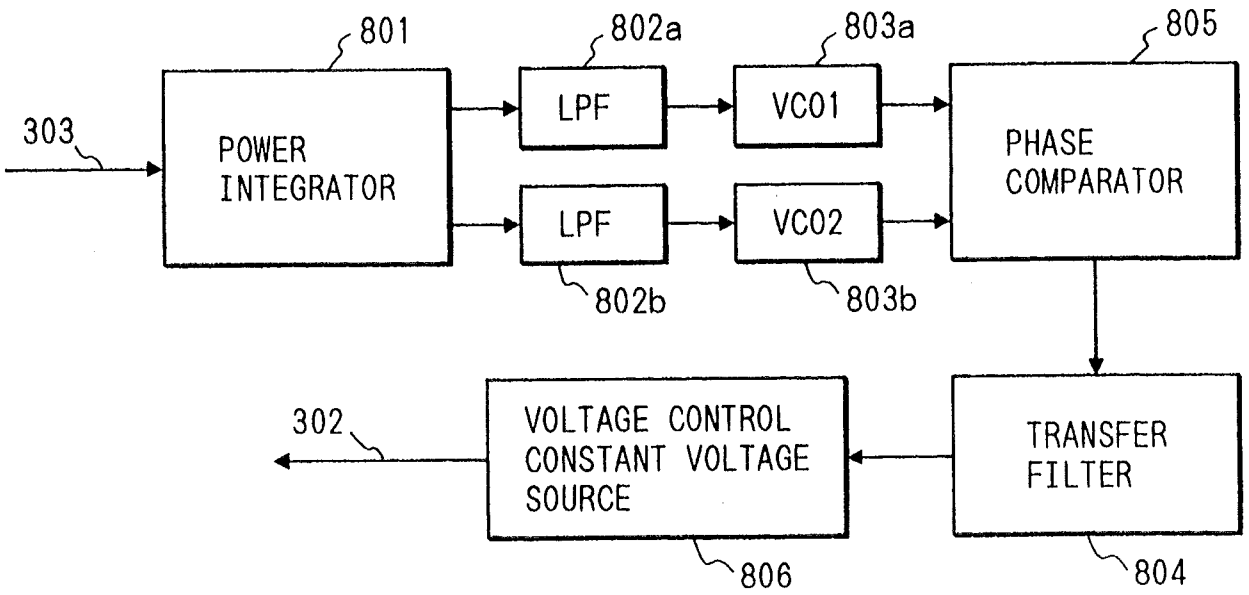
FIG. 9 is a diagram showing a block control circuit of the duty change restraining means in a second embodiment of this invention.

FIG. 9 is a circuit block diagram of the duty change restraining means in the second embodiment. A power integrator generally designated at 801 in FIG. 9 accumulates the electric power proportional to lengths of the pulse width Th, Tl of the output signal 303. Low-pass filters 802*a*, 802*b* fetch charge electric power as a DC component from the power integrator 801. Voltage control oscillators 803*a*, 803*b* each change an oscillation frequency with respect to the output voltages from the low-pass filters 802*a*, 802*b*. A phase comparator 805 compares phases of the output frequencies of the voltage control oscillators 803*a*, 803*b* and outputs a phase jitter in the form of a variation in voltage. Under the construction discussed above, a duty change of the output signal 303 is outputted as a fluctuation in voltage of a phase comparator 805. Namely, the pulse widths "Th", "Tl" of the output signal 303 are observed by the power integrator. The duty change is, when recognized, detected as a variation in the output voltage. This is detected as a voltage variation and therefore matched with a next-stage control signal voltage via a transfer filter 804. The reference voltage 302 is controlled by a voltage control constant voltage source 806, with this voltage serving as a control signal of the voltage control constant voltage source 806.

Figure 10:
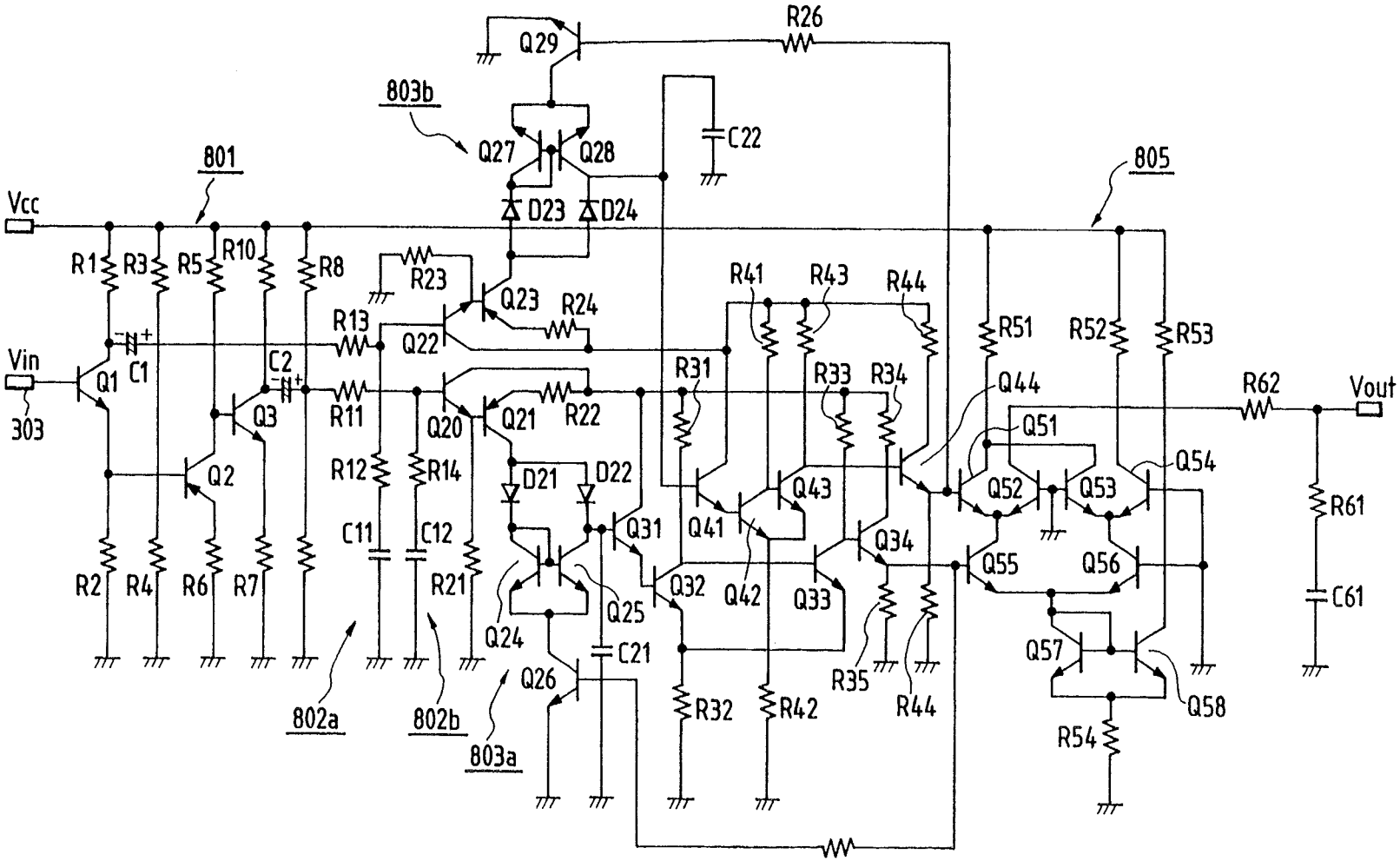
FIG. 10 is a circuit diagram illustrating the principal portion of the duty change restraining means shown in FIG. 9.

FIG. 10 is a diagram of the circuit ranging from the power integrator 801 to the phase comparator 805 in the duty change restraining means of FIG. 9. A configuration and actions of this circuit will hereinafter be explained. Based on a construction consisting of transistors Q1–Q3 and capacitors C1, C2, electric charges are accumulated in the capacitor C1 for a High-time (i.e., a Th-time) of the output pulse 303. The electric charges are accumulated in the capacitor C2 for a Low-time (i.e., a Tl-time) of the output pulse 303. The electric charges accumulated in the capacitors C1, C2 pass through low-pass filters LPF 802*a*, 802*b* composed of a capacitor C11 and resistors R12, R13 and of a capacitor C12 and resistors R11, R14. The electric charges are transferred as DC potentials to VCOs (voltage control oscillators) 803*a*, 803*b*. In this embodiment, however, the VCO 803*a* is constructed of a constant current source consisting of transistors Q22, Q23, Q27, Q28 and a Schmidt trigger circuit consisting of transistors Q41, Q42, Q43, Q44. The VCO 803*b* is also constructed of a constant current source consisting of transistors Q20, Q21, Q24, Q25 and a Schmidt trigger circuit consisting of transistors Q31, Q32, Q33, Q34. Two outputs from these VCOs are inputted to the phase comparator 805 composed of transistors Q51–Q58. An output from this phase comparator 805 is transferred via an LPF consisting of R61, R62, C61 to the transfer filter 804 (see FIG. 9, but not shown in FIG. 10). This output is transferred next to the voltage control constant voltage source 806 (see FIG. 9, but not shown in FIG. 10).

Figures 11A, 11B, 11C:
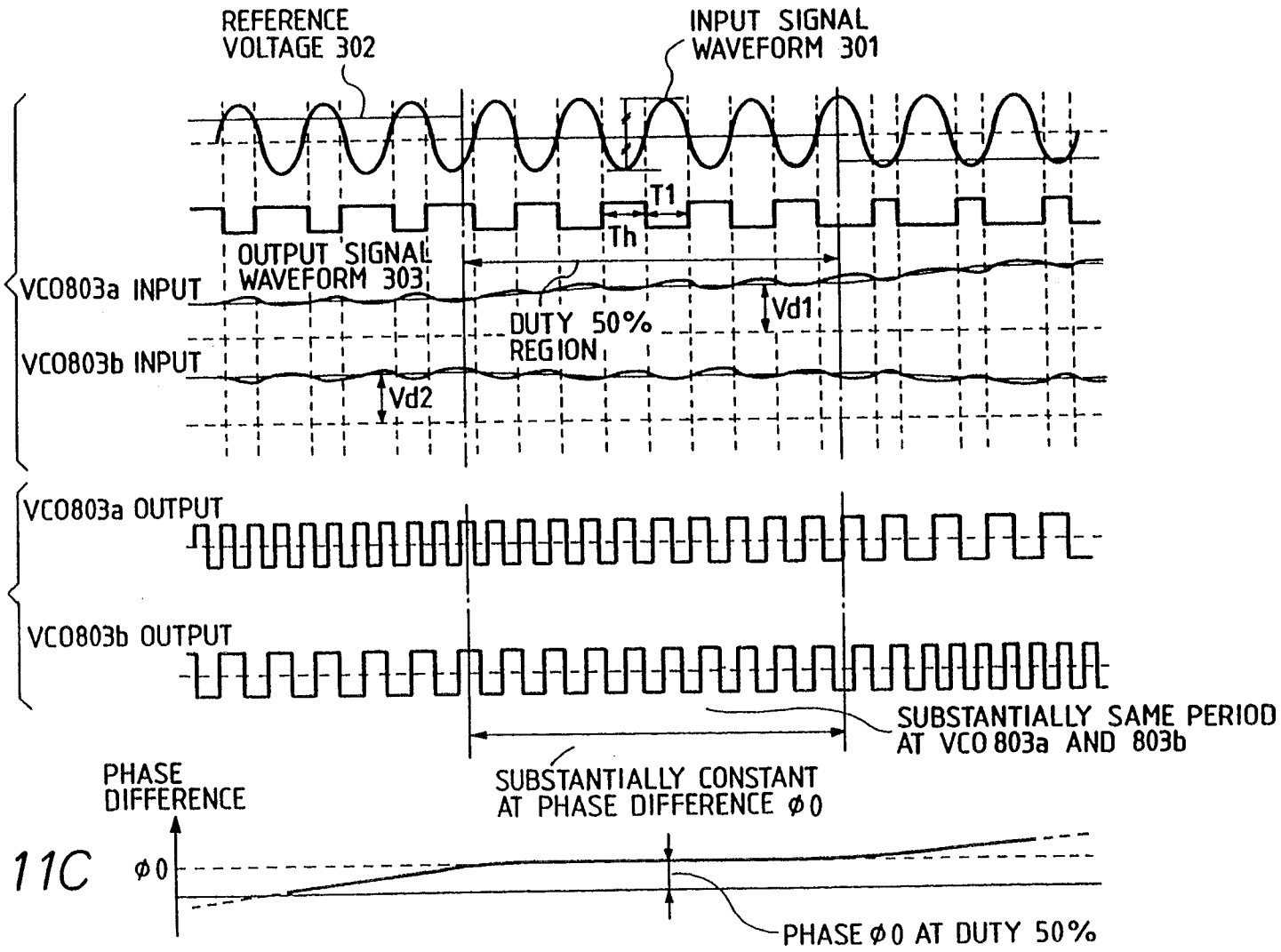
FIGS. 11A–11C comprise a time chart of the observing means of the duty change restraining means shown in FIG. 9.

FIG. 11 illustrates waveforms when a duty change observing means circuit of the duty change restraining means is open on the occasion of opening a transfer block of the duty change restraining means. When the reference voltage 302 assuming a pulse generation threshold level changes with respect to a waveform of the input signal 301, the High- and Low-level widths "Th", "Tl" of the wave form of the output signal 303 change. This pulse width information is converted into electric potentials Vd1, Vd2 by means of the power integrator 801 and the LPFs 802*a*, 802*b*. The electric potentials are respectively inputted to the VCOs 803*a*, 803*b*. In FIG. 11, Vd1 corresponds to Tl, while Vd2 corresponds to Th. When the reference voltage 302 is not equally divided by a peak-to-peak value of the waveform of the input signal 302, a difference is produced between the electric potentials Vd1, Vd2. It is herein assumed that characteristics of the VCOs 803*a*, 803*b* are identical with each other, a scatter is caused in the oscillation frequencies generated in these VCOs and outputted therefrom. A phase difference $\phi$ is therefore produced in the inputs to the phase comparator 805. In this Figure, a control loop is open, and hence no phase tracking is effected. Further, the output 302 has a duty ratio on the order of 50% when in the open state and is thus at a considerably far level. Hereat, the frequencies of the outputs themselves of the respective VCOs are completely different, and it follows that the output of the phase comparator 805 does not indicate a correct value. The voltage source 806 is controlled by closing the control loop so that the output of the phase comparator 805 is always $\phi 0$. The waveform of the output signal 303 can thereby hold the duty ratio 50%. The voltage source 806 is exactly controlled by the phase comparator 805. For this purpose, as a transfer function of the transfer filter 804, an arbitrary function in a linear or non-linear form is given corresponding to an output characteristic of the phase comparator 805.

Incidentally, under the printer printing control where the output of the linear encoder as employed in this invention is utilized, even when performing the printing operation during an acceleration or deceleration of the carriage, the frequency of the output signal pulse 303 fluctuates at stages of the acceleration and deceleration. If the pulse duty ratio of "Th", "Tl" does not change, however, a difference output is taken out at the next stage of the power integrator 801 and inputted to VCO. Consequently, no influence is exerted on the output of the phase comparator 805.

(Third Embodiment)

Figure 12:
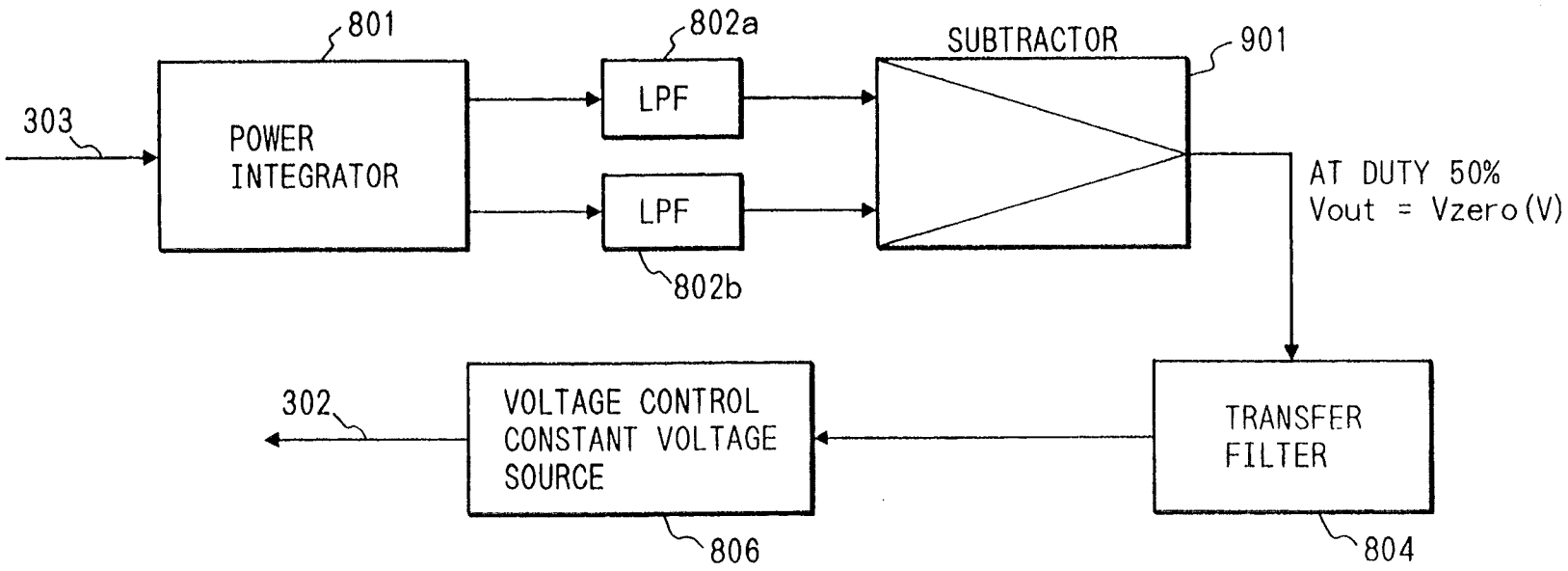
FIG. 12 is a diagram illustrating a block control circuit of the duty change restraining means shown in FIG. 2 in a third embodiment of this invention.

In the second embodiment, the electric power is integrated in accordance with the output signal pulse widths "Th", "Tl". The duty change is observed by use of the phase comparator and the VCOs. As illustrated in FIG. 12, however, the output voltages of the power integrator 801 are compared by a subtracter (voltage comparator) 901. The duty ratio 50% of the output pulse 303 can be obtained even by controlling the reference voltage 302 so that a difference therebetween is zeroed.

(Fourth Embodiment)

Figure 13:
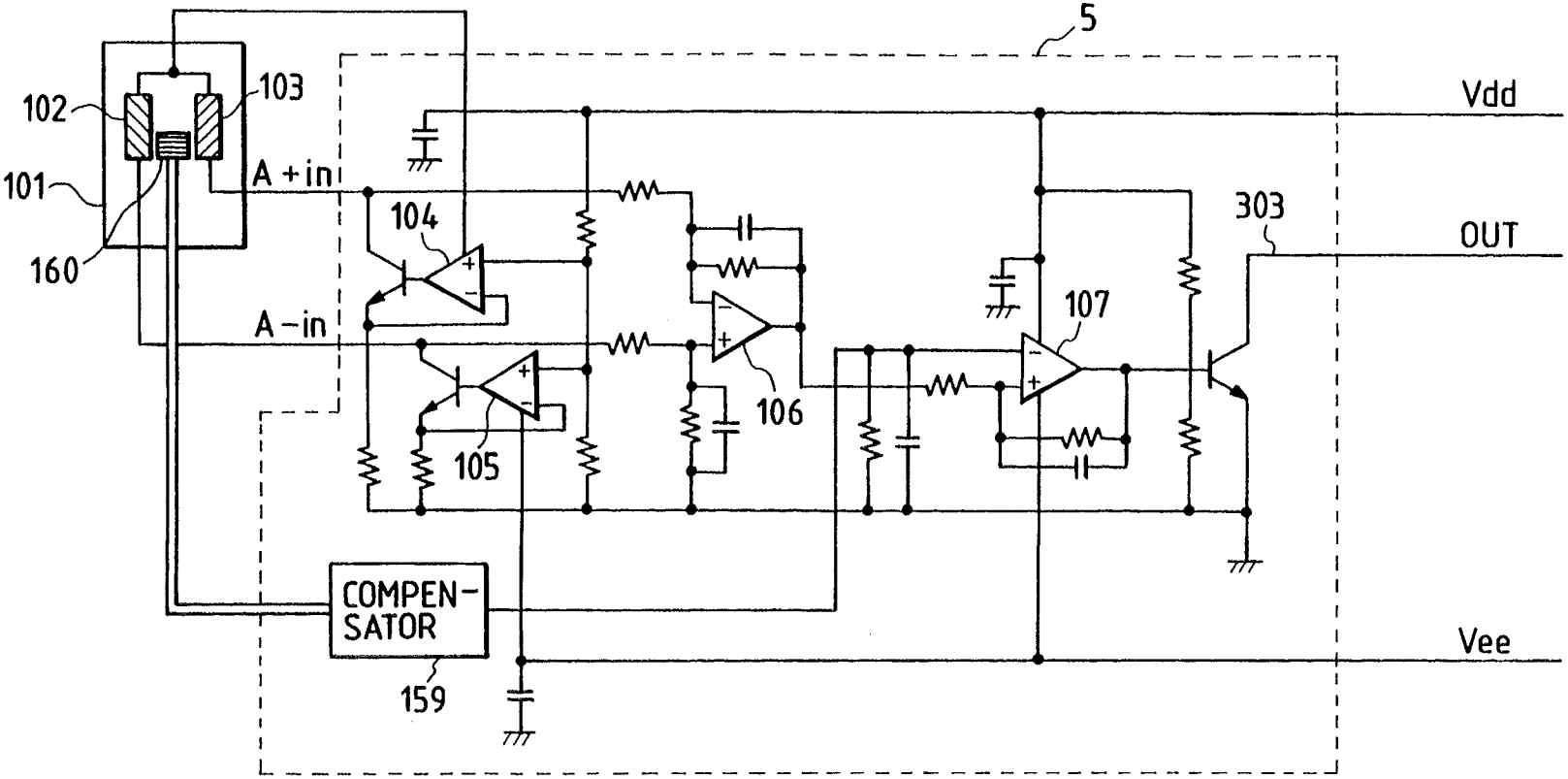
FIG. 13 is a circuit diagram fully showing the synchronous signal generating circuit illustrated in FIG. 2 in a fourth embodiment of this invention.

FIG. 13 is a circuit diagram in a fourth embodiment. The detecting portion 101 is, as in the same way with the first to third embodiments, incorporated into the magnetic head 502. At the same time, the detecting portion 101 is constructed of the magnetic detecting elements 102, 103 which act based on the MR (magnetic resistance) effect. The magnetic detecting elements 102, 103 are also similarly connected to amplifiers 104, 105 which constitute a constant current circuit. The amplifiers 104, 105 are further connected to an amplifier 106 for amplifying a detected signal and a comparator 107. In accordance with the fourth embodiment, an interior of the detecting portion 101 is provided with a temperature measuring portion 160 consisting of an element the resistance value of which varies depending on a temperature as in the case of a thermistor. In this element, a variation in the temperature is detected as a fluctuation in voltage when a constant current flows therein. This temperature measuring portion 160 is connected to a compensator 159 for compensating temperature characteristics of the magnetic detecting elements 102, 103. The compensator 159 is constructed to set and output a reference voltage of the comparator 107 in accordance with an output voltage of the temperature measuring portion 160.

Figure 14:
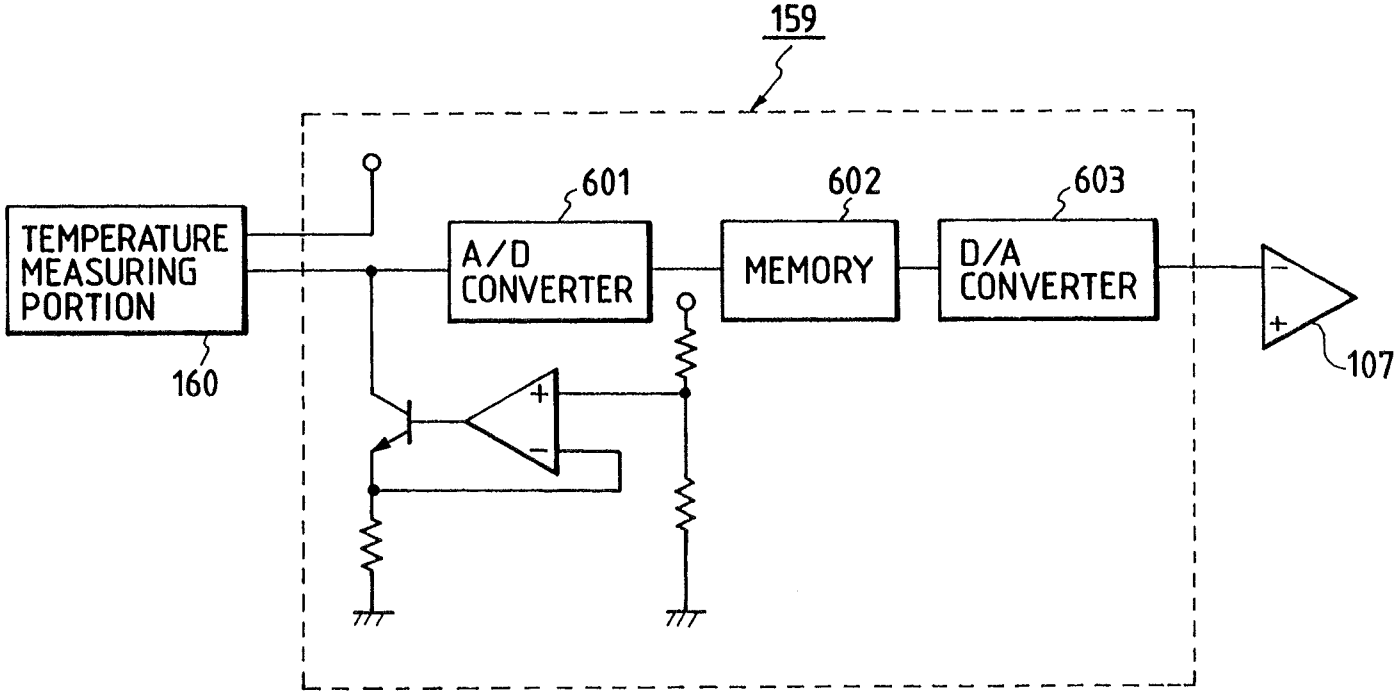
FIG. 14 is a diagram showing a block control circuit of a temperature compensating circuit shown in FIG. 13.

FIG. 14 shows internal circuitry of the compensator 159. As illustrated in FIG. 14, this compensator 159 incorporates an A/D converter 601, a memory 602 and a D/A converter 603. The memory 602 previously stores, as shown in FIG. 15C, data of a reference voltage $V_S$ of the comparator 107 which corresponds to an output voltage $V_O$ of the temperature measuring portion 160. Herein, FIG. 15A is a graphic chart showing a relationship of an ideal reference voltage versus a temperature. FIG. 15B is a graphic chart showing a relationship of a temperature measuring portion output voltage versus the temperature. FIG. 15D is a graphic chart showing a relationship of a reference voltage given by memory data versus the temperature. That is, the memory previously stores a value of the ideal reference voltage corresponding to the output voltage of the temperature measuring portion which is obtained at a certain temperature. This value is, as will be explained below, employed as a reference voltage of the comparator.

An A/D converter 601 effects an A/D (analog-to-digital) conversion of an output voltage of the measuring circuit portion 160. The compensator 159 reads data corresponding to the converted value out of the memory 602. Thereafter, the data undergoes a D/A (digital-to-analog) conversion in a D/A converter 603 and is outputted as a reference voltage of the comparator 107. An influence caused due to the variation in temperature is thereby eliminated. Giving one example where the temperature is Tk; and the output voltage of the temperature measuring portion 160 is Vok, this value is inputted via the A/D converter 601 to the memory 602. A reference voltage Vsk (digital value) corresponding to this voltage Vok is outputted from the memory 602. The reference voltage Vsk of this digital value is subjected an analog conversion in the D/A converter 603. Thereafter, the converted result is inputted to the comparator 107.

Figure 16A:
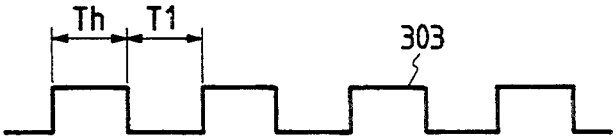
FIG. 16A is a waveform diagram illustrating an output signal of the comparator shown in FIG. 14.
Figure 16B:
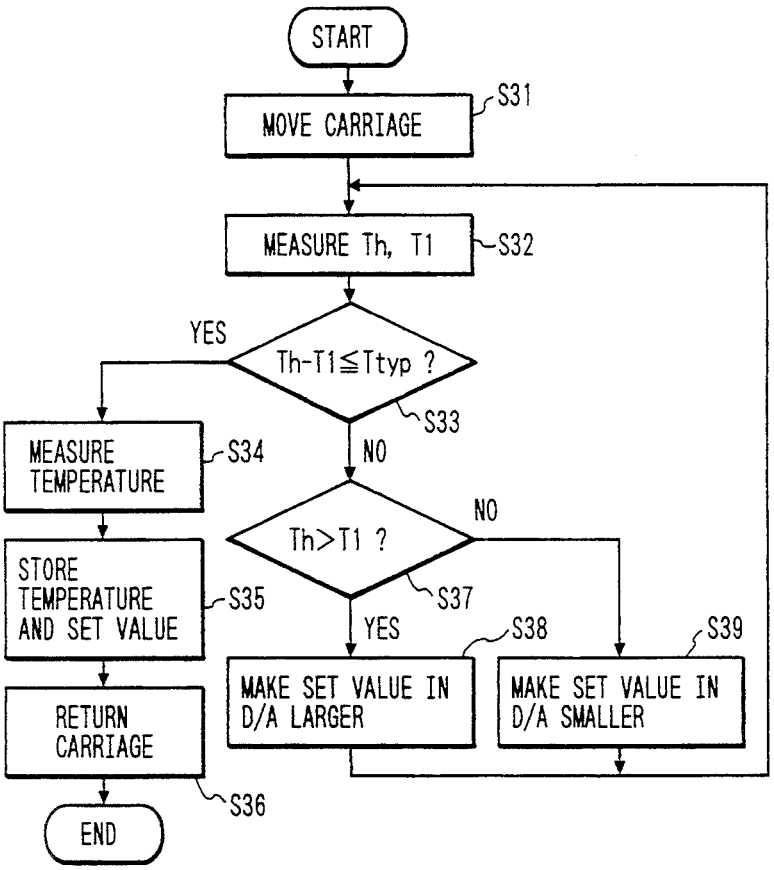
FIG. 16B is a flowchart showing a writing action of the set value of the reference voltage to the memory shown in FIG. 14.
Figure 16C:
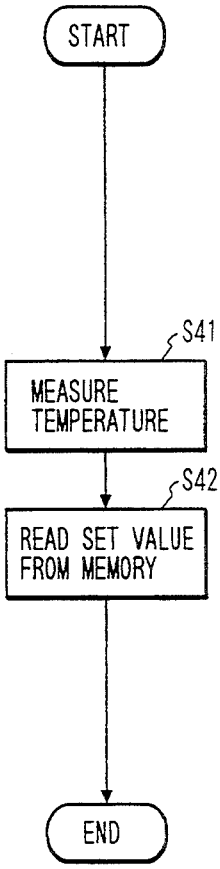
FIG. 16C is a flowchart showing a setting action of the reference voltage of the comparator illustrated in FIG. 14.

FIG. 16A shows output signals of the comparator. FIG. 16B is a flowchart showing actions to write a set value of the reference voltage to the memory, which are executed before the delivery. FIG. 16C is a flowchart showing actions to set the reference voltage after the delivery.

As illustrated in FIG. 16A, Th indicates a time for which the pulse of the output signal 303 remains High (i.e., a pulse width at the High level). The symbol Tl indicates a time for which the output signal 303 remains Low (i.e., a pulse width at the Low level). In the actions shown in FIG. 16B, a reference voltage is sequentially set through the D/A converter while measuring a pulse duty ratio. The setting is ended Just when the duty ratio falls within a predetermined range. The reference voltage is automatically set so that a difference between Th and Tl is equal to or within a predetermined value. For this setting, the carriage is moved in step S31. The action proceeds to next step S32. Measured therein are Th, Tl of the pulse of the output signal 303 outputted with the movement of the carriage. Judged in step S33 is whether or not an absolute value obtained by subtracting Tl from Th is equal to or smaller than a predetermined value Ttyp. If equal to or smaller than it, it may be judged that a proper reference voltage is present. No adjustment is required. The action therefore proceeds to step S34, wherein the output voltage of the temperature measuring portion is transferred to the compensator. In step S35, set values of the temperature (actually, the output voltage of the temperature measuring portion) and of the reference voltage are stored in the memory. In step S36, the carriage is returned to a home position, thus finishing the adjustment.

On the other hand, if the difference exceeds the predetermined value Ttyp in step S33, the action goes to step S37. Whether or not Th>Tl is judged therein. When Th>Tl, the set value of the reference voltage inputted to the D/A converter is increased in step S38. Further, when Th<Tl, the set value of the reference voltage inputted to the D/A converter is decreased in step S39. The action goes back to step S32 in order to set a proper reference voltage. When equal to or smaller than the predetermined Ttyp, the action is ended.

Figure 17:
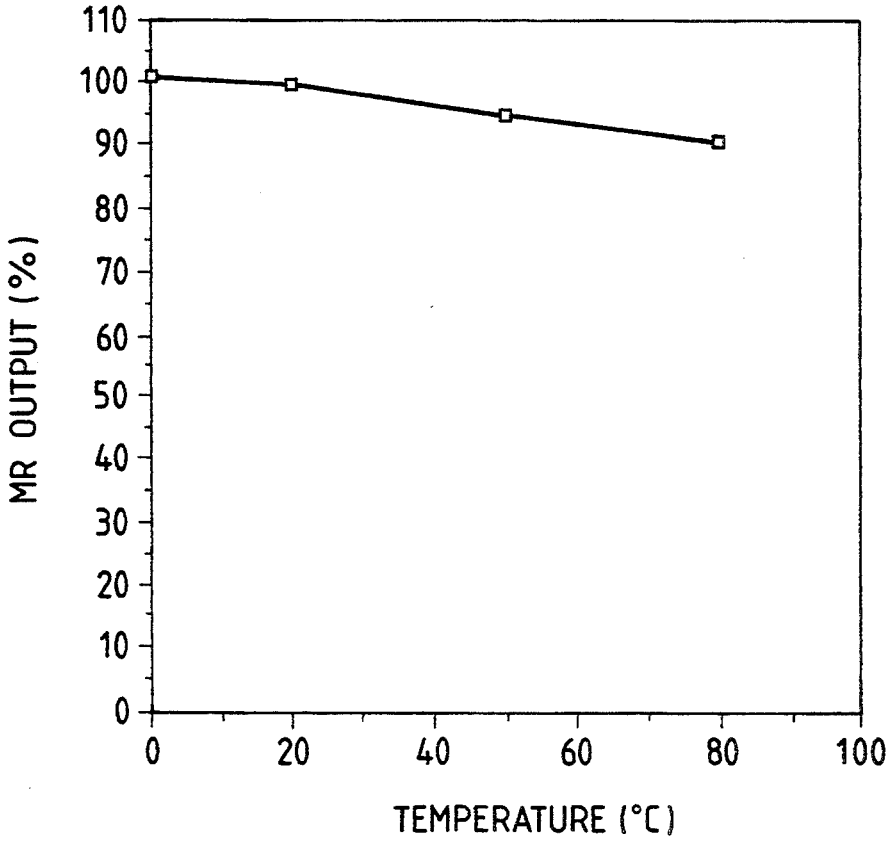
FIG. 17 is a chart showing a relationship of a temperature versus an output of the MR element.

The data shown in FIG. 16C are stored in the memory according to the steps described above. Note that the graphic chart of FIG. 17 showing the relationship of the MR element output versus the temperature corresponds to FIG. 15A.

FIG. 16C shows the actions to set the reference voltage in a delivered product after the actions to write the set value of the reference voltage to the memory which have been explained in FIG. 16B. In step S41, the output voltage of the temperature measuring portion is obtained. The output voltage acquired in step S41 is A/D converted in step S42. The reference voltage set value stored in the memory is read and D/A converted, thereby setting a reference voltage. The following is the way of setting an in-use reference voltage of the actual product. For instance, in a range from a temperature Tk to a temperature Tk+1 shown in FIG. 15B, the output voltage Vok of the temperature measuring portion is inputted to the A/D converter 601 (see FIG. 14) of the compensator. The reference voltage Vsk corresponding to the output of the A/D converter is read from the memory 602 and outputted as a reference voltage via the D/A converter 603.

Herein, if an interval between Tk and Tk+1 is reduced to increase the data, it follows that an approximation to an ideal reference voltage shown in FIG. 15A is attained. Further, the actions in FIGS. 16B and 16C can be easily actualized by a combination of TTl semiconductors such as a counter function, a comparator function, etc., or by the software involving the use of a microcomputer, etc.

Moreover, when using a common ROM without performing the adjustment with respect to each serial printer, an accuracy required is slightly decreased. However, the adjustment when delivered becomes unnecessary. Further, the costs can be reduced down by using the ROM. Additionally, if the specification of the magnetic head is modified after the product has come out, the apparatus can correspond to this simply by a modification of the ROM.

(Fifth Embodiment)

In accordance with the fourth embodiment, the A/D converter, the D/A converter and the memory are employed in the compensator 109. In a fifth embodiment of this invention, the compensator 109 is not limited to these elements but may involve the use of an OP amplifier or the like. Note that printing with a much higher accuracy is attainable in the former case, whereas the costs increase. Further, in the latter case, although the necessary accuracy slightly declines, the costs can be reduced by using inexpensive parts. Besides, the necessity for control of a CPU is eliminated, and hence the apparatus undergoes no restriction when mounted.

The following is an explanation of a method of setting the reference voltage by use of the OP amplifier. It is presumed that the output voltage, as expressed in FIG.

Figure 18A:
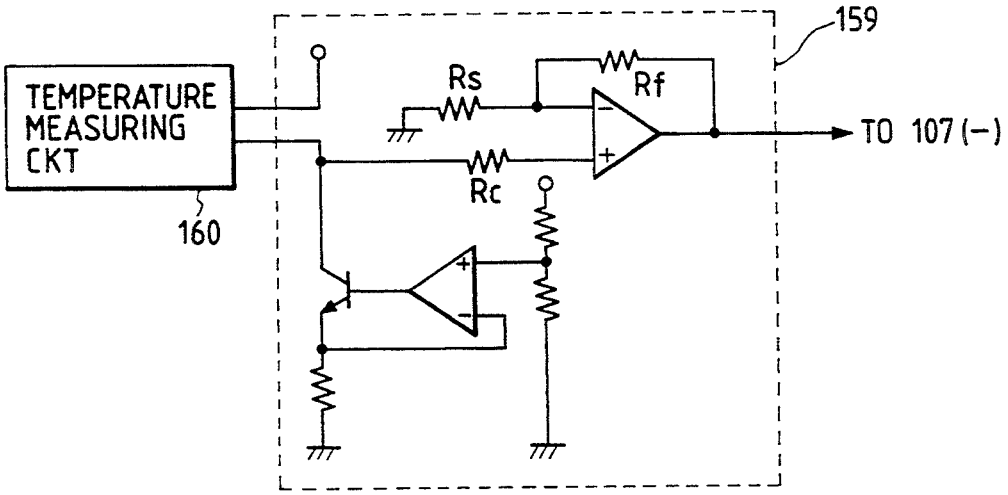
FIG. 18A is a circuit diagram illustrating the temperature compensating circuit shown in FIG. 13 in a fifth embodiment of this invention.

15B, of the temperature measuring part is approximated to the ideal reference voltage shown in FIG. 15A. An amplification is effected by the OP amplifier to obtain a desired multiplying factor. FIG. 18A shows the compensator 109 in this instance. This compensator is conceived as a so-called non-inversion amplifier circuit, wherein a degree of amplification is adjusted at a ratio of Rf to Rs.

(Sixth Embodiment)

Figure 18B:
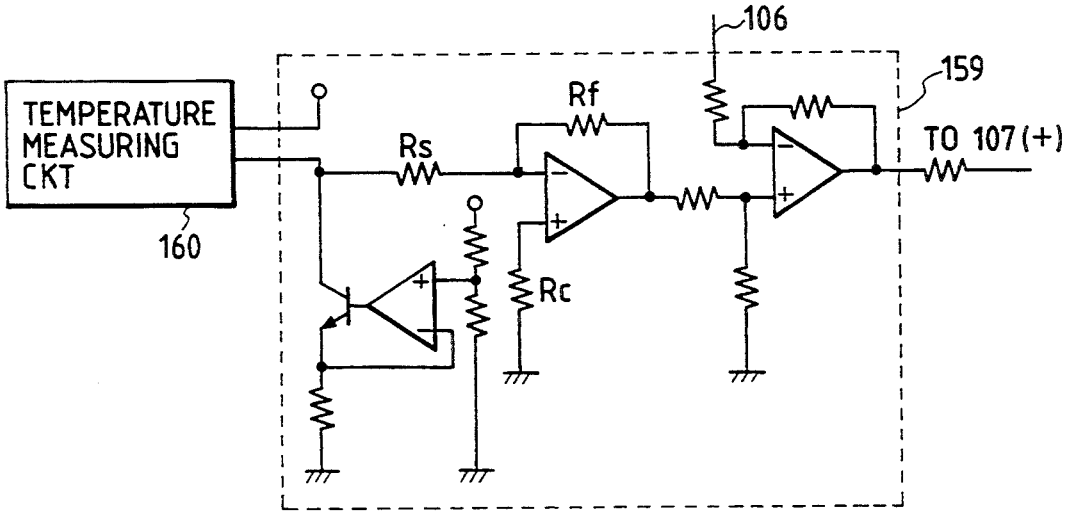
FIG. 18B is a circuit diagram illustrating another example of the temperature compensating circuit shown in FIG. 18A.
Figures 19A, 19B:
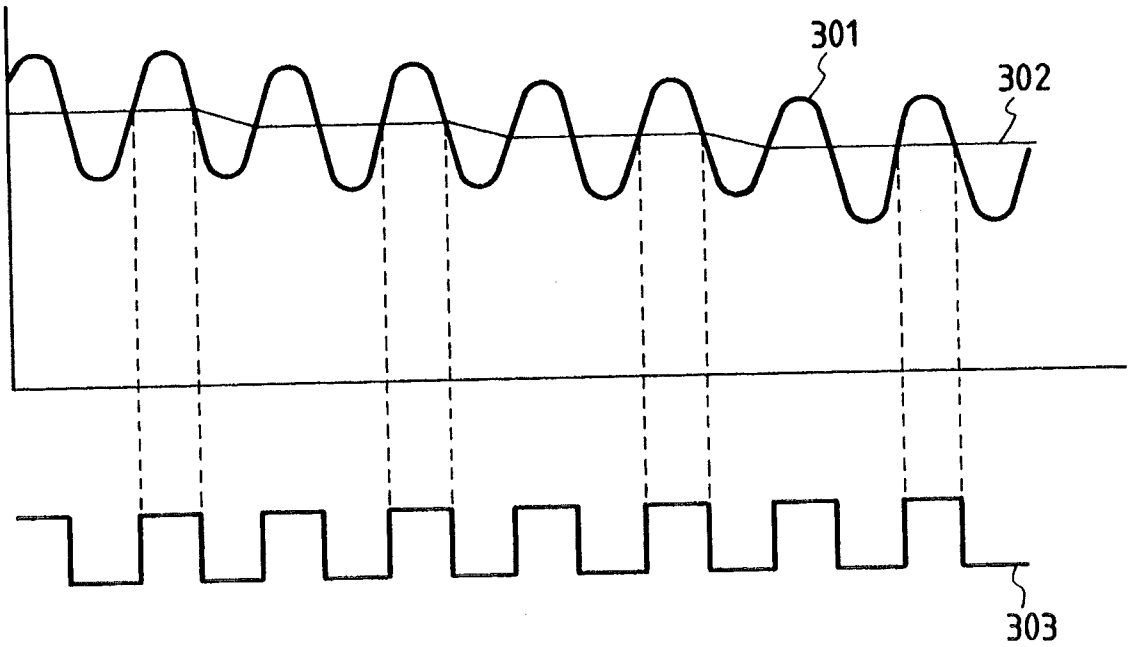
FIG. 19A is a diagram showing a relationship of the reference voltage versus an input signal to the comparator depicted in FIG. 13.
FIG. 19B is a waveform diagram showing an output signal of the comparator illustrated in FIG. 13.
Figure 20:
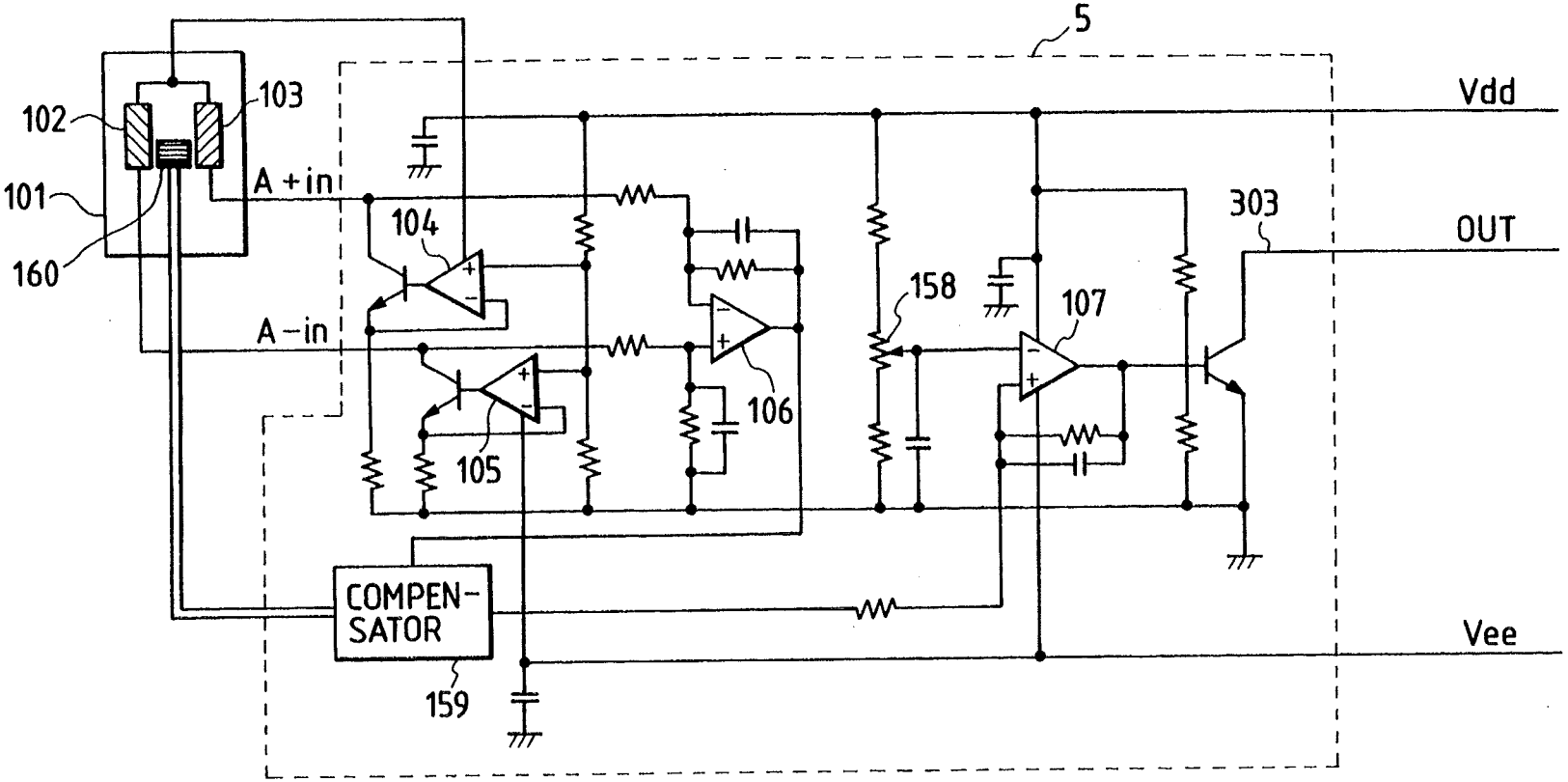
FIG. 20 is a circuit diagram fully illustrating the synchronous signal generating circuit shown in FIG. 2 in a sixth embodiment of this invention.

In the fourth and fifth embodiments, as shown in FIGS. 19A and 19B, the duty change is eliminated by the method of varying the reference voltage 302 of the comparator. The present invention is not confined to this but may adopt a method of varying the output signals of the magnetic detecting element. This embodiment is configured by a circuit shown in FIG. 20. In this case, the compensator 159 inverts the output of the temperature measuring portion 160 and, in accordance with a signal thereof, functions to amplify the signal of the magnetic detecting element. FIG. 18B illustrates the compensator 159 in this case. This compensator may be a so-called inversion amplifier circuit consisting of an OP amplifier and a differential amplifier circuit, wherein the output is adjusted at a ratio of Rf to Rs.

As discussed above, the first through sixth embodiments of the present invention provide the construction, wherein the duty ratio of the printing synchronous output signal pulse waveform is observed, and the synchronous output generation reference voltage is controlled based on the result thereof. It is thus possible to obtain the serial printer capable of high-quality printing owing to the synchronous output which is stable at all times.

It is also feasible to acquire the serial printer capable of restraining the duty change due to the variation in the temperature.

(Seventh Embodiment)

Figure 21:
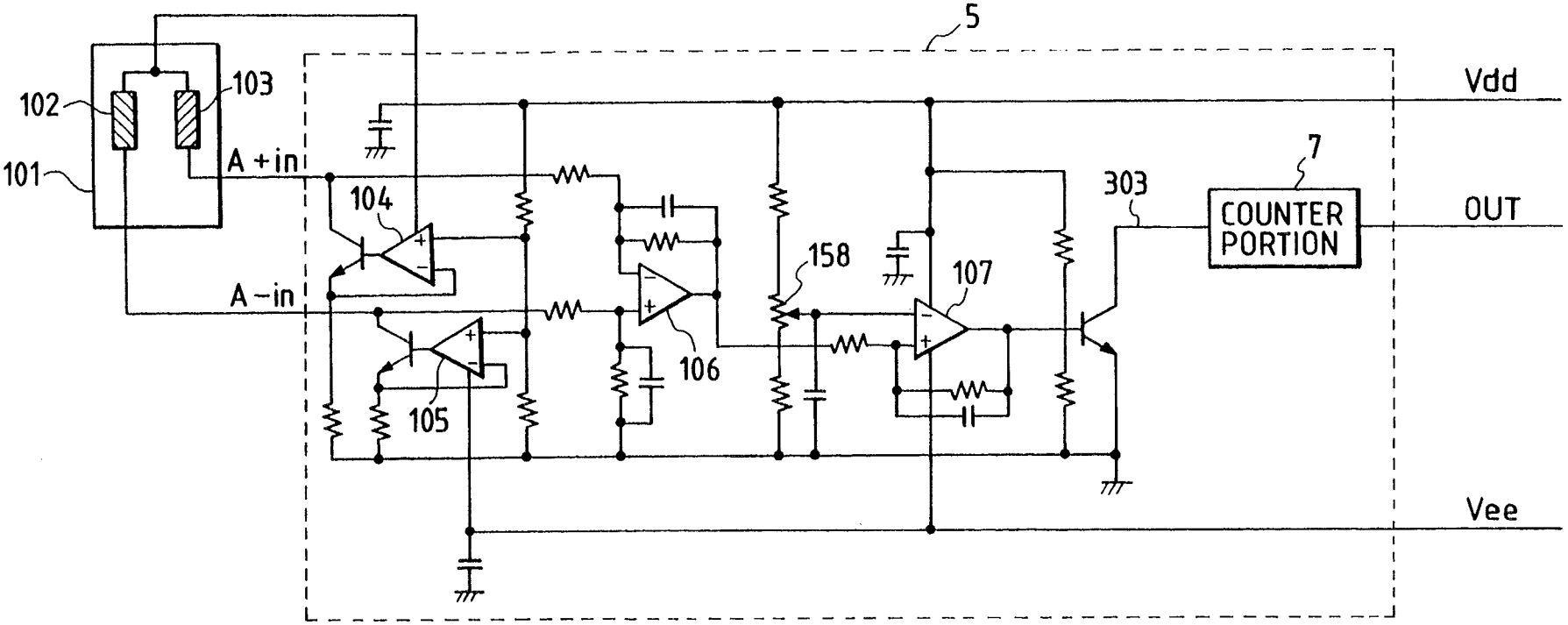
FIG. 21 is a circuit diagram fully illustrating the synchronous signal generating circuit in a seventh embodiment of this invention.

Next, FIG. 21 is a circuit diagram illustrating a configuration of a synchronous signal generating circuit according to this invention. The scale portion of the linear encoder is mounted in the carriage shown in FIG. 1 and fixed to the apparatus body. A detecting portion 101 of the linear encoder detects a relative moving position of the carriage to the apparatus body by detecting the scale portion. The detecting portion 101 is constructed of MR elements which act based on the magnetic resistance effect. The detecting portion 101 is provided integrally with a pair of magnetic detecting elements 102, 103. This detecting portion 101 is also connected to the substrate 5 mounted on the carriage, the substrate being shown by a broken line in the Figure. Connected to this substrate 5 are the amplifiers 104, 105 for constituting constant current circuits, the amplifier 106 for amplifying a detected signal and the comparator 107. The output signal 303 is thereby outputted. This output signal is inputted to a counter portion 7. Note that a variable resistor 158 for determining a reference voltage is connected to this comparator 107; these elements are packaged on the substrate 5; and an adjustment is made on the carriage.

Figure 22:
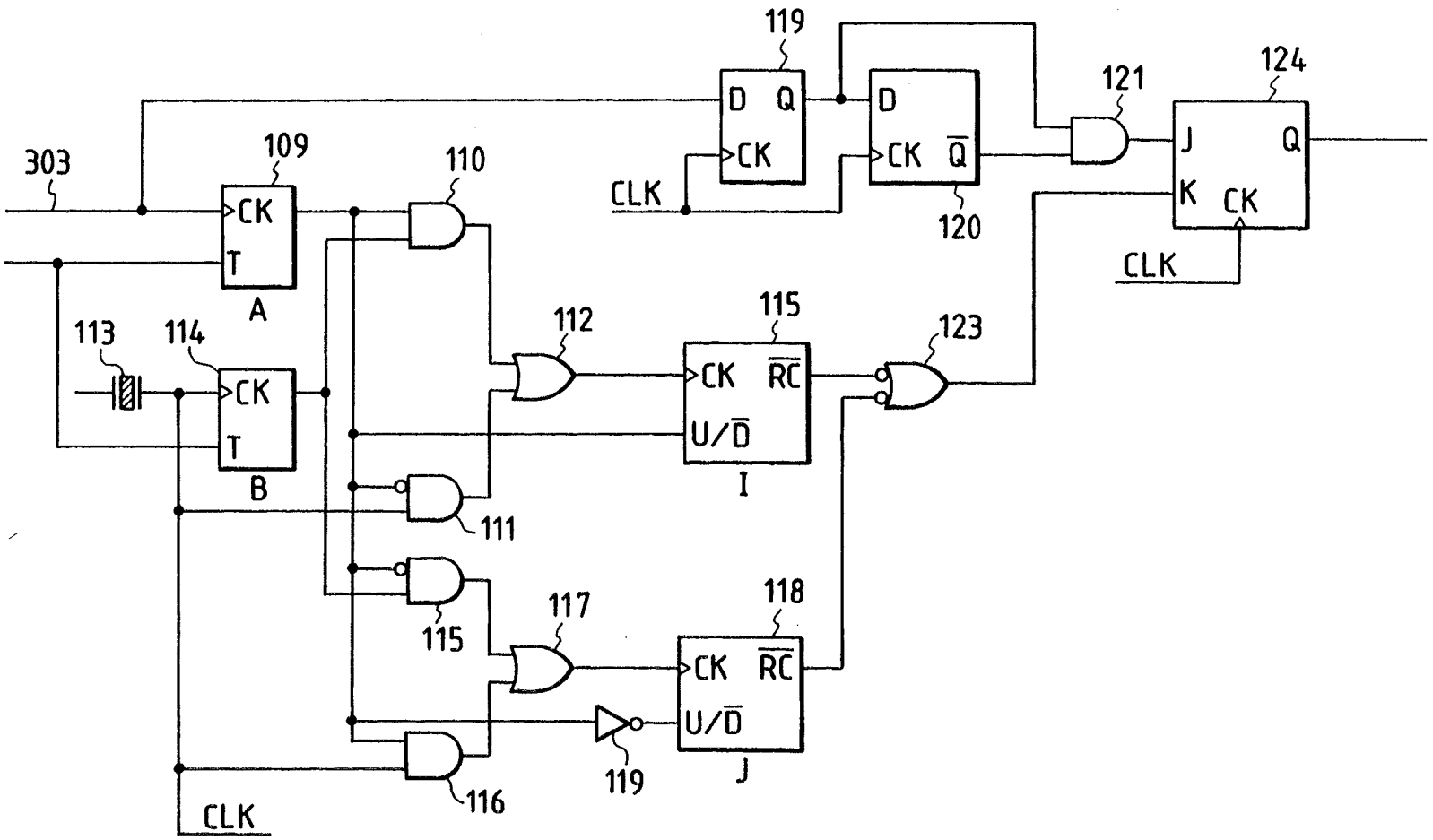
FIG. 22 is a diagram fully illustrating a circuit of a counter portion shown in FIG. 21.

Next, FIG. 22 is a diagram showing detailed circuitry of the counter portion 7 shown in FIG. 21. A frequency divider A109 consisting of trigger flip-flops effects a $\frac{1}{2}$ frequency division with respect to an output of the comparator 107. On the other hand, an output signal of an oscillator 113 is inputted to a frequency divider B114. Respective output signals of the frequency dividers A109, B114 and the oscillator 113 are inputted to add/count-back counter I115 and an add/count-back counter J116 such as TTL, etc. via gates 110, 111, 112, 115, 116, 117, 119, respectively.

Figures 23A, 23B, 23C, 23D, 23E, 23F, 23G, 23H, 23I:
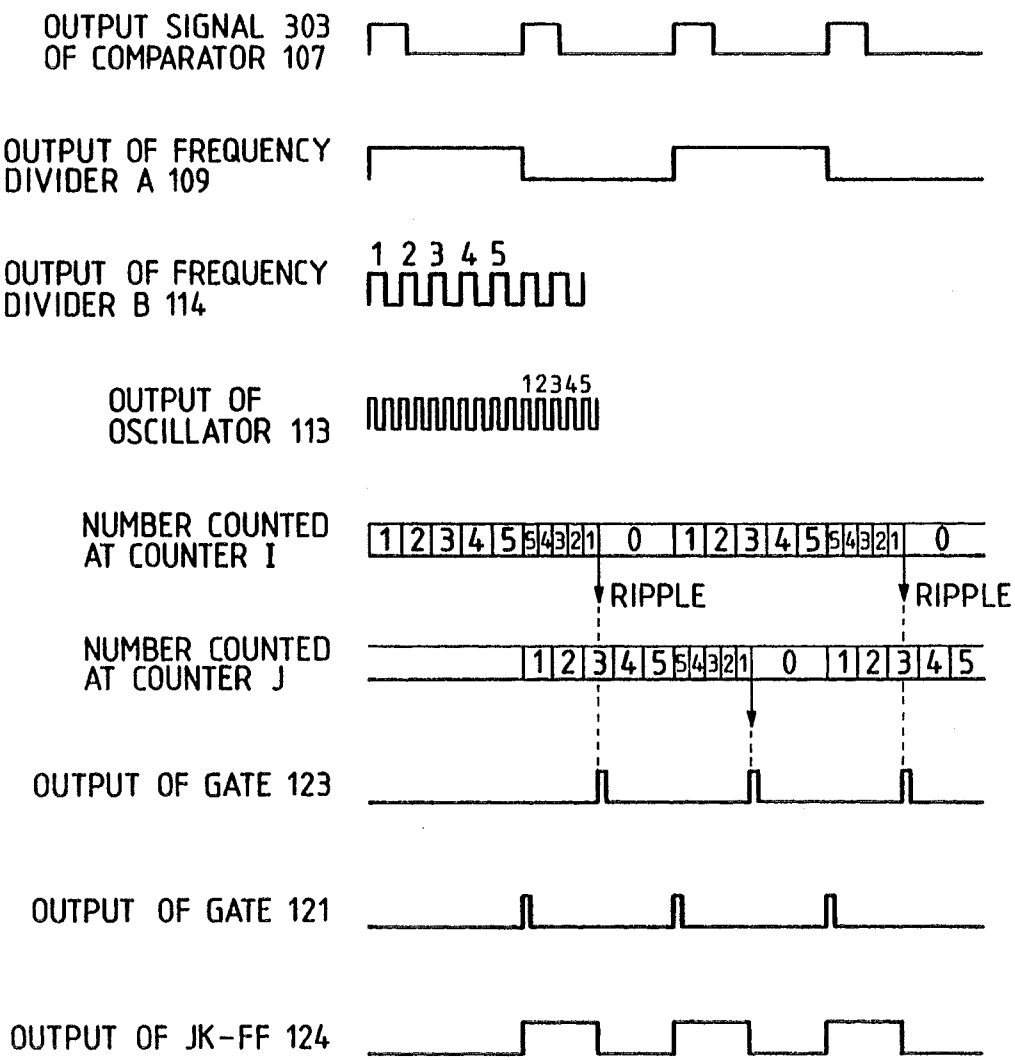
FIGS. 23A–23I are time charts of respective portions of the counter circuit shown in FIG. 22.

Next, the action of this circuit will be explained with reference to FIGS. 21, 22 and 23A–23I. The magnetic detecting elements 102, 103 are supplied with a constant current via the amplifiers 104, 105 each constituting the constant current circuit. The magnetic head 502 moves along the scale portion 501 of the linear encoder illustrated in FIG. 1. Resistance values of the magnetic detecting elements 102, 103 vary with the movement thereof. Variations thereof are detected as fluctuations in voltage. A signal amplified by the amplifier 106 is inputted to one input terminal of the comparator 107. The output signals 303 (FIG. 23A) of the comparator are converted into high and low clocks (FIG. 23B) per waveform by means of the frequency divider 109 of FIG. 22. A pulse (FIG. 23D) well shorter than the output signal of the frequency divider A109 is generated from the oscillator 113. When the output signal of the frequency divider A109 is at a High level, a clock number of the output signals (FIG. 23C) of the frequency divider A114 is added to the add/back-count counter 115 through the respective gates 110, 111, 112, 115, 116, 117. When the output signal of the frequency divider A109 is at a Low level, the clock number of the output signals of the oscillator 113 is counted back from the add/back-count counter I115. At this time, a clock frequency of the oscillator 113 is twice as large as a clock frequency of the output signal of the frequency divider B114. Hence, as shown in FIG. 23E, the add-/back-count counter 115 counts back the count number down to 0 in a time which is one-half of the time of addition. Further, the add/back-count counter J118 is, as illustrated in FIG. 23F, in the adding process when the output signal of the frequency divider A109 is at the Low level but in the back-counting process when at the High level.

As described above, the counters I, J are counted back after the addition has been executed. When the count number comes to 0, the counters I, J set ripple clock output signals at the Low level. A gate 123 serves to, when any one of the counters I, J gives forth a ripple clock output, invert this output as shown in FIG. 23G. The inverted one is outputted to an input terminal K of a JK-flip-flop 124.

On the other hand, D-flip-flops 119, 120 and a gate 121 output, to an input terminal J of the JK-flip-flop 124, a signal which assumes the High level at a rise of an output signal 108 of the comparator but, as illustrated in FIG. 23H, the Low level after one clock of the oscillator 113.

The JK-flip-flop 124 outputs a signal which becomes, as shown in FIG. 23I, the High level at a rise of the gate 121 but the Low level at a rise of the gate 123.

The JK-flip-flop 124 is thus capable of outputting the clocks exhibiting a duty ratio 50%. Note that in this embodiment, TTLs 191 are used by ones in the counters, however, if two or more stages are provided, the duty ratio approximates 50%. As an adequate example, two stages of TTLs 191 are employed, and a clock of the oscillator is set on the order of 500 ns. The clock of the output signal of the comparator is on the order of 160 μs, and, therefore, clocks 1 μs of the output signals of the frequency divider B can be counted 160. The counter is capable of counting 8 bits (256), and this is therefore a sufficient value. Delays of these gates are on the order of 10 ns, and hence this is an ignorable value for 500 ns. Supposing that the count number fluctuates ±1, the duty ratio is 50±0.3125%. Further, the clock can be preset corresponding to an amount of error. If a much higher accuracy is required, the counters may be multi-staged corresponding thereto by increasing the frequency of the oscillator. Note that the circuit and the components (counters, frequency dividers, etc.) in the embodiment are provided by way of one example, but the embodiment is not limited to those components if the same functions are incorporated therein.

In accordance with the seventh embodiment, the present invention is oriented to the counter for setting the duty ratio at 50%. However, in an eighth embodiment which will be discussed as below, a noise filter circuit is used in place of the counter.

(Eighth Embodiment)

FIG. 24 shows one example of the noise filter circuit. D-flip-flops 201, 202 and gates 203, 204, 205 are circuits for detecting leading and trailing edges of the output signal 303 of the comparator and generating pulses. Note that the three gates 203, 204, 205 (AND circuit, NAND circuit and OR circuit) can be substituted with a single piece of EX-NOR (exclusive NOR) circuit. For simplifying the function, however, a construction is given herein with three gates. A delay circuit 206 can be easily actualized by connecting the D-flip-flops in series at multi-stages. However, the delay circuit 206 is required to have a delay time larger than a noise pulse width. If a comparator output signal shown in FIG. 25A is present, pulses shown in FIG. 25C are obtained from the delay circuit 206. A D-flip-flop 207 latches the output signal of the comparator at a rise of this pulse and outputs this output signal (FIG. 25B). The noises can be filtered off based on the circuitry described above.

Note that the circuit shown in FIG. 24 is given by way of one example, but other circuitry may be adopted. For instance, the following arrangement may be adopted. The D-flip-flop 207 is replaced with a T-flip-flop, and the outputs of the gate 205 are counted by the counter. Only in the case of an odd number (low-order 1-bit output assumes the High level), the pulses are transmitted to the T-flip-flop.

As discussed above, according to the seventh and eighth embodiments of the present invention, the counter portion for measuring the wavelength of the synchronous output signal is provided, whereby the duty ratio of the synchronous output signal pulse waveform is set to 50%. It is thus possible to obtain the serial printer capable of high quality printing.

Provided further is the filter circuit for filtering off the noises which may probably enter the synchronous signal generating circuit. There is acquired the serial printer which can thereby get the synchronous signal output pulses with no mistake in counting due to the noises.

(Ninth Embodiment)

Figure 26:
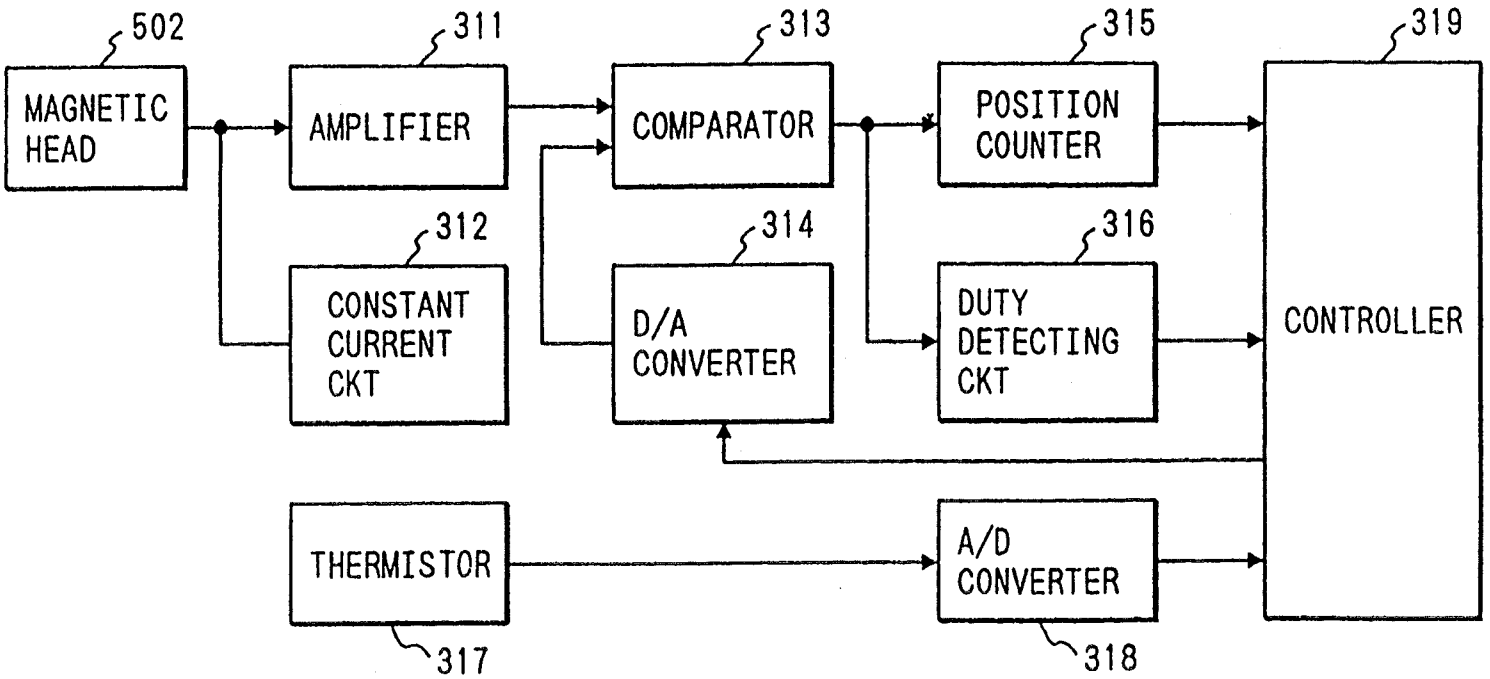
FIG. 26 is a diagram illustrating a block control circuit of the printer shown in FIG. 1.

FIG. 26 is a basic block diagram of a ninth embodiment. In FIG. 26, a magnetic head 502 reads a magnetic pattern of the scale portion and converts it into an electric signal. The magnetic head 502 consists of MR elements. The magnetic head 502 outputs a pseudo sine wave signal having a waveform similar to a sine wave with a relative movement to the scale portion. This output signal has two outputs assuming first and second phases, mutually shifted 90 degrees, for detecting a moving direction of the carriage. A constant current circuit 312 supplies the magnetic head 502 with a constant current. An amplifier 311 amplifies a signal of the magnetic head up to a predetermined magnitude. Parts generally indicated at 502, 301, 302 are mounted on the substrate 5 (see FIG. 1) on the carriage.

A comparator 313 converts an output signal of the amplifier 311 into a pulse signal. The base voltage (reference voltage) of the comparator 313 is given by an output of a D/A converter 314. The base voltage is freely variable according to a command of a controller 319 which will be mentioned later. A position counter 315 counts information indicating a position of the carriage with respect to the scale portion from a phase lead-to-lag relationship between a first phase pulse signal and a second phase pulse signal as well as from the number of second phase pulses. A duty detecting circuit 316 detects duties of the first and second phase pulse signals. A thermistor 317 disposed in a proper position (preferably close to the magnetic head) of the substrate 5 is intended to measure a temperature of this part. An A/D converter 318 converts an output voltage of the thermistor 317 into a digital value. The controller 319 is constructed of a CPU, a ROM, a RAM, I/O ports and a timer circuit. The I/O ports are employed for inputting and outputting to and from the D/A converter 314, the position counter 315, the duty detecting circuit 316 and the A/D converter 318. Further, the timer circuit is used for generating a timing signal of interruption processing.

Figure 27:
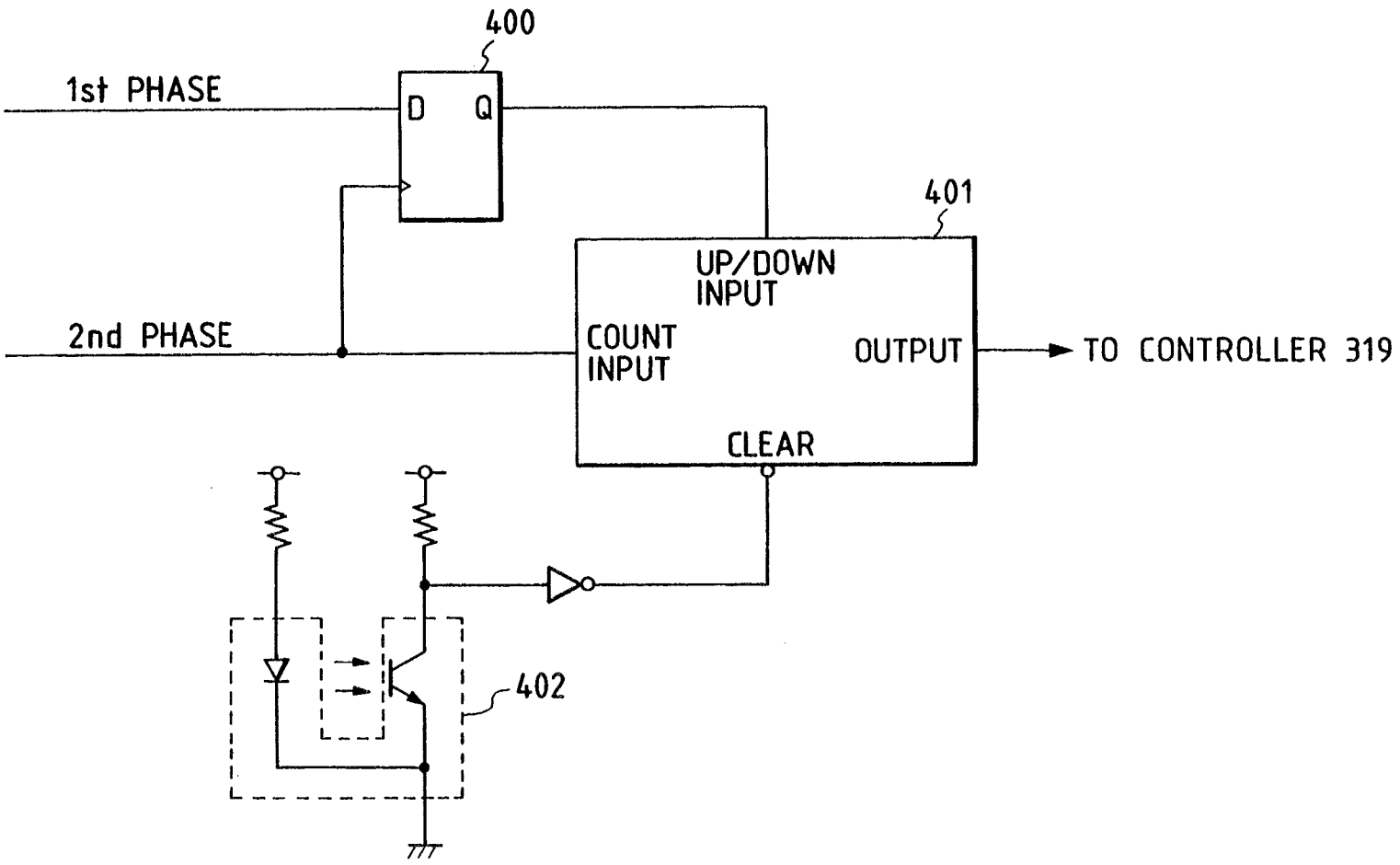
FIG. 27 is a diagram fully illustrating a circuit of a position counter shown in FIG. 26.

FIG. 27 shows an example of a specific circuit of the position counter. Referring to FIG. 27, the numeral 400 represents a D-FF, and 401 denotes an up-down counter. The phases of the first and second phase pulse signals are shifted 90 degrees. It is therefore to know which direction the carriage moves from the phase lead-to-lag relationship therebetween. Thereupon, the phase lead-to-lag relationship is detected by the D-FF. An output thereof is connected to an up-down input terminal. For example, the number of the second (or first) phase pulses is counted. Accordingly, when the carriage moves in a certain direction, the pulse number is counted up. Further, when the carriage moves in the direction opposite thereto, the pulse number is counted down. The present position of the carriage is therefore obtained from the count number of the up-down counter.

In addition, a home position sensor 402 involves the use of a photo interrupter. When the carriage is in the home position, the light incident on a light receiving element from a light emitting element of the photo interrupter is cut off. A signal is then transmitted to a clear input of the up-down counter 401, thereby zero-clearing the count of the up-down counter 401. Hence, the count number of the up-down counter 401 indicates a moving distance of the carriage from the home position, i.e., a carriage position.

Figure 28:
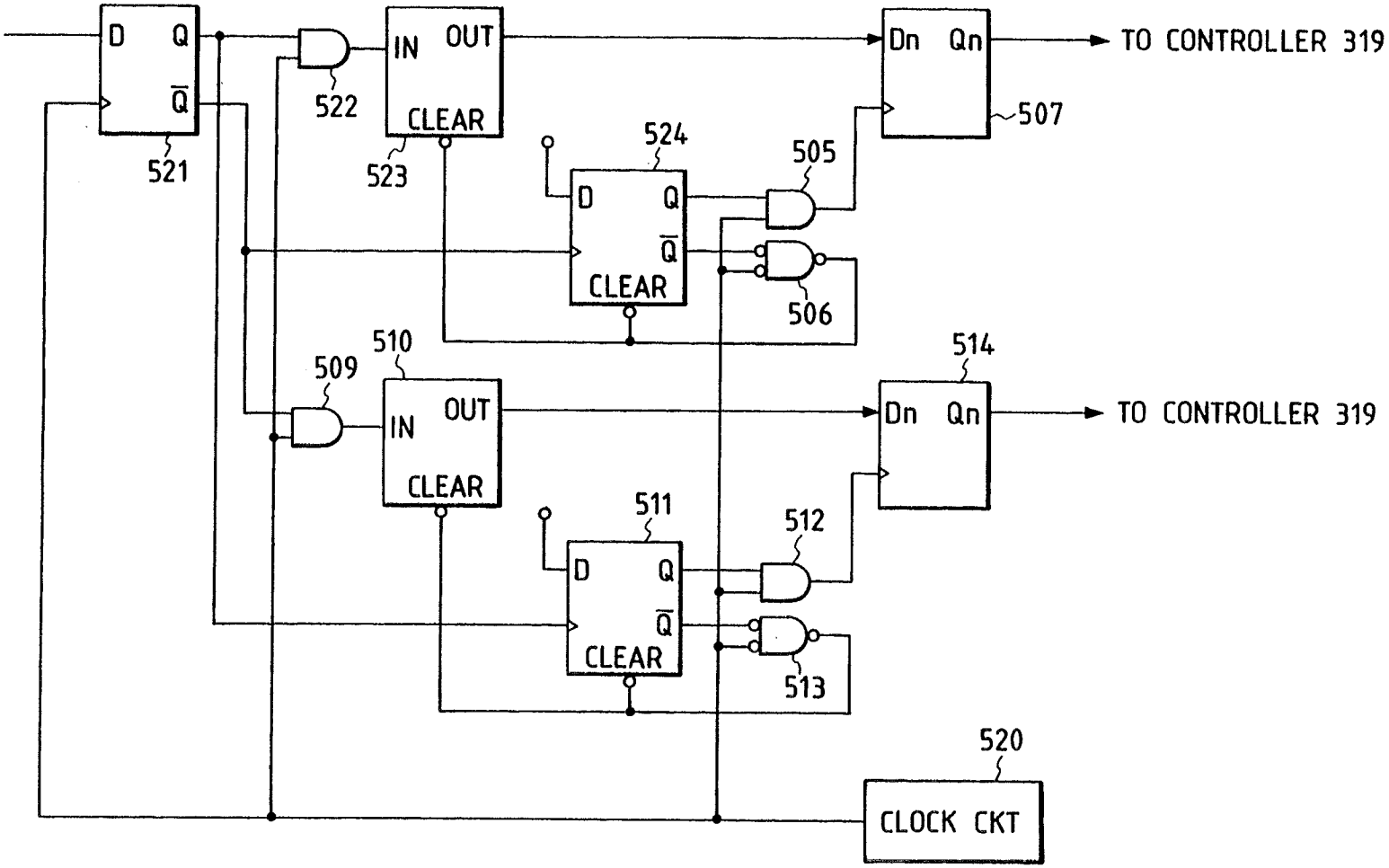
FIG. 28 is a circuit diagram fully illustrating a duty detecting circuit shown in FIG. 26.

FIG. 28 shows a specific example of the duty detecting circuit 316. The circuit shown in FIG. 28 detects a duty of the pulse signal assuming one of phases. For detecting the pulse signal assuming another phase, as a matter of fact, one additional circuit similar thereto is prepared (incidentally, though not illustrated in FIG. 26, for obtaining the pulse signal assuming another phase, there are prepared another set of the magnetic head 502, the amplifier 311, the constant current circuit 312 and the comparator 313; and, as explained earlier, the pulse signals coming from the two comparators are inputted to the position counter 315).

The pulse signal is at first synchronized with a clock period of a clock circuit 520 by means of a 1st-stage D-FF 521. The clock period selected is well faster than the period of the pulse signal outputted with the movement of the carriage. Generally, the pulse signal period is on the order of 0.1 mSec (=10KHz). The clock period to be selected ranges from several 100 nSec to several Sec (several 100 KHz–several MHz). The clock circuit 500 may be independently provided. Normally, however, a CPU clock within the controller 319 is usable as it is or by properly dividing the frequency.

An AND circuit 522 takes a logic product between an output of the D-FF 521 and an output of the clock circuit. The result thereof is counted by a counter 523 having a predetermined number of bits. Counting continues for a duration of a High-state of the pulse signal. More specifically, only when the pulse signal is at the High level, the AND circuit 522 permits the clocks to pass therethrough. The counter 523 counts the number of clocks. When the logic of the pulse signal is inverted, videlicet, when becoming Low, a content of the counter 523 is transferred to a D-latch circuit 507 having a predetermined number of bits while synchronizing with a next leading edge of the clock output through a D-FF 524 and an AND circuit 505. That is, when the pulse signal becomes Low, an output Q of the D-FF 521 becomes High. The output Q of the D-FF 524 is set High, and the next clock output is inputted via the AND circuit 505 to a clock input of the D-latch 507. As a result, the content of the counter 523 is transferred to the D-latch 507.

Thereafter, the content of the counter 523 is cleared through the D-FF 524 and a negative logic AND circuit 506 when the clock output becomes Low next. Namely, as stated above, when the pulse signal assumes the Low level, an output $\overline{Q}$ of the D-FF 521 becomes High, and hence an output $\overline{Q}$ of the D-FF 524 turns out Low. For this reason, when the clock output becomes Low, the output of the negative logic AND circuit 506 becomes Low. This Low output is inputted to a clear input of the counter, thereby clearing the counter 523. Hereat, a Low output of the negative logic AND circuit 506 is also inputted to a clear input of the D-FF 524, thereby clearing the D-FF 524 itself. The content of the D-latch circuit 507 is not therefore updated till the next counting action of the counter 523 is finished (till the pulse signal assumes the Low level after the end of the next counting action for a High-period of the pulse signal). A time-interval of a High duty of the pulse signal is thus measured.

Similarly, a time-interval of a Low duty of the pulse signal is measured through an AND circuit 509, a counter 510, a D-FF 512, a negative logic AND circuit 513 and a D-latch circuit 514.

The controller 319 is capable of reading contents of the D-latch circuits 507, 514 and the latest High and Low duty time-intervals of the pulse signals at arbitrary timings. A duty ratio is simply obtained by the following formula:

$$\text{Duty Ratio} = \text{High Duty}/(\text{High Duty} + \text{Low Duty})$$

Given next is an explanation of a control method of restraining fluctuations in the duty ratio on the basis of the circuitry described above.

To start with, a step in a power-ON state will be explained. When turning ON the power source, the output voltage of the D/A converter 314 is set to a proper initial value. Next, the carriage is moved without having any recording (printing) action executed. At this moment, the duty ratio of the pulse signal output of the comparator 313 takes a proper value. If the pulse signal is outputted, however, there is no problem because of no influence being exerted on the action of the position counter 315. Subsequently, the contents of the position counter 315 are confirmed at a predetermined interval. A carriage driving motor is controlled by a method such as PWM control so that the carriage moves at a constant speed. An execution of this action at a predetermined interval is easily attainable by a method in terms of software involving an interrupt processing function of the CPU within the controller 319. A moving velocity can be also calculated by dividing a difference between the contents of the counter by an interval time per interval.

Figure 29:
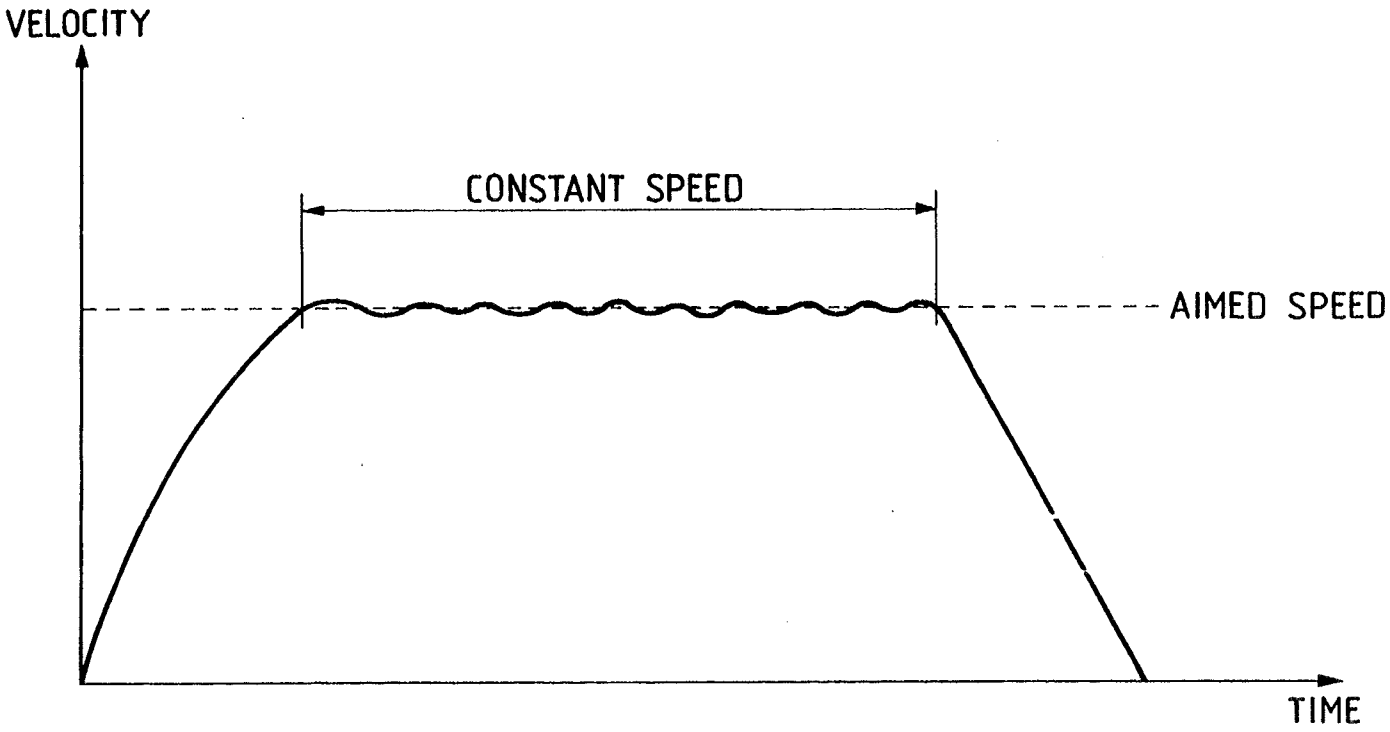
FIG. 29 is a diagram showing a carriage moving speed.

FIG. 29 is a diagram showing a moving velocity of the carriage. As obvious from the Figure, the carriage gradually increases the velocity and, when reaching an aimed velocity, moves substantially at a constant velocity. The carriage, after moving a predetermined distance, gradually decreases the velocity and then stops. Now, when the carriage reaches a constant moving velocity at a significant level, the duty detecting circuit 316 reads a duty time and calculates a duty ratio. Then, an output (reference voltage inputted to the comparator 313) of the D/A converter 314 is varied based on the result thereof. If the duty ratio does not reach substantially 50% in this state, the duty ratio is re-calculated, and the output of the D/A converter 314 is varied. The steps described above are repeated till the duty ratio comes to substantially 50%. When the duty ratio reaches substantially 50%, the carriage is returned to the home position. A temperature at this time, i.e., the output of the A/D converter 318, is read and stored in the RAM of the controller 319. Note that the step enters a standby action after the carriage has gone back to the home position.

By the way, the duty ratio may be calculated each time per pulse signal. However, there is no problem in terms of practicality even if calculated discretely. Hence, there may be read the contents of the duty detecting circuit 316 together with the contents of the position counter when effecting the interruption processing mentioned above. Further, as shown in FIG. 29, it is difficult to completely set constant the moving velocity of the carriage. Accordingly, an average value of the measurement effected several times is taken, and an adjustment is made based on this mean value. This manner is more preferable than by adjusting the reference voltage (output of the D/A converter 314) finely inputted to the comparator at the duty ratio each time.

Next, the operation during the recording (printing) action will be discussed. During the recording action, the carriage always moves. Excepting a motion starting time and a motion stopping time shown in FIG. 29, the carriage moves at the constant speed. Therefore, during this constant speed moving interval, the adjustment of the reference voltage is executed each time the interruption processing is performed. The duty ratio of the pulse signal is thereby kept at substantially 50%. At this time, after the output of the D/A converter 314 has been varied, the temperature is read and stored in the RAM of the controller. Note that even when moving the carriage for reasons other than the recording action, the same steps may be conducted.

Next, the operation during a standby status (e.g., off-line) will be explained. Temperature information is monitored at a predetermined interval. When the output of the D/A converter 314 is changed, this is compared with temperature information stored beforehand. Then, if a temperature difference is a predetermined value or greater, a series of the same actions as those executed when turning ON the power source are performed.

Figure 30:
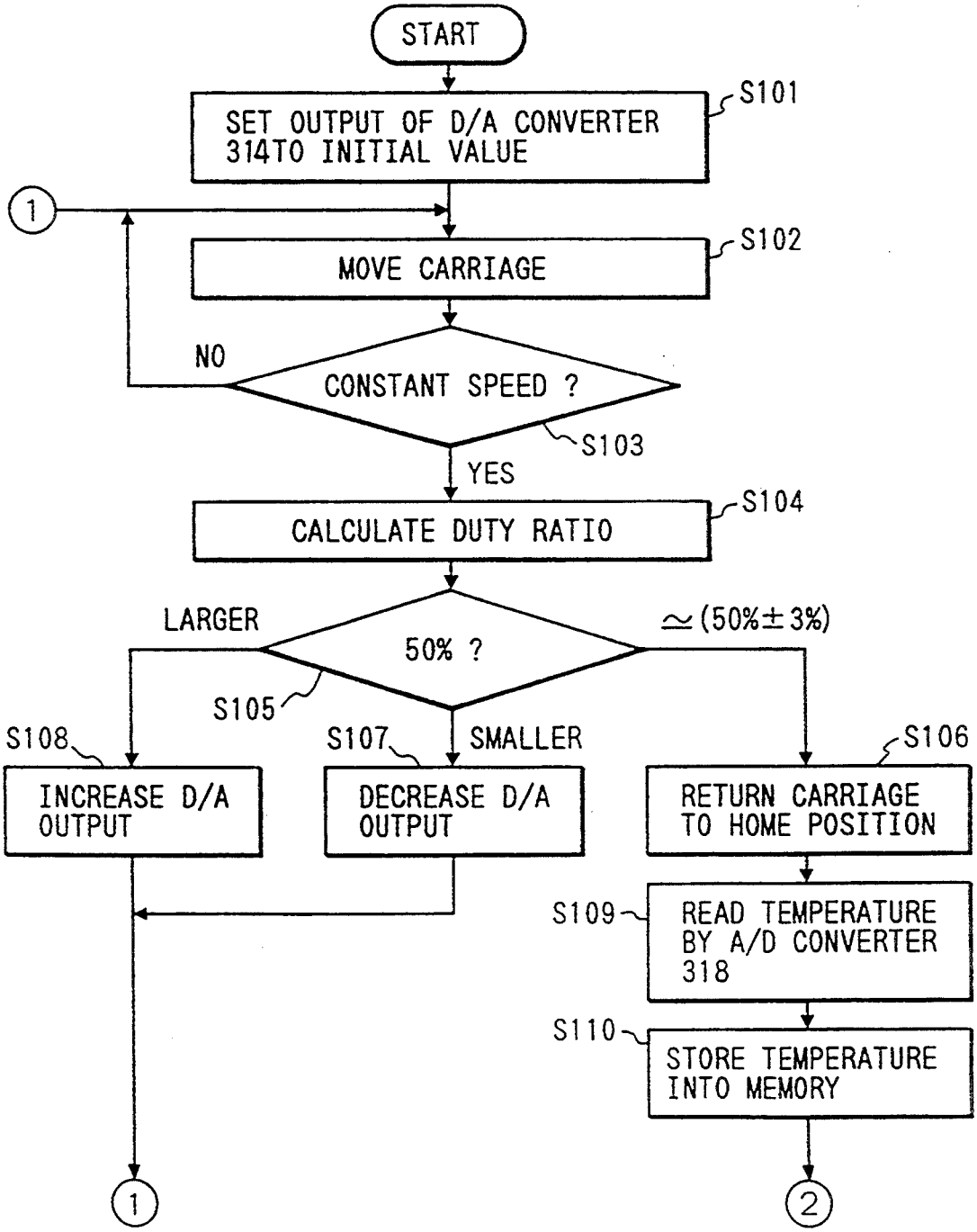
FIG. 30 is a flowchart of a control circuit shown in FIG. 26.
Figure 31:
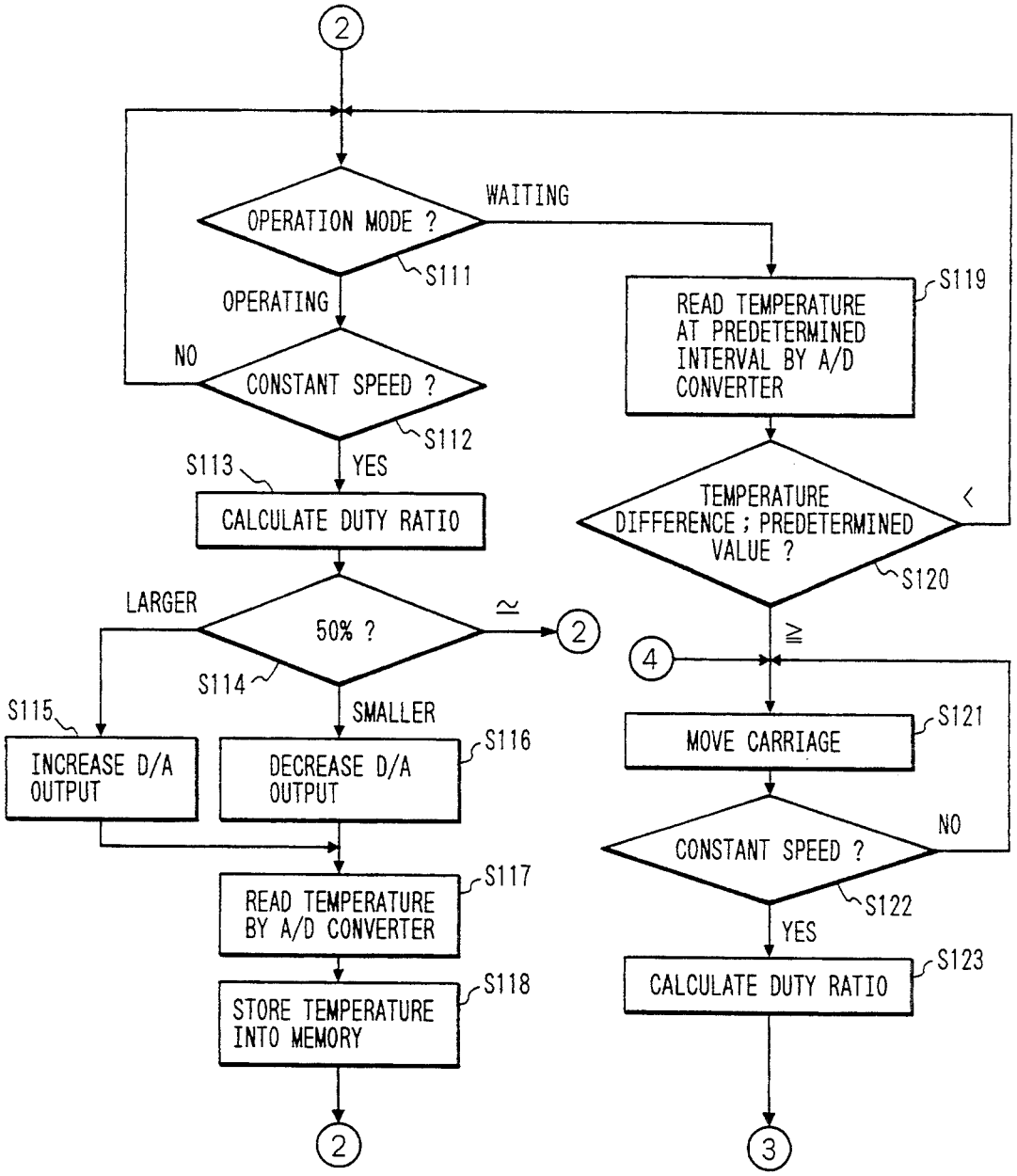
FIG. 31 is a flowchart showing actions continued from the flowchart of FIG. 30.
Figure 32:
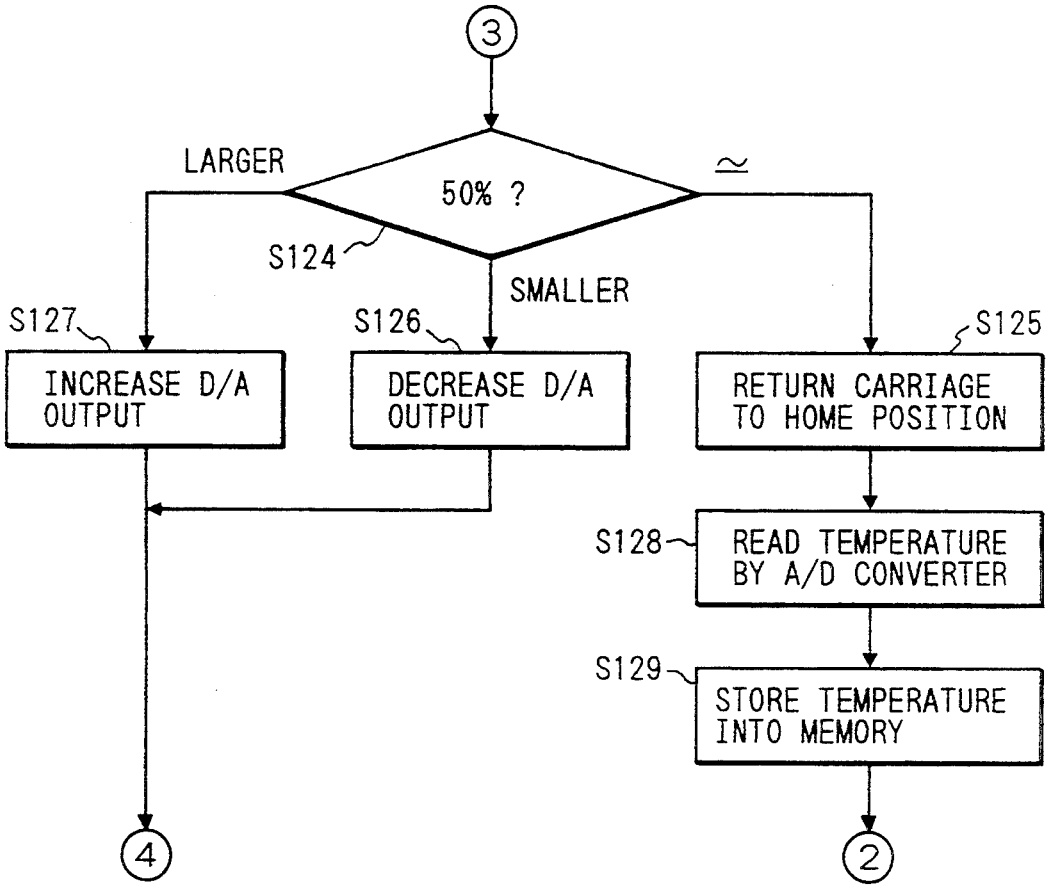
FIG. 32 is a flowchart showing actions continued from the flowchart shown in FIG. 30.

FIGS. 30–32 are flowcharts in which contents of the control explained above are rearranged. Next, the contents of the control will be explained referring to these flowcharts. However, the contents of principal actions have already been stated, and therefore only an outline will be given herein.

Referring to FIGS. 30–32, after turning ON the power source, the D/A converter 314 is set to the initial value (step S101). Next, the carriage is moved (step S102), and there is a wait till the carriage reaches a constant speed (step S103). After reaching the constant speed, as explained with reference to FIG. 28, the duty ratio is calculated (step S104).

Judged is whether the calculated duty ratio is greater or smaller than or substantially equal to 50% (e.g., within a range of 50%±3%) (step S105). If larger than 50%, the output of the D/A converter 314 is increased (step S108). Whereas if smaller, the output of the D/A converter 314 is decreased (step S107). Thereafter, the action goes back to step S102. The steps S102–S108 or S107 are hereafter repeated till the duty ratio comes to substantially 50%.

In step S105, if the duty ratio is judged to be substantially 50%, the carriage is returned to the home position (step S106). Subsequently, a temperature is read by the A/D converter (step S109) and stored in the RAM of the controller (step S110). Note that the carriage comes to a standby state in the home position.

Judged next is whether an indication of the recording action is given or not, i.e., during the recording action or the standby status (step S111). In the case of the recording action, whether the carriage moves at the constant speed or not is judged (step S112). If not at the constant speed, actions of steps S111, S112 are repeated till the constant speed is reached. When reaching the constant speed, the duty ratio is calculated (step S113). There is judged whether the duty ratio is larger or smaller than or equal to substantially 50% (step S114). If larger than 50%, the output of the D/A converter is increased (step S115). Whereas if smaller, the output of the D/A converter 314 is decreased (step S116). Subsequently, a temperature is read by the A/D converter 318 (step S117) and stored in the RAM of the controller (step S118). Note that if the duty ratio is judged to be substantially 50% in step S114, the action returns to step S111.

If the carriage is judged to be in the standby status in step S111, the A/D converter 318 reads a temperature at a predetermined interval (step S119). Judged next is whether or not a difference between the temperature read this time and the temperature read last time is smaller than a predetermined value (step S120). If smaller than the predetermined value, the action goes back to step S111. Whereas if larger than the predetermined value, the carriage is moved (step S121), and there is a wait till the carriage reaches the constant speed (step S122). The duty ratio is then calculated (step S123).

Next, there is judged whether the calculated duty ratio is greater or smaller than or equal to substantially 50% (step S124). If larger than 50%, the output of the D/A converter is increased (step S127). Whereas if smaller, the output of the D/A converter 314 is decreased (step S126). Thereafter, the action goes back to step S121. The steps S121–S127 or S126 are hereafter repeated till the duty ratio comes to substantially 50%.

In step S124, if the duty ratio is judged to be substantially 50% (e.g., within a range of 50%±3%), the carriage is returned to the home position (step S125). Next, a temperature is read by the A/D converter 318 (step S128) and stored in the RAM of the controller (step S129). Note that the carriage is brought into the standby status in the home position, (Tenth Embodiment)

In the embodiment discussed above, when the temperature difference larger than the predetermined value is produced during the standby status, the carriage is, as can be understood from the steps S120, S121, automatically moved. However, some cases may be thinkable, wherein this becomes troublesome. For instance, it is not desirable that the carriage automatically starts moving when the user replaces an ink cartridge employed for recording during the standby status. For avoiding such a trouble, a possible measure is to change the design so that the ink cartridge is allowed to be replaced only for an OFF-time of the power source. In some cases, however, such a measure can not be taken depending on a construction of an appliance.

Under such circumstances, in accordance with this embodiment, an in-standby process is modified as follows. The controller 319 judges, when trying to perform an event (e.g., a resumption of the recording action) to move the carriage next, whether or not the carriage is to be moved. If not moved, the carriage reverts to the standby status to prevent the movement of the carriage. Further, only when the carriage is to be moved, a series of the same actions as those when entering the power-ON state are carried out.

Figure 33:
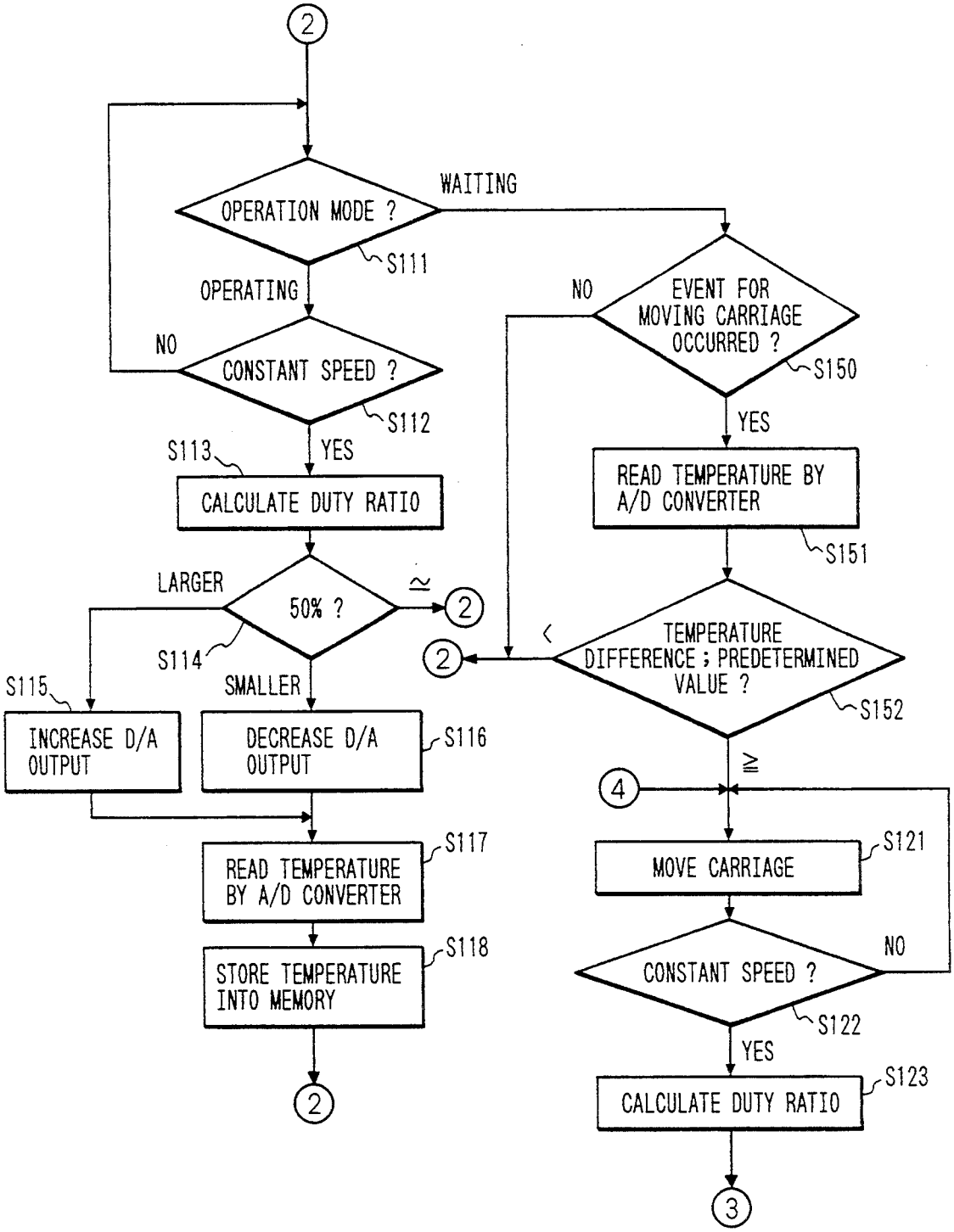
FIG. 33 is a flowchart showing steps in which the control contents in the flowchart shown in FIG. 31 are modified.

FIG. 33 is a flowchart in which the modified contents of the control explained above are rearranged. Turning to FIG. 33, if judged to be the standby status in step S111, it is judged whether the event to move the carriage happens or not (step S150). If the event does not happen, the action goes back to step S111. Whereas if it is judged that the event happens, the A/D converter 318 reads a temperature (step S151). Whether or not a difference between the read temperature of this time and the read temperature of the last time is smaller than a predetermined value is then judged (step S152). If the temperature difference is smaller than the predetermined value, the action returns to step S111. If larger, the action proceeds to step S121. There is hereafter conducted the control of the same actions of steps S122–S125, S126 or S127 as those in the power-ON state.

In accordance with this embodiment, the carriage in the standby status is by no means moved in an uncontrolled manner (i.e., as far as there happens no event to move the carriage as by a command of recording action, the action does not proceed to step S121 wherein the carriage is moved). It is therefore possible to prevent the trouble which may take place when replacing the ink cartridge.

As discussed above, according to the ninth and tenth embodiments of this invention, the control to set the duty ratio at 50% is conducted beforehand just when the carriage reaches the constant moving speed in the power-ON state. Hence, the highly accurate duty ratio 50% is quickly obtained. Even when shifting to the recording action, the recording action can be easily performed at the duty ratio 50% which gives a desirable printing result from the beginning. Besides, there is executed the control to set the duty ratio at 50% at all times when the carriage reaches the constant moving speed during the recording action also. The duty ratio can be therefore always kept at 50%during the recording action.

Further, in consideration of a temperature characteristic (a change in the duty ratio due to variations in temperature) of the position detecting circuit including the magnetic head, if the temperature difference increases even in the standby state, the control to keep the duty ratio at 50% is performed. Hence, it is feasible to maintain the duty ratio of the pulse signal substantially at 50% at all times not only during the recording (printing) action but also in the standby status. When shifting to the recording action, the recording action can be quickly executed at the duty ratio 50%. Besides, it is possible to actualize the serial printer capable of obtaining an excellent recording (printing) result in a wide temperature range even when the temperature fluctuates in the in-use process.

(Eleventh Embodiment)

An eleventh embodiment of the present invention will next be discussed.

Figure 34:
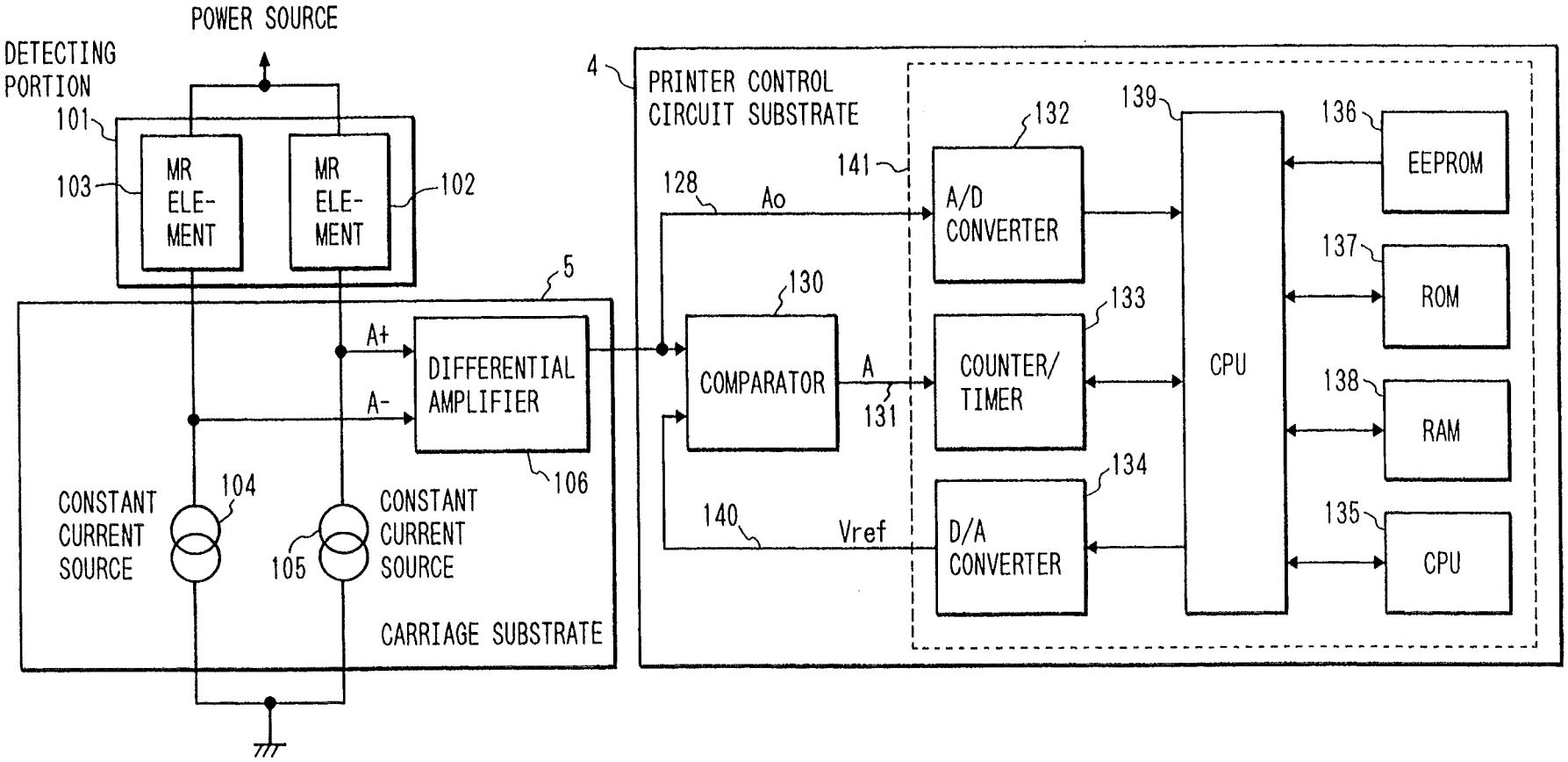
FIG. 34 is a diagram illustrating a block control circuit of the printer shown in FIG. 1 in an eleventh embodiment of this invention.

FIG. 34 is a block diagram illustrating a configurational example of the circuit of the serial printer shown in FIG. 1. Referring to FIG. 34, the scale portion of the magnetic linear encoder is mounted in the carriage and fixed to the apparatus body. The magnetic linear encoder includes a detecting portion 101 for detecting a relative moving position of the carriage by detecting information which is magnetized on the scale portion. The detecting portion 101 incorporates magnetic detecting elements 102, 103 consisting of MR elements which act based on the magnetic resistance effect. The detecting portion 101 is also connected to a carriage substrate 5 (indicated by a broken line in FIG. 1) mounted on the carriage. This carriage substrate 5 includes a constant current circuit 104 and a differential amplifier 106 for differentially amplifying respective signals detected by the detecting elements. An output signal $A_O$ (or 108) is outputted from the differential amplifier 106.

A printer control circuit substrate 4 includes an A/D converter 132 for A/D converting the output signal $A_O$ and a comparator 130 for generating a counter pulse A (or 131) having a pulse waveform by comparing the output signal $A_O$ with a reference voltage. The printer control circuit substrate 4 also includes a D/A converter 134 for generating a reference voltage $V_{ref}$ (or 140) defined as an input signal to one terminal of the comparator 130 and a counter/timer 133 for counting counter pulses A. The printer control circuit substrate 4 further includes a CPU 135 for controlling the system, an EEPROM 136 serving as a memory device, a ROM 137, a RAM 138 and a CPU bus 139 serving as a bus for data, addresses and control signals of the CPU 135. Note that some or the whole of the components surrounded with the broken line may be incorporated into the CPU 135.

Next, the operation of the thus constructed circuit will be explained. The magnetic detecting elements 102, 103 are supplied with a constant current via the constant current circuits 104, 105, respectively. Magnetic patterns are previously magnetized at a fixed interval on the scale portion 501 (see FIG. 1), fixed to the apparatus body, of the magnetic linear encoder. When the detecting portion moves along the scale portion 501, resistance values of the magnetic detecting elements 102, 103 vary. Variations in the resistance values are detected as fluctuations in voltage. After being amplified in the differential amplifier 106, amplification signals thereof are inputted to one input terminal of the comparator 130.

The output signal $A_O$ transmitted from the differential amplifier 106 is a pseudo sine wave and therefore compared with the reference voltage $V_{ref}$ outputted from the D/A converter 134 in the comparator 130. The counter pulses A are thereby obtained as synchronous signals. The counter pluses A are inputted to and counted by the counter/timer 133. A count value thereof represents a position of the carriage. Note that the CPU 135 controls the system and transfers the data of the EEPROM 136, the ROM 137 and the RAM 138 via the CPU bus 139. The CPU 135 also controls the A/D converter 132, the counter/timer 133 and the D/A converter 134. The CPU 135 further controls other functions (e.g., an interface function to the host control over a variety of motors, a printing action, etc.) of the serial printer.

As discussed above, the output signal $A_O$ obtained from the detecting portion of the magnetic linear encoder is the pseudo sine wave. It is therefore required that the output signal be converted into the counter pulse A expressed by the digital signal (pulse waveform) by use of the converter 130. On the other hand, the reference voltage $V_{ref}$ inputted to the comparator employed for the conversion and compared with the output signal $A_O$ is desirably an average value of the output signals $A_O$. For this reason, an initial adjustment is, it is required, made so that the reference voltage $V_{ref}$ becomes the average value of the output signals $A_O$.

Figure 35:
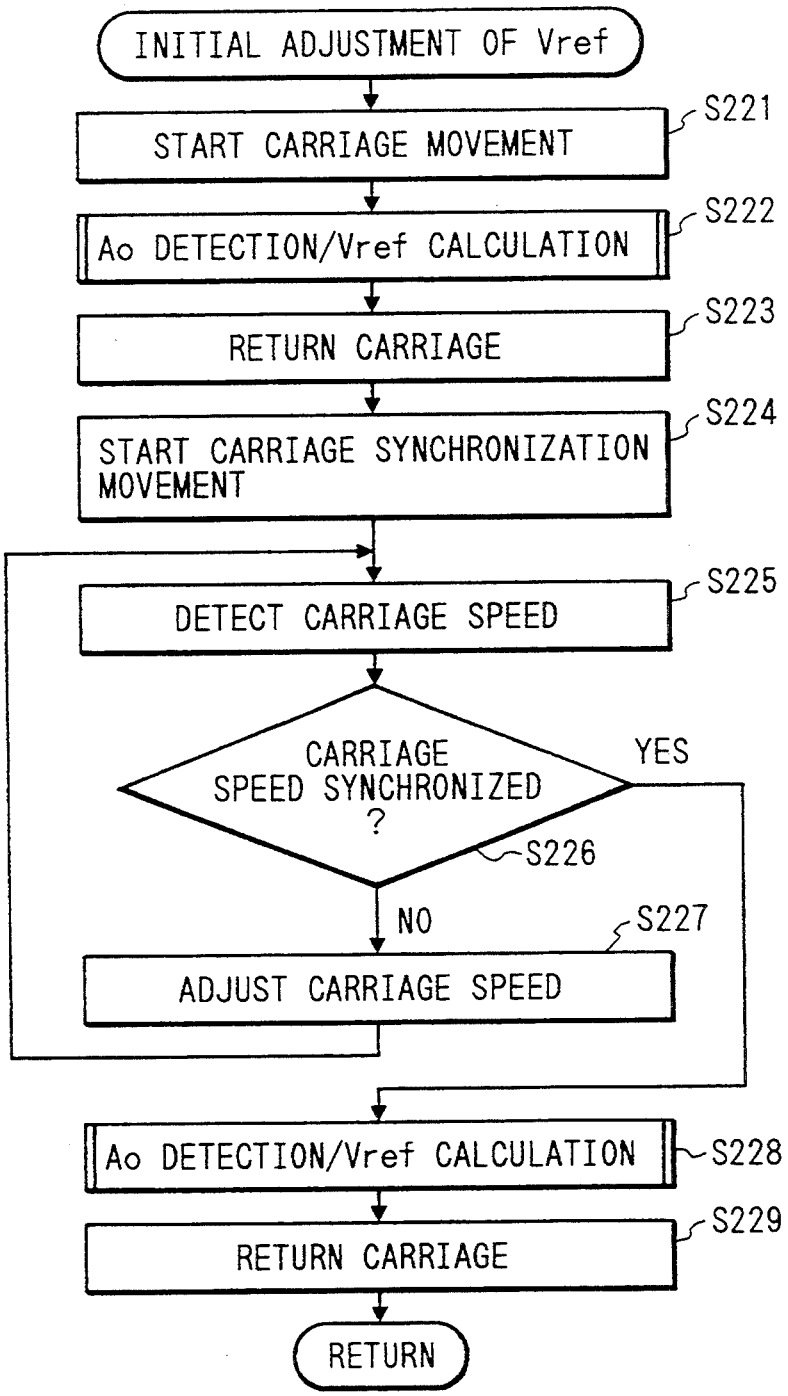
FIG. 35 is a flowchart showing an initial adjustment sequence of the reference voltage of the comparator shown in FIG. 34.

The following is an explanation of procedures for the initial adjustment of the reference voltage $V_{ref}$ with reference to a flowchart of FIG. 35.

Figure 36A:
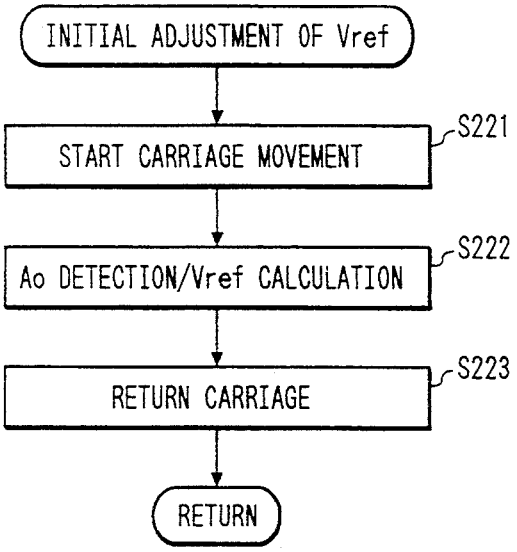
FIG. 36A is a flowchart showing steps S221–S223 of the flowchart shown in FIG. 35.

Referring to FIG. 35, the carriage starts moving (step 221). The counter pulse from the linear encoder is not yet correctly outputted at this moment, and, hence, the moving speed is unknown. Accordingly, there is previously obtained the minimum torque by which to shift a load based on mechanism parts such as the carriage and the guide shaft member. The CPU issues a command to move the carriage at a velocity so that the carriage motion is not so fast. Next, the output signals $A_O$ from the differential amplifier 106 are detected. Outputted to the D/A converter 134 is such a digital value that the average value of the output signals $A_O$ becomes the reference voltage $V_{ref}$(step S222). Next, the carriage is returned to the initial position (step S223). These steps S222, S223 are shown in FIG. 36A.

Figure 36B:
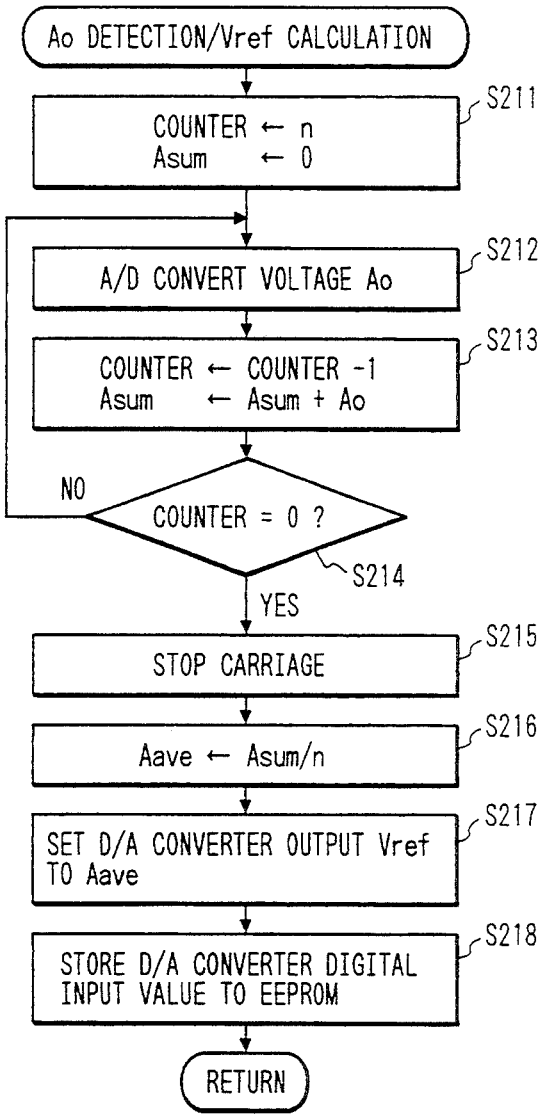
FIG. 36B is a flowchart showing details of step S222 of the flowchart shown in FIG. 36A.

Next, the content of step S222 will be explained in greater detail with reference to FIG. 36B. To begin with, the number n (an integer of 1 or larger) predetermined as a measurement number of the output signals $A_O$ is initialized in the counter. Simultaneously, an addition area $A_{sum}$ of $A_O$ is cleared (step S211). Next, data $A_O$ is A/D converted by the A/D converter 132 and thereafter taken in the RAM 138 (step S212). Subsequently, the counter is decremented, and at the same time, $A_O$ is added to $A_{SUM}$ (step S213). Next, whether or not the counter is 0 is judged (step S214). If not 0, the action goes back to step S212. If the counter is 0, the action proceeds to step S215. That is, steps S212, S213 are repeated till the counter is zeroed. In step S214, when the counter is zeroed, the carriage is stopped (step S215). Subsequently, $A_{SUM}$ is divided by the measurement number n to obtain an average value $A_{ave}$ of $A_O$ (step S216). Set next in the D/A converter 114 is such a digital value as to establish $V_{ref}=A_{ave}$ (step S217). Finally, the EEPROM 116 stores the digital value set in step S218.

Incidentally, a sequence of the initial adjustment of $V_{ref}$ is normally performed once before delivering the serial printer from the factory. However, if the output $A_O$ largely changes with a passage of time, a sequence of the $V_{ref}$ initial adjustment may be incorporated in the initialization sequence after turning ON the power source when used. As stated earlier, the digital value stored in the EEPROM is set in the D/A converter in the initialization sequence after the power-ON process of the serial printer.

Next, the carriage is moved again (step S224). Subsequently, steps S225–S227 will be executed. These steps, however, form a carriage speed control loop. To be specific, the carriage speed is detected (step S225). Whether or not the carriage speed is synchronized is judged (step S226). If not synchronized, the carriage speed is adjusted (step S227). The action goes back to step S225, wherein the carriage speed is detected once more. Whether or not the carriage speed is synchronized is judged again. Steps S225–S227 are repeated till the carriage speed is synchronized. When synchronized, the action proceeds to the next step, i.e., step S228.

Herein, the carriage speed adjustment in step S227 involves a step of reading a count value of the count pulses A from the counter/timer. The carriage speed is adjusted to establish the following relational formula 1 wherein a sampling period $T_S$ of the A/D converter is expressed in relation to a period of the output $A_O$ of the MR element.

$$T_S=T_{AO}/2^m \text{ (m is the integer of 1 or greater)} \quad (1)$$

Figure 37:
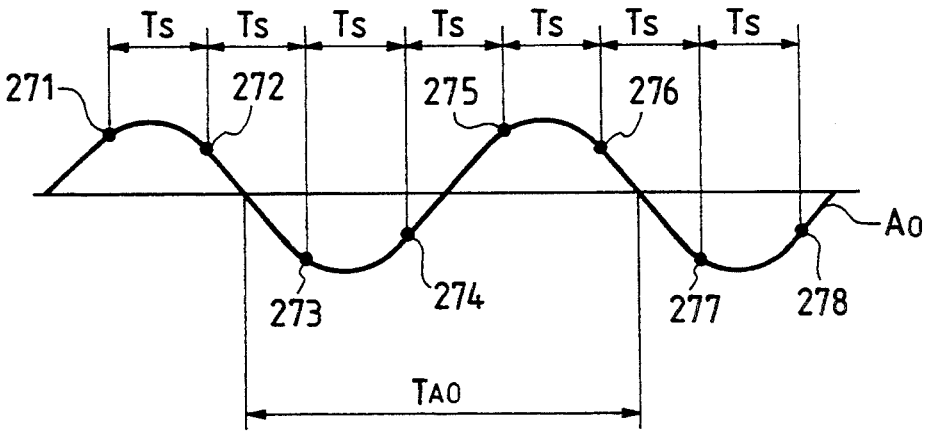
FIG. 37 is a diagram depicting an input waveform of the comparator shown in FIG. 34.

Note that FIG. 37 shows an example where the relational formula 1 is established.

On this occasion, when $T_s$ is variable, only $T_S$ may be varied to establish the relational formula 1 without changing $T_{AO}$, i.e., without changing the moving speed of the carriage.

Next in step S228, $A_O$ is measured n-times at a $T_S$-interval, thus calculating the average value $A_{ave}$. This step S228 is the same as steps S211–S218 which have already been explained in association with FIG. 36B. It is, however, required that the measurement number n should satisfy the following relational formula 2:

$$n=k\cdot 2^m \quad (2)$$

(where m is the same as m in the relational formula 1, and j is the integer of 1 or larger). FIG. 37 also shows an example where the relational formula 2 is established. In the example of FIG. 37, m=2, k=2, and n=8.

The average value $A_{ave}$ of the measurement effected n-times is equal to a DC component of $A_O$. For this purpose, sampling may be effected at such a timing that a phase of $A_O$ is shifted 180 degrees. It can be comprehended from the example of FIG. 37 that values of points 271–273, 272–274, 275–277 and 276–278 offset errors with respect to the DC level of $A_O$.

Then, finally the carriage is returned (step S229), and the $V_{ref}$ initial adjustment is thus completed.

(Twelfth Embodiment)

Next, a twelfth embodiment will be discussed with reference to FIG. 38. A sequence of the initial adjustment of the reference voltage is the same as that in FIG. 35. This embodiment is applicable to a case where the sampling period $T_S$ can not be shorter than the period $T_{AO}$ of the output $A_O$ of the MR element, i.e., the carriage moving speed can not be decreased. Videlicet, an error in the measurement average value $A_{ave}$ can be reduced by modifying the above-mentioned relational formulae 1, 2 into the following relational formulae (1'), (2'):

$$T_S=T_{AO}(\tfrac{1}{2}+m) \text{ (m is the integer of 1 or larger)} \quad (1')$$

$$n=2^k \text{ (k is the integer of 1 or larger)} \quad (2')$$

Figure 38:
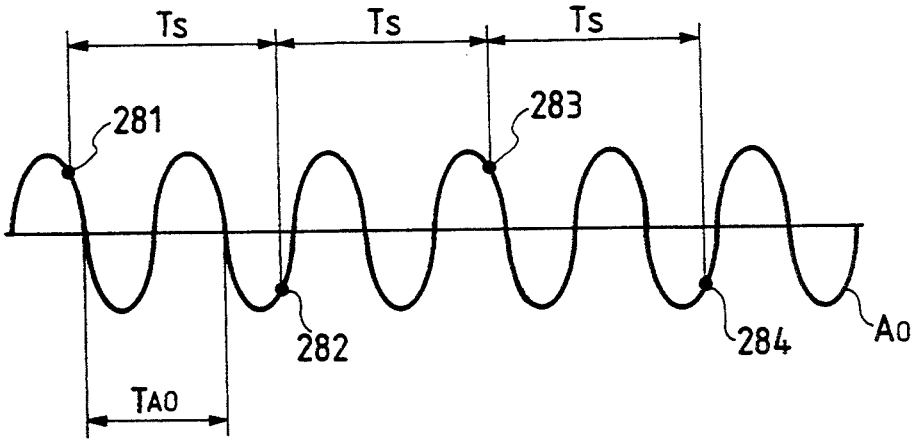
FIG. 38 is a diagram depicting an input waveform of the comparator shown in FIG. 34 in a twelfth embodiment of this invention.

FIG. 38 shows an example when m=1, k=2, and n=4. Values of points 281–282 and 283–284 offset each other.

As discussed above, according to the eleventh and twelfth embodiments of this invention, the carriage moving speed is synchronized with the sampling period of the A/D converter with respect to the MR element output. Added to the $V_{ref}$ initial adjustment sequence is the sequence of sampling effected a given number of times obtained from the carriage moving speed and from the sampling period. The counter pulse can be thereby obtained, wherein the duty ratio is approximate to 50%. The variations in the counter pulse waveform due to the passage-of-time change in the MR element output can be restrained. A scatter in density as a result of recording by the serial printer can be thereby restrained.

(Thirteenth Embodiment)

Figure 39:
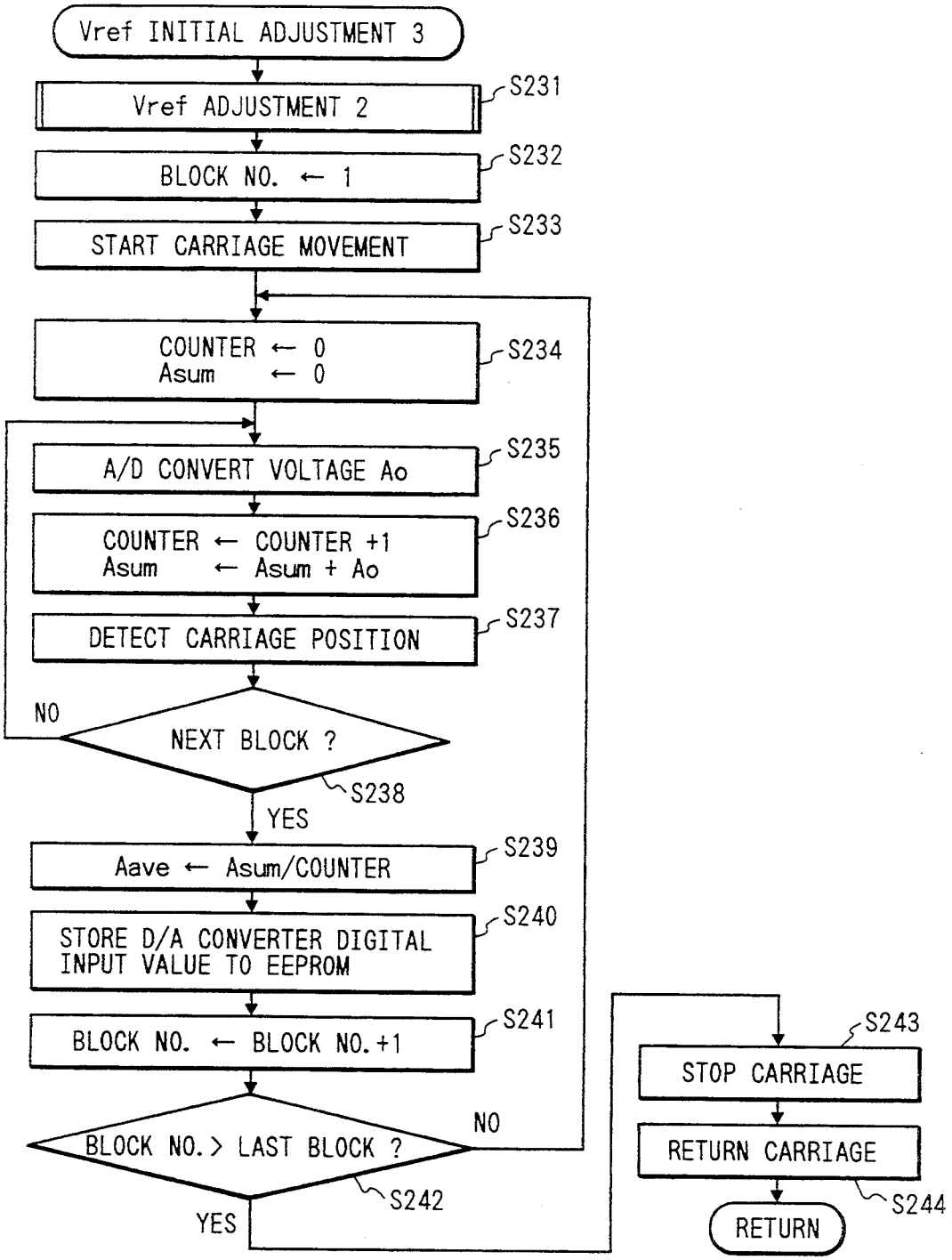
FIG. 39 is a flowchart showing an initial adjustment sequence of the reference voltage of the comparator shown in FIG. 34 in a thirteenth embodiment of this invention.

Next, a thirteenth embodiment of this invention will be described. FIG. 39 is a flowchart ($V_{ref}$ initial adjustment 3) showing actions of a reference voltage $V_{ref}$ initial adjusting method in the serial printer according to this invention. Note that the hardware of the serial printer is the same as that shown in FIGS. 1 and 34, and its explanation is omitted herein.

Turning to FIG. 39, the steps (steps S221–S229 shown in FIG. 35) of the $V_{ref}$ initial adjustment 2 described above are at first executed (step S231).

Next, a block number 1 is set, videlicet, the block number is initialized (step S232). The carriage starts moving (step S233). The add counter of $A_O$ and the addition area $A_{SUM}$ are initialized (step S234). Subsequently, the A/D converter measures the voltage $A_O$ (step S235). The add counter is incremented (1 is added), and, besides, $A_O$ is added to $A_{SUM}$ (step S236). A carriage position is detected through the counter/timer (step S237).

Subsequently, whether or not the carriage position reaches the next block is judged (step S238). Note that the block herein implies one unit when a carriage moving range is previously partitioned into blocks at an interval. The above-mentioned block number implies a serial number put on each block which is incremented as the carriage moves. In step S238, if it is judged that the carriage position does not reach the next block, steps S235–S237 are repeated till the next block is reached.

In step S238, if it is judged that the carriage position reaches the next block, $A_{SUM}$ is divided by the add counter to calculate the average value $A_{ave}$ (step S239). Next, a digital value is stored in an area, corresponding to the present block number, of the EEPROM. this digital value being set in the D/A converter as the average value $A_{ave}$ in the carriage position indicated by the thus obtained present block number, i.e., as the reference voltage $V_{ref}$ (step S240). Subsequently, the block number is incremented, or in other terms, updated (step S241). Judged is whether or not the updated block number is larger than the predetermined final block number (=dividing number of carriage position) (step S242).

In step S242, if it is judged that the present block number is not larger than the final block number, steps S234–S242 are repeated till the present block number becomes larger than the final block number. In this manner, the average value $A_{ave}$ per block is stored in each corresponding area of the EEPROM. Then, in step S242, if it is judged that the present block number is larger than the final block number, the carriage stops (step S243). The carriage is returned to the initial position (step S244).

Next, the actions shown in the flowchart of FIG. 39 will be explained referring to a timing chart of FIG. 40. FIG. 40 is a timing chart showing relationships of the carriage position versus the output signal $A_O$ from the differential amplifier 106, the ideal reference voltage $V_{ref}$ defined as the DC component of $A_O$, an ideal counter pulse A(a) in this instance, a counter pulse A(b) when the average value of $A_O$ in the entire carriage moving range is $V_{ref}$ and a counter pulse A(c) when an in-block average value of $A_O$ is $V_{ref}$. This embodiment presents a case where the carriage moving range is partitioned into four blocks.

In step S231 of FIG. 39, the counter pulse A can be, though it does not take an ideal waveform as shown by A(b) in FIG. 40, obtained enough for block partitioning of the carriage position. One block may be set well longer than a period (e.g., 360 dpi) of the counter pulse A. A positional accuracy of a block boundary may also be set considerably lower than a carriage position detecting accuracy needed during the printing process. Accordingly, the counter pulse A at the end of step S231 may not be so accurate.

The block number is initialized in step S232. The carriage starts moving in step S233. In step S234, the A and the addition area $A_{SUM}$ are initialized. In steps S235–S238, $A_O$ undergoes periodic sampling till the carriage position exceeds a range of the present block number, and an addition thereof is applied to $A_{SUM}$. The $A_O$ average value $A_{ave}$, in the present block number is thus obtained in step S239. In step S240, a digital value is stored in an area, corresponding to the present block number, of the EEPROM, this digital value being set in the D/A converter for attaining $V_{ref}=A_{ave}$. The block number is incremented in step S241. The present block number is compared with the predetermined final block number (4 in the embodiment in FIG. 40) in step S242. When the present block number does not exceed the final block number, steps S234–S242 are repeated. The digital value set in the D/A converter is therefore sequentially stored in the EEPROM, with $A_O$ average value in each block being $V_{ref}$. After the $V_{ref}$, digital values in all the blocks have completely been stored in the EEPROM, the carriage stops in step S243. The carriage is returned to the original position in step S244.

In FIG. 40, (c) shows the counter pulse A when $V_{ref}$ is varied stepwise in accordance with the carriage position so that the in-block $A_O$ average value is $V_{ref}$. This is approximate to the ideal waveform A(a) as compared with the waveform A(b) when $V_{ref}$ is the $A_O$ average value in the entire carriage moving range.

Further, the number of blocks may be set to an optimum value depending on an amount of fluctuation in the DC component of $A_O$ as well as on an allowance of the areas in the EEPROM. For instance, if the amount of fluctuation in the DC component of $A_O$ is large, and when there are sufficient empty areas of the EEPROM, the number of blocks is preferably large (finer blocks). In general, the blocks are arranged preferably at equal spacings but may be, if there is some allowance for areas of the EEPROM, arranged at unequal spacings. In this case, it is required that the carriage position at the block boundary be also stored in the EEPROM. This is effective in such an instance that the DC component of $A_O$ locally fluctuates.

Figure 41:
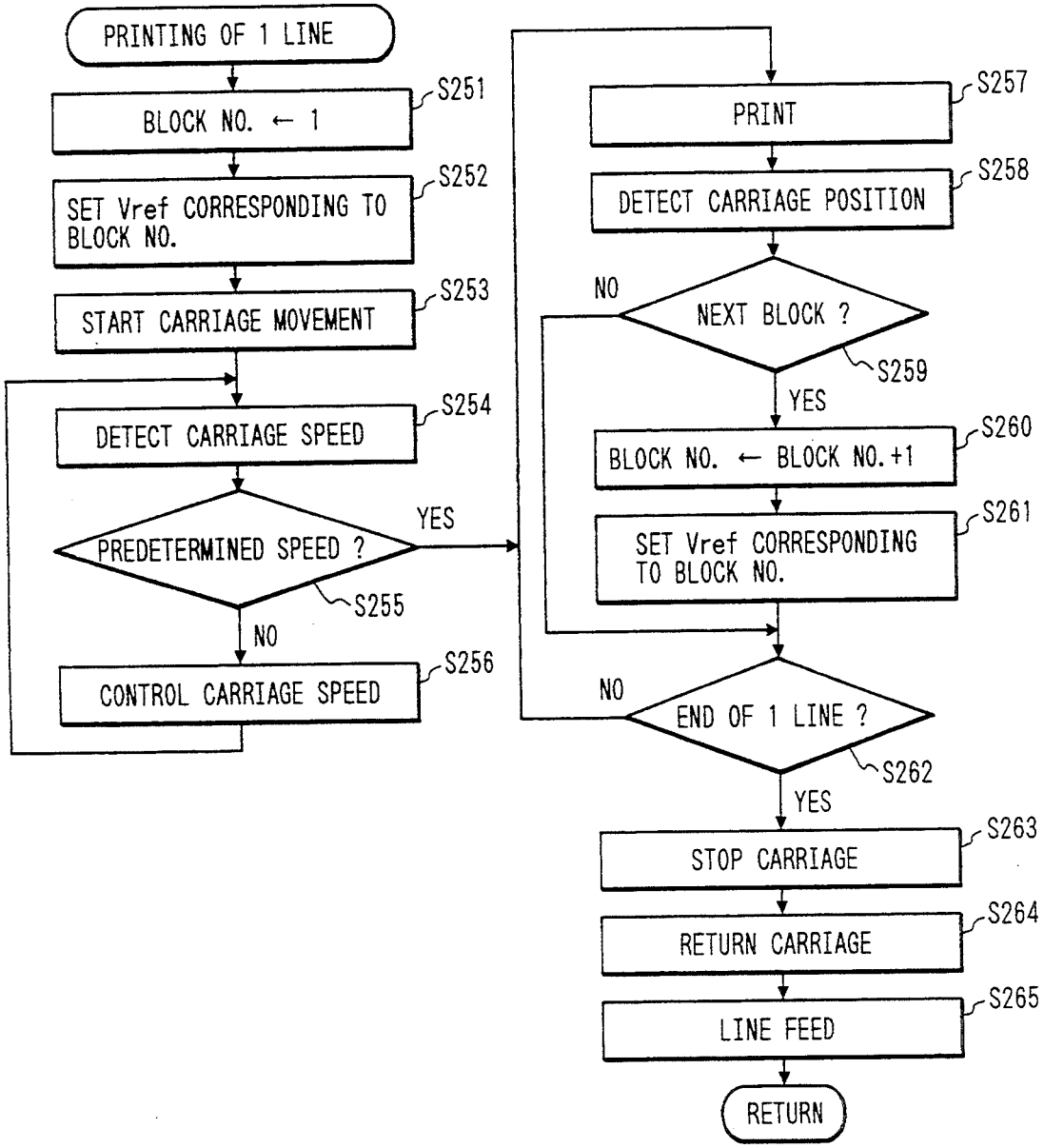
FIG. 41 is a flowchart showing a one-line printing sequence of the control circuit shown in FIG. 34.

Next, the printing action in the thirteenth embodiment of this invention will be explained with reference to FIG. 41. As stated above, the carriage moving range is partitioned into blocks, and the reference voltage $V_{ref}$ is set per block. The printing action corresponding thereto is accordingly needed. FIG. 41 is a flowchart showing printing for one line in such a case. In this flowchart, steps S251–S252 and steps S258–S260 are added by way of the thirteenth embodiment of this invention. Other steps are the same as those shown in FIG. 36A.

Paying attention to FIG. 41, in step S251, 1 is set as a block number, i.e., the block number is initialized. In step S252, the reference voltage $V_{ref}$ corresponding to the block number 1 is set in the D/A converter. In step S253, the carriage starts moving. The carriage speed is set at a predetermined velocity in a loop formed by steps S254–S256. More specifically, the carriage speed is detected in step S254. Whether or not the carriage speed is the predetermined velocity is judged in step S255. If not the predetermined velocity, the carriage speed is controlled in step S256. The action thereafter goes back to step S254. Steps S254–S256 are repeated till the predetermined velocity is reached. Subsequently, in step S257, printing is effected in a predetermined position.

Next in step S258, the carriage position is detected. Steps S259–S261 are to detect which block the carriage now exists and to reset, if over the block boundary, the reference voltage $V_{ref}$ in accordance with the block number.

Next in step S262, whether one-line printing has been finished or not is judged. If not finished, steps S257–S262 are repeated. Whereas if finished, the carriage stops in step S264. A line feed is performed in step S265.

Note that steps S251, S259, S260 in the flowchart of FIG. 41 may be modified as below in the case of bidirectional printing.

Step S251: Block number←Block number corresponding to the present carriage position.

Step S259: Previous block?

Step S260: Block number←Block number−1

Incidentally, a stepwise variation in $V_{ref}$ at the block boundary is, as shown in FIG. 42A, abrupt and causes a generation of noises in the counter pulse A. In this case, as shown in FIG. 42B, the variation in $V_{ref}$ can be made moderate by performing the setting in the D/A converter a plurality of times, separately.

(Fourteenth Embodiment)

Figure 43:
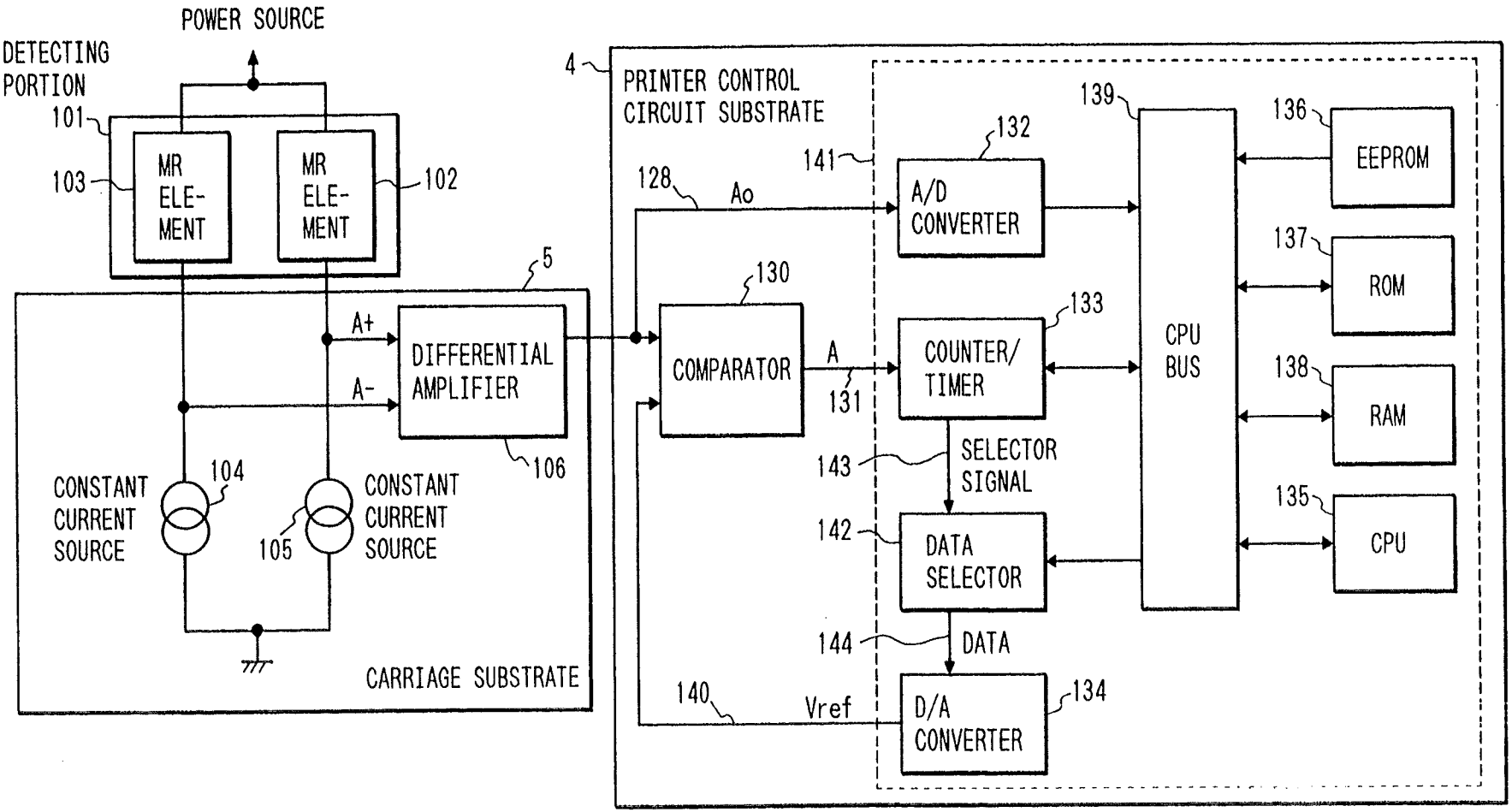
FIG. 43 is a diagram illustrating a block control circuit of the printer illustrated in FIG. 1 in a fourteenth embodiment of this invention.
Figure 44:
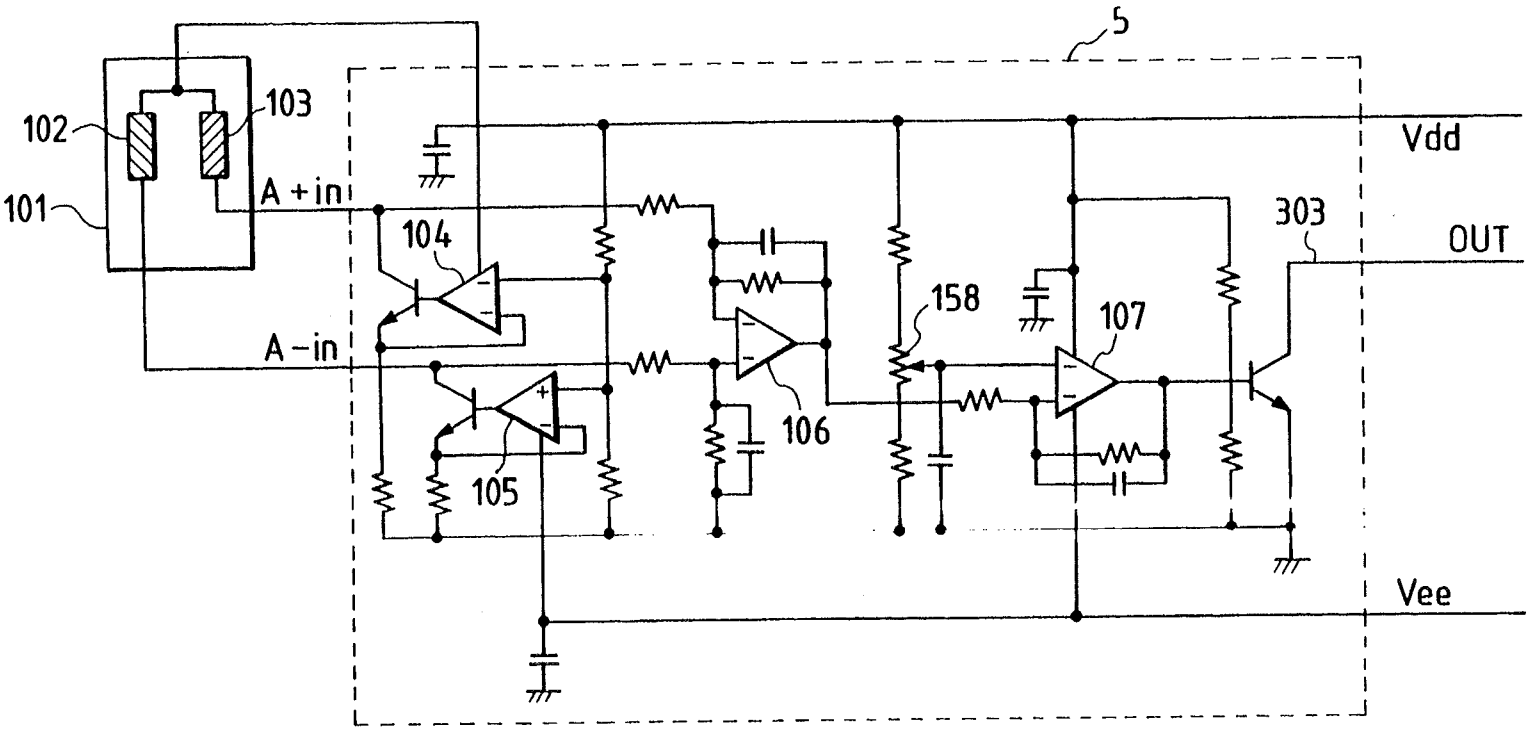
FIG. 44 is a circuit diagram illustrating a conventional synchronous signal generating circuit.
Figures 45A, 45B:
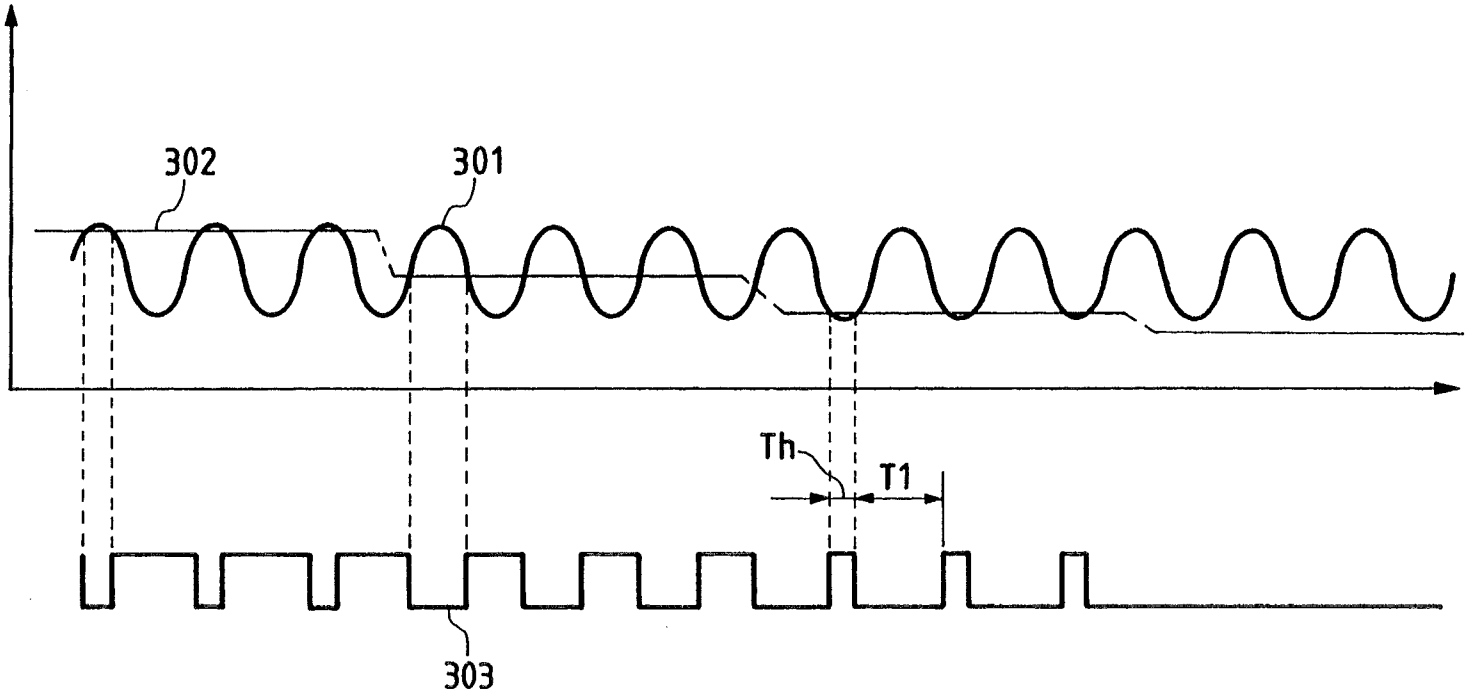
FIGS. 45A and 45B are diagrams showing signal waveforms of an input and an output of the synchronous signal generating circuit illustrated in FIG. 44.
Figure 46A:
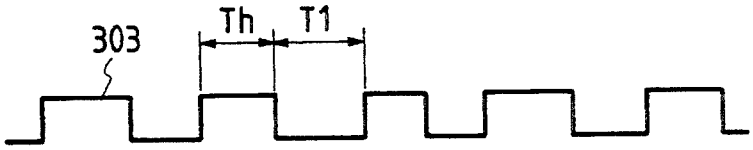
FIGS. 46A and 46B are explanatory diagrams each showing a recording action based on the synchronous signal generating circuit illustrated in FIG. 44.
Figure 46B:
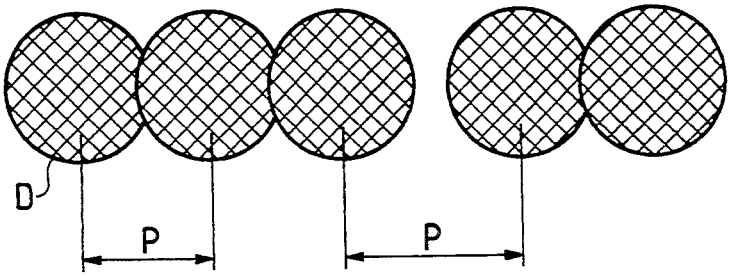
Figure 47:
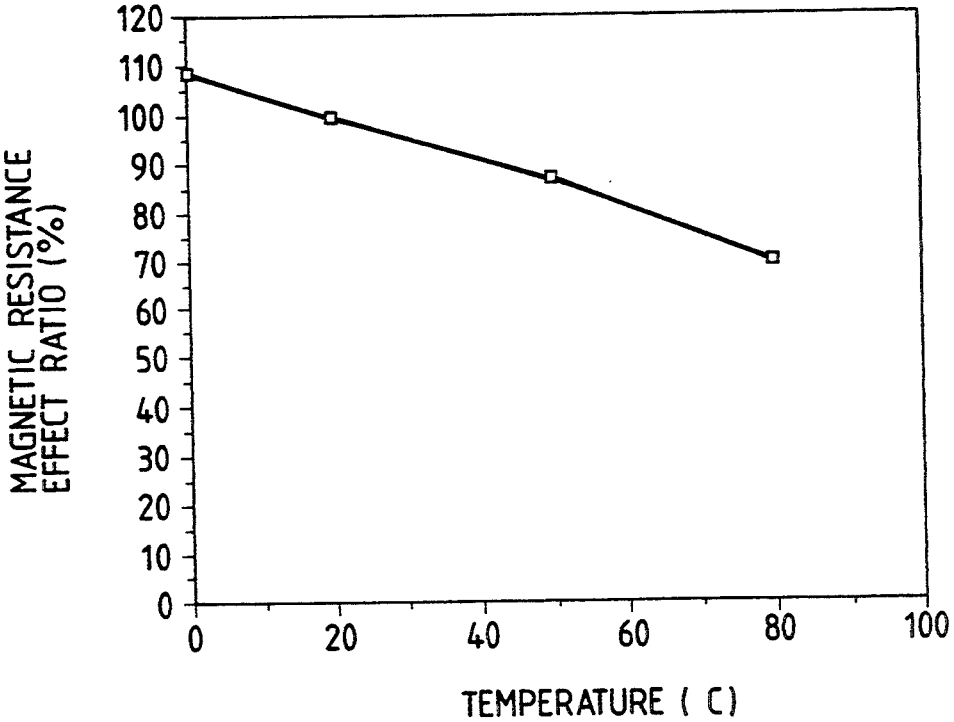
FIG. 47 is a chart showing a relationship of a temperature versus a magnetic resistance effect rate.
Figures 49A, 49B:
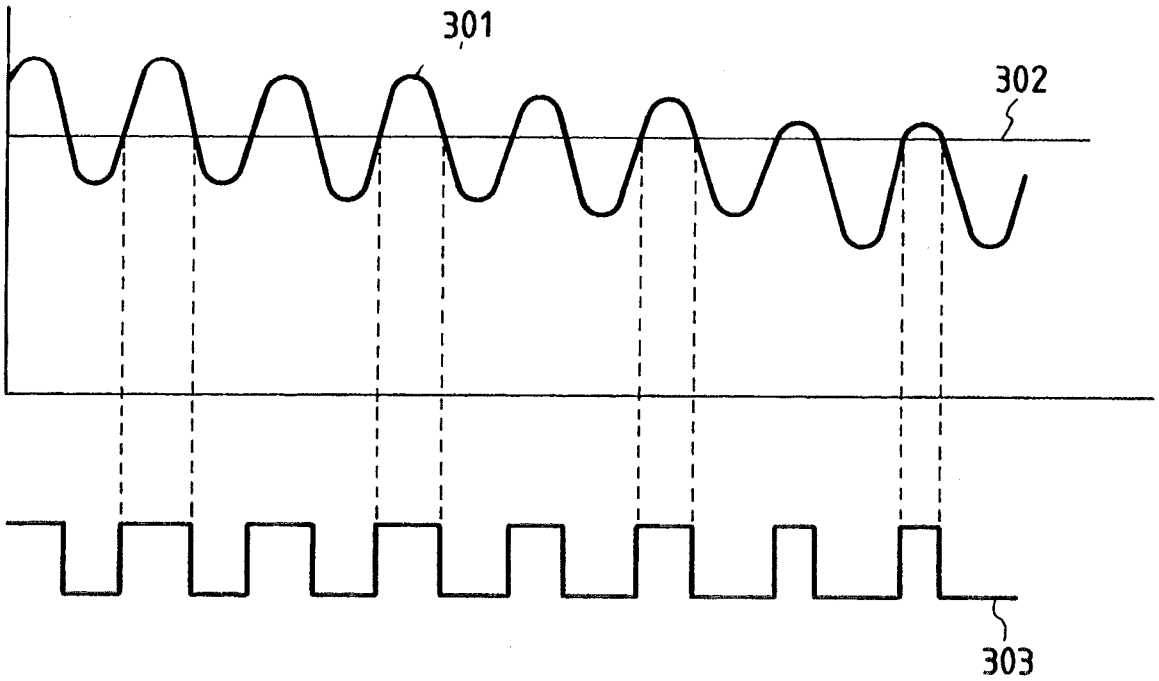
FIGS. 49A and 49B are time charts of respective portions of the synchronous signal generating circuit illustrated in FIG. 44.

A fourteenth embodiment for printing according to this invention will be explained with reference to FIG. 43. FIG. 43 is a circuit block diagram in the fourteenth embodiment. The circuit shown in FIG. 43 has an addition of a data selector 142 in contrast with the circuit illustrated in FIG. 34. Other configurations are the same, and hence the following explanation is centered on the data selector 142. The portions relative to other configurations have already been explained, and, hence, the descriptions thereof are omitted.

D/A converter set data for a plurality of blocks which have been written from the CPU 135 are selected by the data selector 142 in accordance with a selector signal 143 coming from the counter/timer 133. The selected data are set in the D/A converter 134. The corresponding-to-carriage-position setting of $V_{ref}$ can be thereby conducted without increasing a load in terms of software, i.e., in accordance with the flowchart exclusive of steps S251–S252 and steps S258–S261 in the 1-line printing flowchart of FIG. 41.

The digital data of $V_{ref}$ in each block which is obtained in the embodiment of FIG. 39 is previously set in the data selector 142 before the printing action as an initial state before the printing action. Simultaneously, the counter/timer 133 is connected to the data selector 142, whereby the carriage position counter data for high-order several bits corresponding to each block are transferred in the form of the selector signal 143 from the counter-timer 133 to the data selector 142. For example, when the division number of blocks is set to 4, two or three bits may suffice for the selector signal 143.

When the carriage moves after entering the printing action, the carriage position counter within the counter/timer 133 counts up and down correspondingly, with the result that the selector signal 143 changes. An item of $V_{ref}$ digital data 144 imparted to the D/A converter 134 is changed over by the data selector 142. Note that the data selector 142 may be so constructed as to be capable of storing a plurality of items of data, selecting one item of the data with the aid of the selector signal and outputting it. Accordingly, an arrangement may be taken, wherein the data selector involves the use of, e.g., a dual port RAM, and the selector signal is connected to an address of one port.

Further, as depicted in FIG. 42A, in a case where a stepwise variation of $V_{ref}$ at the block boundary is abrupt and induces a generation of noise in the counter pulse A, an output 140 of the D/A converter 134 may be inputted via a low-pass filter (unillustrated) to the comparator 110.

As discussed above, there is provided the software for previously measuring and storing the reference voltage $V_{ref}$ corresponding to the carriage position. Provided also is the software or hardware for selecting in real time the reference voltage $V_{ref}$ stored corresponding to the carriage position during the printing action. It is therefore possible to obtain the counter pulse exhibiting the good state over the entire carriage moving range and defined as an output of the comparator. This is attained even when the DC component of the output of the differential amplifier which is inputted to the comparator largely varies due to the carriage position. Consequently, the carriage position detecting accuracy can be improved. A resultant quality of recording by the serial printer Can be also ameliorated.

Furthermore, the waveform of the counter pulse can be approximate to the ideal waveform when the duty ratio is 50%. A sufficient allowance is therefore provided against the passage-of-time change in the output of the differential amplifier, thereby making it possible to reduce a degree of decline in the printing quality with the passage of time. This implies that a frequency of executing the initial adjustment sequence of the reference voltage $V_{ref}$ may be decreased. A user's feeling in operation is improved.

It is apparent that, in this invention, a wide range of different working modes can be formed based on the invention without deviating from the spirit and scope of the invention. This invention is not restricted by its specific working modes except being limited by the appended claims.

What is claimed is:

1. A serial printer comprising:

a carriage reciprocated on an apparatus body;

a recording means, mounted on said carriage, for recording while synchronizing with a movement of said carriage;

a scale portion, provided on said apparatus body, of a linear encoder;

a detecting portion, mounted in said carriage, of said linear encoder, said detecting portion for detecting a position of said scale portion;

a synchronous signal generating means for generating a pulse output as a synchronous signal by comparing a detecting signal from said detecting portion with a reference voltage; and an adjusting means for adjusting a duty of the pulse output when the duty of the pulse output generated by said-synchronous signal generating means fluctuates, wherein said adjusting means effects control so that a duty ratio of the pulse output generated by said synchronous signal generating means comes to 50%, said adjusting means includes a counter for outputting a signal having a duty ratio 50% by measuring a wavelength of a waveform of the pulse output generated by said synchronous signal generating means, and said counter includes a frequency divider means for effecting a ½ frequency division of the pulse waveform of the output signal coming from said synchronous signal generating means and outputting a first signal having a pulse width for one period, a second signal generating means for generating a second signal at a timing which is one-half of the pulse width of the first signal when the first signal is at high and low levels, a third signal generating means for generating a third signal at a leading edge timing of said first signal at the high level and trailing edge timing of the first signal at the low level and a fourth signal generating means for generating, as a signal of the duty ratio 50%, a fourth signal having a pulse width corresponding to an interval between the second and third signals on the basis of the third and fourth signals coming from said second and third signal generating means.

2. A serial printer comprising:

a carriage reciprocated on an apparatus body;

a recording means, mounted on said carriage, for recording while synchronizing with a movement of said carriage;

a scale portion provided on said apparatus body, of a linear encoder;

a detecting portion, mounted in said carriage of said linear encoder, said detecting portion for detecting position of said scale portion;

a synchronous signal generating means for generating a pulse output as a synchronous signal by comparing a detecting signal from said detecting portion with a reference voltage; and an adjusting means for adjusting a duty of the pulse output when the duty of the pulse output generated by said synchronous signal generating means fluctuates, wherein said adjusting means includes an observing means for counting a high level width and a low level width of the pulse of the output signal, a detecting means for detecting a difference between a count value of the high level width and a count value of the low level width of the pulse which are obtained by said observing means and outputting a difference value signal and a control means for controlling the reference voltage on the basis of the difference value signal transmitted from said detecting means.

3. A serial printer comprising:

a carriage reciprocated on an apparatus body;

a recording means, mounted on said carriage, for recording while synchronizing with a movement of said carriage;

a scale portion, provided on said apparatus body of a linear encoder;

a detecting portion mounted in said carriage of said linear encoder said detecting portion for detecting a position of said scale portion;

a synchronous signal generating means for generating a pulse output as a synchronous signal by comparing a detecting signal from said detecting portion with a reference voltage; and an adjusting means for adjusting a duty of the pulse output when the duty of the pulse out generated by said synchronous signal generating means fluctuates wherein said adjusting means includes a power integrator for integrating electric power for a period between the high level width and the low level width of the pulse of the output signal and a voltage comparator for comparing respective voltages obtained by said power integrator and outputting a difference therebetween, and the reference voltage is controlled based on the difference output from said voltage comparator.

4. A serial printer comprising:

a carriage reciprocated on an apparatus body;

a recording means, mounted on said carriage, for recording while synchronizing with a movement of said carriage;

a scale portion, provided on said apparatus body, of a linear encoder;

a detecting portion, mounted in said carriage, of said linear encoder, said detecting portion for detecting a position of said scale portion;

a synchronous signal generating means for generating a pulse output as a synchronous signal by comparing a detecting signal from said detecting portion with a reference voltage; and a noise filtering means for filtering noises having a possibility to enter said synchronous signal generating means, wherein said noise filtering means includes a pulse generating circuit for generating pulses at a leading edge timing and a trailing edge timing of the output signal coming from said synchronous signal generating means, a delay circuit for delaying the pulses from said pulse generating circuit and a circuit for latching and outputting the output signal from said synchronous signal generating means at a rise of the delayed pulse from said delay circuit.

5. A serial printer comprising:

a carriage reciprocated on an apparatus body;

a recording means, mounted on said carriage, for recording while synchronizing with a movement of said carriage;

a scale portion, provided on said apparatus body, of a linear encoder;

a detecting portion, mounted in said carriage, of said linear encoder, said detecting portion for detecting a position of said scale portion;

a reference voltage generating means for generating a reference voltage;

a synchronous signal generating means for generating a pulse output as a synchronous signal by comparing a detecting signal from said detecting portion with a reference voltage from said reference voltage generating means;

a temperature measuring means for measuring a temperature of said detecting portion and generating a temperature signal; and a compensating means for making an adjustment to effect a temperature compensation of the reference voltage from said reference voltage generating means in accordance with the temperature signal from said temperature measuring means.

6. The serial printer according to claim 5, wherein said compensating means includes a memory for storing a proper reference voltage corresponding to each value of the temperature signal.

7. The serial printer according to claim 6, wherein said compensating means further includes an A/D converter for A/D converting the temperature signal as a voltage and a D/A converter for D/A converting the output signal from said memory.

8. The serial printer according to claim 6, wherein said memory stores, per temperature, such a voltage value corresponding to a difference between a high level width and a low level width of the pulse of the output signal from said synchronous signal generating circuit means.

9. The serial printer according to claim 6, wherein said compensating means includes an OP amplifier for performing an amplification at a predetermined multiplying factor to output a proper reference voltage with inputting of the temperature signal from said temperature measuring means.

10. The serial printer according to claim 6, wherein said compensating means includes a first OP amplifier for outputting a predetermined multiplying factor with inputting of the temperature signal from said temperature measuring means and a second OP amplifier for effecting a differential amplification at the predetermined multiplying factor with inputting of an output of said first OP amplifier and of an output of said measuring means.

11. A serial printer comprising:

a carriage reciprocated on an apparatus body;

a recording means, mounted on said carriage, for recording while synchronizing with a movement of said carriage;

a scale portion, provided on said apparatus body, of a linear encoder;

a detecting portion, mounted in said carriage, of said linear encoder, said detecting portion for detecting a position of said scale portion;

a comparing means for comparing a detecting signal from said detecting portion with a base voltage and generating a pulse output;

a base voltage variable means for making the base voltage variable;

a temperature measuring means for measuring a temperature of said detecting portion and generating a temperature signal;

a memory portion for storing a measured result of said temperature measuring means;

a speed control means for controlling a carriage moving speed on the basis of the pulse output from said comparing means; and a duty ratio detecting means for detecting a duty ratio of the pulse output of said comparing means when the carriage moving speed becomes constant.

12. The serial printer according to claim 11, wherein the base voltage of said comparing means is adjusted to set the duty ratio substantially at 50% on the basis of a detected result of said duty ratio detecting means.

13. The serial printer according to claim 12, wherein said temperature measuring means measures a temperature when adjusting the base voltage of said comparing means, and the measured temperature is stored in said memory.

14. A serial printer comprising:

carriage reciprocated on an apparatus body;

a recording means, mounted on said carriage, for recording while synchronizing with a movement of said carriage;

a scale portion, provided on said apparatus body, of a linear encoder;

detecting portion, mounted in said carriage, of said linear encoder, said detecting portion for detecting a position of said scale portion; and a synchronous signal generating means for generating a pulse output as a synchronous signal by comparing a detecting signal from said detecting portion with a reference voltage; and an initial adjusting means for effecting an initial adjustment of the reference voltage inputted to said synchronous signal generating means, wherein said initial adjusting means includes a speed synchronizing means for synchronizing a carriage moving speed with a sampling period for sampling the output signal, a measuring means for measuring a value of the output signal a predetermined number of times on the basis of sampling after said speed synchronizing means has synchronized the carriage moving speed with the sampling period for sampling the output signal and a means for obtaining the reference voltage by averaging the values obtained from said measuring means.

15. The serial printer according to claim 14, wherein said speed synchronizing means is constructed to establish relational formulae such as:

$$T_S = T_{AO}/2^m \text{ (} m \text{ is the integer of 1 or larger)}$$

$$n = k \cdot 2^m \text{(where } m \text{ is the same as } m \text{ in the former formula, and } k \text{ is the integer of 1 or larger)}$$

where $T_{AO}$ is the period of the output signal, $T_S$ is the sampling period, and n is the measurement number.

16. A serial printer comprising:

a carriage reciprocated on an apparatus body;

a recording means, mounted on said carriage, for recording while synchronizing with a movement of said carriage;

a scale portion, provided on said apparatus body, of a linear encoder;

a detecting portion, mounted in said carriage, of said linear encoder, said detecting portion for detecting a position of said scale portion; and a synchronous signal generating means for generating a pulse output as a synchronous signal by comparing a detecting signal from said detecting portion with a reference voltage; and an initial adjusting means for effecting an initial adjustment of the reference voltage inputted to said synchronous signal generating means, wherein said initial adjusting means includes a moving range blocking means for partitioning a carriage moving range into blocks and a reference voltage calculating means for calculating a reference voltage per block subjected to the blocking process through said moving range blocking means.

17. The serial printer according to claim 16, further comprising a speed control means for controlling a carriage speed before said moving range blocking means partitions the carriage moving range into the blocks.

18. The serial printer according to claim 16, wherein said reference voltage calculating means includes a measuring means for measuring a value of the output signal a predetermined number of times on the basis of sampling per block and a means for obtaining a reference voltage by averaging the values obtained from said measuring means with a sampling number.

19. The serial printer according to claim 16, further comprising a printing means for effecting a print for one line on the basis of the reference voltage per block.

20. The serial printer according to claim 16, further comprising a D/A converter for D/A converting the reference voltage obtained from said reference voltage initial adjusting means and inputting a converted result to said comparing means of said synchronous signal generating circuit.

* * * * *

UNITED STATES PATENT AND TRADEMARK OFFICE

CERTIFICATE OF CORRECTION

PATENT NO. : 5,427,461

DATED : June 27, 1995

INVENTOR(S) : YUICHI HIRAI, ET AL.

It is certified that error appears in the above-indentified patent and that said Letters Patent is hereby corrected as shown below:

IN THE DRAWINGS:

SHEET 37

Figures 40A, 40B:
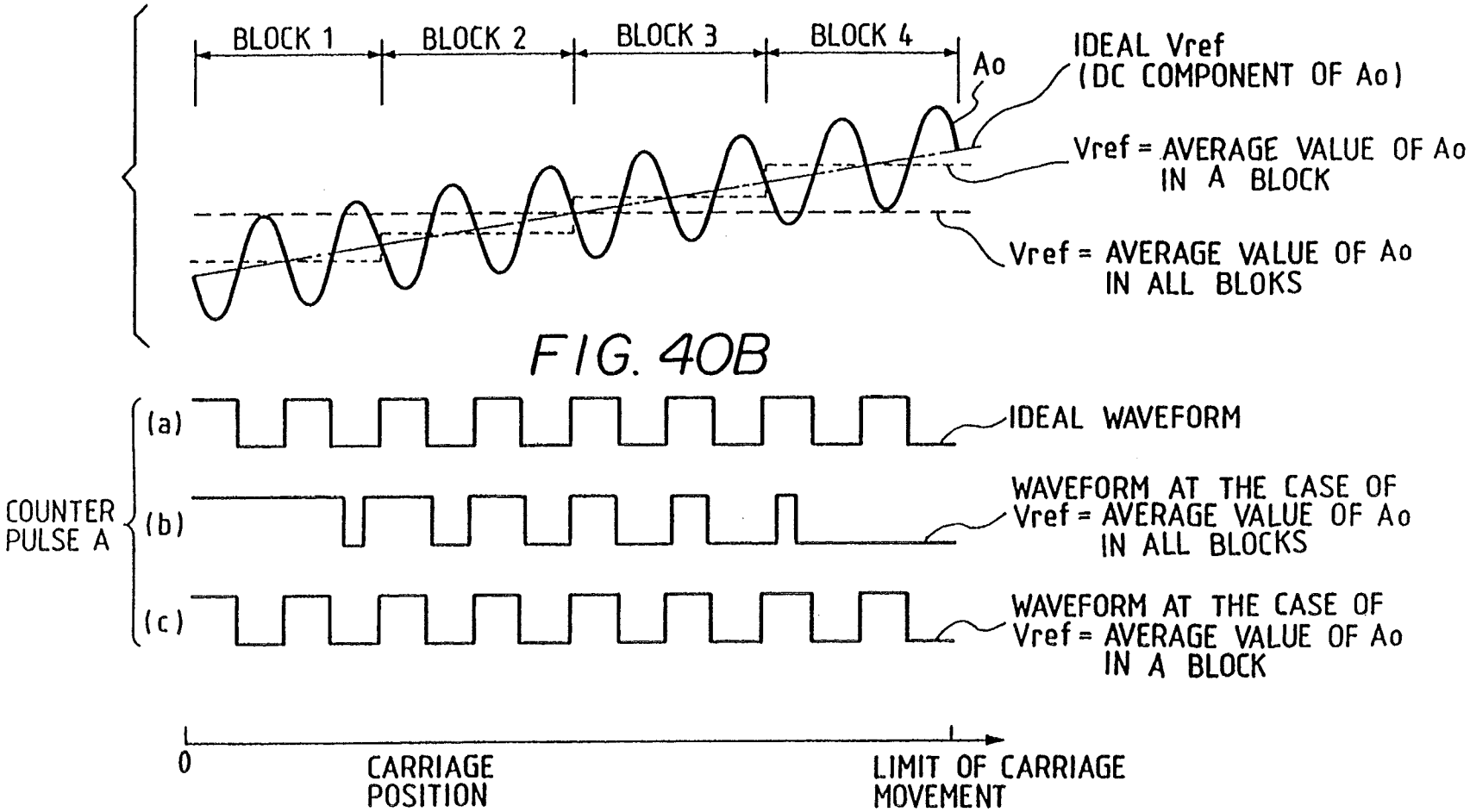
FIG. 40A and 40B comprise a time chart showing a relationship between the input, the reference voltage and the output of the comparator shown in FIG. 34.

Figure 40A, "BLOKS" should read --BLOCKS--.

Column 6

Line 54, "215c" should read --215--.

Column 8

Line 5, "High" should read --high--; and
Line 6, "Low" should read --low--.

Column 11

Line 33, "jected" should read --jected to--; and
Line 49, "Just" should read --just--.

Column 20

Line 17, "position," should read --position.--.

Column 25

Line 10, "EEPROM." should read --EEPROM,--.

Column 26

Line 2 , "$V_{ref}$," should read --$V_{ref}$--.

UNITED STATES PATENT AND TRADEMARK OFFICE

CERTIFICATE OF CORRECTION

PATENT NO. : 5,427,461

DATED : June 27, 1995

INVENTOR(S) : YUICHI HIRAI, ET AL.

It is certified that error appears in the above-indentified patent and that said Letters Patent is hereby corrected as shown below:

Column 28

Line 5, "Can" should read --can--;
Line 39, "said-synchronous" should read --said synchronous--; and
Line 60, "and" should read --and a--.

Column 29

Line 6, "portion" should read --portion,--;
Line 8, "carriage" should read --carriage,--;
Line 9, "detecting" should read --detecting a--;
Line 35, "body" should read --body,--;
Line 37, "portion" should read --portion,--; and "carriage" should read --carriage,--
Line 38, "encoder" should read --encoder,--; and
Line 47, "ates" should read --ates,--.

UNITED STATES PATENT AND TRADEMARK OFFICE

CERTIFICATE OF CORRECTION

PATENT NO. : 5,427,461

DATED : June 27, 1995

INVENTOR(S) : YUICHI HIRAI, ET AL.

It is certified that error appears in the above-indentified patent and that said Letters Patent is hereby corrected as shown below:

Column 30

Line 55, "circuit" should be deleted.

Column 31

Line 45, "detecting" should read --a detecting--.

Signed and Sealed this

Seventeenth Day of October, 1995

*Attest:*

*Attesting Officer*

BRUCE LEHMAN

*Commissioner of Patents and Trademarks*